US009645518B2

(12) United States Patent
Abe et al.

(10) Patent No.: US 9,645,518 B2
(45) Date of Patent: May 9, 2017

(54) TONER

(71) Applicant: CANON KABUSHIKI KAISHA, Tokyo (JP)

(72) Inventors: Koji Abe, Numazu (JP); Yuhei Terui, Numazu (JP); Taiji Katsura, Suntou-gun (JP); Naoya Isono, Suntou-gun (JP); Katsuyuki Nonaka, Mishima-shi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/746,499

(22) Filed: Jun. 22, 2015

(65) Prior Publication Data

US 2015/0378274 A1 Dec. 31, 2015

(30) Foreign Application Priority Data

Jun. 26, 2014 (JP) ..... 2014-131706

(51) Int. Cl.
*G03G 9/097* (2006.01)
*G03G 9/093* (2006.01)

(52) U.S. Cl.
CPC ..... *G03G 9/09328* (2013.01); *G03G 9/09364* (2013.01); *G03G 9/09392* (2013.01)

(58) Field of Classification Search
CPC ..... G03G 9/09307; G03G 9/09314; G03G 9/09328; G03G 9/09342; G03G 9/09392
See application file for complete search history.

(56) References Cited

U.S. PATENT DOCUMENTS

| | | | | |
|---|---|---|---|---|
| 8,980,517 | B2 * | 3/2015 | Kawaguchi | G03G 9/09775 430/110.1 |
| 2010/0159375 | A1 | 6/2010 | Zhou et al. | |
| 2014/0186762 | A1 * | 7/2014 | Abe | G03G 9/09 430/108.21 |

FOREIGN PATENT DOCUMENTS

| | | | |
|---|---|---|---|
| JP | H03-089361 | A | 4/1991 |
| JP | H08-095284 | A | 4/1996 |
| JP | 2001-075304 | A | 3/2001 |
| JP | 2006-146056 | A | 6/2006 |

* cited by examiner

*Primary Examiner* — Peter Vajda
(74) *Attorney, Agent, or Firm* — Canon U.S., Inc. IP Division

(57) ABSTRACT

A toner contains toner particles having a surface layer containing an organosilicon polymer.
The organosilicon polymer has a particular partial structure.
The surface layer has a particular average thickness Dav.
The ratio of silicon ions to carbon ions emitted from the toner particles in response to irradiation of the toner particles with primary ions in mapping measurement by FIB-TOF-SIMS is specified.

11 Claims, 2 Drawing Sheets

TONER

BACKGROUND OF THE INVENTION

Field of the Invention

The present invention relates to a toner for developing electrostatic images (electrostatic latent images) for use in image-forming methods, such as electrophotography and electrostatic printing.

Description of the Related Art

With recent advances in computers and multimedia, there has been a demand for means for outputting high-definition full-color images in various fields, including offices and homes.

For business use involving frequent copy and printing, there is a demand for high endurance without deterioration of image quality even after many copies and prints are output. For use in small offices and homes, there is a demand for small apparatuses from the space-saving, energy-saving, and weight-saving perspectives, as well as a demand for high-quality images. In order to meet these demands, it is necessary to improve toner performance, such as environmental stability, low-temperature fixability, development endurance, and storage stability.

In particular, in the case of full-color images formed of superposed color toners, various color toners must be developed in the same manner, otherwise poor color reproduction and color non-uniformity occur. For example, when a pigment or dye used as a colorant for toner is precipitated on the surface of toner particles, this may affect developability and cause color non-uniformity.

Fixability and color mixture properties are also important in full-color images. For example, although binder resins effective in low-temperature fixability are selected in order to meet the demand for high-speed printing, such binder resins greatly affect developability and endurance.

There is also a demand for toners that can be used for extended periods and produce high-definition full-color images at various temperatures and humidities. In order to meet these demands, it is necessary to reduce variations in the amount of electrical charge of toner and variations in toner surface properties due to different operating environments, such as temperature and humidity. It is also necessary to reduce soiling of components, such as a developing roller, a charging roller, a regulating blade, and a photosensitive drum. Thus, there is a demand for toners that have stable chargeability, cause no soiling of components, and have consistent development endurance even after long-term storage in various environments.

Variations in storage stability or in the amount of electrical charge of toner depending on the temperature and humidity can be caused by a release agent or a resin component of the toner bleeding from the interior to the surface of the toner (hereinafter also referred to simply as bleed) and changing the surface properties of the toner.

Such problems may be solved by a method for covering the surface of toner particles with resin.

Japanese Patent Laid-Open No. 2006-146056 discloses a toner having inorganic fine particles firmly adhered to the surface thereof as a toner having good high-temperature storage stability and printing endurance in a normal temperature and humidity environment or in high temperature and high humidity environments.

However, even in the toner having inorganic fine particles firmly adhered to the surface of toner particles, a release agent or a resin component may bleed through a space between the inorganic fine particles, and the inorganic fine particles may detach from the surface due to degradation. Thus, the endurance of toner and soiling of components in severe environments should be further improved.

Japanese Patent Laid-Open No. 03-089361 discloses a method for producing a polymerized toner by adding a silane coupling agent to a reaction system in order to produce a toner that has no colorant or polar substance exposed on the surface thereof, has a narrow electrical charge distribution, and has the amount of electrical charge largely independent of humidity. However, in such a method, precipitation and hydrolytic polycondensation of a silane compound on the toner surface are insufficient, and environmental stability and development endurance need to be further improved.

Japanese Patent Laid-Open No. 08-095284 discloses a polymerized toner covered with a silane compound in order to control the amount of electrical charge of the toner and to form high-quality print images at any temperature and at any humidity. However, high polarity of an organic functional group of the silane compound results in insufficient precipitation and hydrolytic polycondensation of the silane compound on the toner surface. As a result, it is necessary to reduce variations in image density due to variations in chargeability in high temperature and high humidity environments, to reduce soiling of components due to toner melt adhesion, and to improve storage stability.

Japanese Patent Laid-Open No. 2001-75304 discloses a polymerized toner having a covering layer formed by adhesion of agglomerates containing a silicon compound as a toner that has improved flowability, a less likelihood of separation of a fluidizer, improved low-temperature fixability, and improved blocking properties. However, it is necessary to further reduce the bleed of a release agent or a resin component through a space between the agglomerates containing the silicon compound. It is also necessary to reduce variations in image density due to variations in chargeability in high temperature and high humidity environments resulting from insufficient precipitation and hydrolytic polycondensation of a silane compound on the toner surface, to reduce soiling of components due to toner melt adhesion, and to improve storage stability.

SUMMARY OF THE INVENTION

The present invention provides a toner not having the problems described above. More specifically, the present invention provides a toner having good environmental stability, low-temperature fixability, development endurance, and storage stability.

As a result of extensive studies, the present inventors arrived at the present invention by finding that the following structure can solve the problems.

The present invention provides a toner containing toner particles, each of which has a surface layer containing an organosilicon polymer, wherein the organosilicon polymer has a partial structure represented by the following formula (T3), $$R—Si(O_{1/2})_3 \quad (T3)$$

wherein R denotes an alkyl group having 1 to 6 carbon atoms or a phenyl group, wherein the surface layer has an average thickness Dav. of 5.0 nm or more and 150.0 nm or less as measured by observing a cross section of each of the toner particles with a transmission electron microscope (TEM), and the toner has a ratio (ASi/AC) of 20.00 or more in mapping measurement by focused-ion-beam time-of-flight secondary ion mass spectrometry (FIB-TOF-SIMS), wherein ASi denotes ISi/I, AC denotes IC/I, ISi denotes an intensity of silicon ions, IC denotes an intensity of carbon ions, and I denotes the number of primary ions, the silicon ions and carbon ions being emitted from the toner particles in response to irradiation of the toner particles with the primary ions.

Further features of the present invention will become apparent from the following description of exemplary embodiments with reference to the attached drawings.

DESCRIPTION OF THE EMBODIMENTS

Figure 1:
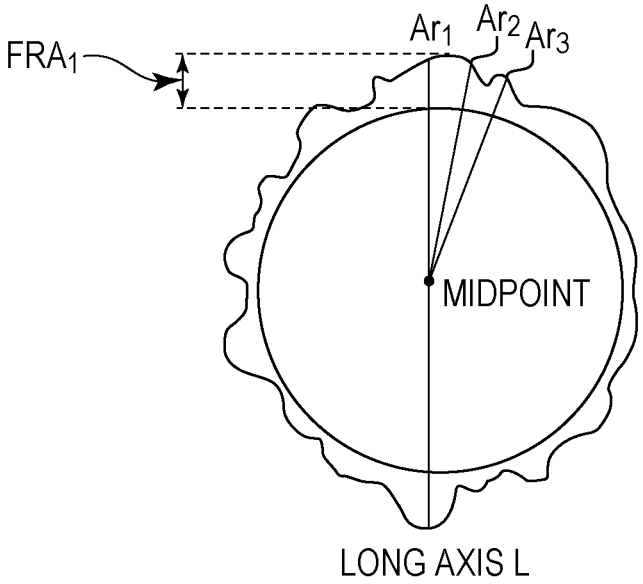
FIG. 1 is a schematic view of a cross section image of a toner particle observed with a TEM.

The present invention will be described in detail below.

A toner according to an embodiment of the present invention is a toner containing toner particles, each of which has a surface layer containing an organosilicon polymer, wherein the organosilicon polymer has a partial structure represented by the following formula (T3), $$R—Si(O_{1/2})_3 \quad (T3)$$

wherein R denotes an alkyl group having 1 to 6 carbon atoms or a phenyl group, wherein the surface layer has an average thickness Dav. of 5.0 nm or more and 150.0 nm or less as measured by observing a cross section of each of the toner particles with a transmission electron microscope (TEM), and the toner has a ratio (ASi/AC) of 20.00 or more in mapping measurement by focused-ion-beam time-of-flight secondary ion mass spectrometry (FIB-TOF-SIMS), wherein ASi denotes ISi/I, AC denotes IC/I, ISi denotes an intensity of silicon ions, IC denotes an intensity of carbon ions, and I denotes the number of primary ions, the silicon ions and carbon ions being emitted from the toner particles in response to irradiation of the toner particles with the primary ions.

Because of endurance due to the T3 structure of the organosilicon polymer and the hydrophobicity and chargeability of R in the formula (T3), it is possible to reduce the bleed of a low-molecular-weight (Mw 1000 or less) resin, a low-Tg (40° C. or less) resin, and, in some cases, a release agent, which are present within the toner rather than in the surface layer and are likely to bleed. This can improve agitation of the toner. Thus, the toner can have high storage stability and good environmental stability and development endurance with respect to printing endurance at a high image printing ratio of 30% or more.

In the partial structure represented by the formula (T3), R denotes an alkyl group having 1 to 6 carbon atoms or a phenyl group. Variations in the amount of electrical charge in various environments tend to increase with the hydrophobicity of R. In particular, an alkyl group having 1 to 5 carbon atoms results in high environmental stability.

In an embodiment of the present invention, when R denotes an alkyl group having 1 to 3 carbon atoms, particularly a methyl group, chargeability and prevention of fogging are further improved. Good chargeability results in good transferability and less untransferred toner, which can reduce soiling of a photosensitive drum, a charging member, and a transfer member.

[ASi/AC]

In an embodiment of the present invention, it is important that the toner has a ratio (ASi/AC) of 20.00 or more in mapping measurement by focused-ion-beam time-of-flight secondary ion mass spectrometry (hereinafter also referred to as FIB-TOF-SIMS), wherein ASi denotes ISi/I, AC denotes IC/I, ISi denotes the intensity of silicon ions (the current value of a SIMS detector), IC denotes the intensity of carbon ions (the current value of a SIMS detector), and I denotes the number of primary ions. The silicon ions (m/z=27.50 to 28.50) and carbon ions (m/z=11.50 to 12.50) are emitted from the toner particles in response to irradiation of the toner particles with the primary ions. In toner particles having a surface layer containing an organosilicon polymer, ASi/AC of 20.00 or more means that the surface layer is rich in the organosilicon polymer. This reduces the surface free energy of the toner particles, reduces soiling of components, and consequently improves development endurance. The ratio (ASi/AC) in an embodiment of the present invention is determined under conditions where the integral dose rate of toner particles is $1.66\times10^{19}$ (counts/$m^2$). The integral dose rate refers to the total number of primary ions incident on the toner particles due to etching with a focused ion beam.

ASi/AC is preferably 40.00 or more, more preferably 60.00 or more.

The organosilicon polymer can be produced by polymerization of an organosilicon compound having a structure represented by the following formula (1):

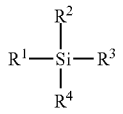

(1)

wherein $R^1$ denotes an alkyl group having 1 to 6 carbon atoms or a phenyl group, and $R^2$, $R^3$, and $R^4$ independently denote a halogen atom, a hydroxy group, an acetoxy group, or an alkoxy group.

ASi/AC can be controlled via the number of carbon atoms in the structure of R represented by the formula (T3), the number of carbon atoms in the structure of $R^1$ represented by the formula (1), hydrolysis conditions, and the reaction temperature, reaction time, reaction solvent, and pH of addition polymerization and condensation polymerization. For example, the number of carbon atoms of $R^1$ is preferably 5 or less, more preferably 3 or less, still more preferably 2 or less. The compound having the structure represented by the formula (1) is preferably polymerized at a reaction temperature of 85° C. or more for a reaction time of 5 hours or more, more preferably at a reaction temperature of 100° C. or more for a reaction time of 5 hours or more. The pH of a reaction solvent for use in the reaction of the compound having the structure represented by the formula (1) is preferably 4.0 or more and 12.0 or less, more preferably 8.5 or more and 11.0 or less. The amount of the organosilicon polymer on the surface of the toner particles can be increased by polymerization of a monomer composition containing the compound having the structure represented by the formula (1) under such reaction conditions.

The presence of the organosilicon polymer in the surface layer of the toner particles as well as on the surface of the toner particles can also be detected by partly etching the surface layer of the toner particles with a focused ion beam and measuring ASi/AC.

The surface layer containing the organosilicon polymer in the toner particles can reduce the bleed of a resin component or a release agent. Thus, the toner can have good development endurance, storage stability, and environmental stability. With respect to the integral dose rate of toner particles, the etch depth depends on the hardness of the surface of the toner particles and the material composition of the toner particles. [The percentage of toner particles in which the average thickness Dav. of the surface layer containing the organosilicon polymer in the toner particles and the thickness of the surface layer containing the organosilicon polymer are 5.0 nm or less.]

The average thickness Dav. of the surface layer containing the organosilicon polymer in the toner particles measured by observing a cross section of each of the toner particles with a transmission electron microscope (TEM) must be 5.0 nm or more and 150.0 nm or less. In an embodiment of the present invention, the surface layer containing the organosilicon polymer can be in contact with a portion other than the toner particle surface layer (a core portion) with no space therebetween. In other words, the surface layer may not be a covering layer formed of agglomerates. This can reduce the bleed of a release agent or a resin component. Thus, the toner can have high storage stability, environmental stability, and development endurance without degradation in low-temperature fixability. From the perspective of storage stability, the average thickness Dav. of the surface layer containing the organosilicon polymer in the toner particles is preferably 10.0 nm or more and 150.0 nm or less, more preferably 10.0 nm or more and 125.0 nm or less, still more preferably 15.0 nm or more and 100.0 nm or less.

The average thickness Dav. of the surface layer containing the organosilicon polymer in the toner particles can be controlled via the number of carbon atoms of R in the formula (T3), the number of carbon atoms of $R^1$ in the formula (1), and the reaction temperature, reaction time, reaction solvent, and pH of hydrolysis, addition polymerization, and condensation polymerization. The average thickness Dav. can also be controlled via the organosilicon polymer content.

In order to increase the average thickness Dav. of the surface layer containing the organosilicon polymer in the toner particles, the number of carbon atoms of $R^1$ is preferably 5 or less, more preferably 3 or less, still more preferably 2 or less. When the number of carbon atoms of $R^1$ is 5 or less, the organosilicon polymer is more likely to be present in the surface layer of the toner particles.

The average thickness Dav. of the surface layer containing the organosilicon polymer in the toner particles is determined by the following method.

The average thickness $D^{(n)}$ of the surface layer containing the organosilicon polymer in one toner particle is determined by the following method.

In observation of a cross section of each of the toner particles with a transmission electron microscope (TEM), i) the longest chord in the cross section of each of the toner particle is taken as a long axis L, ii) one of line segments formed by dividing the long axis L at the midpoint thereof is denoted by a line segment a, and iii) 32 line segments drawn from the midpoint of the long axis L to the surface of the toner particle at intervals of 11.25 degrees with respect to the line segment a is denoted by $Ar_n$ (n=1 to 32).

Furthermore, the length of the surface layer along the $Ar_n$ (n=1 to 32) is denoted by $FRA_n$ (n=1 to 32).

$$D^{(n)}=(\text{Sum of } FRA_n(n=1 \text{ to } 32))/32$$

This calculation is performed for 10 toner particles. The average thickness Dav. of the surface layers containing the organosilicon polymer of the toner particles is calculated by averaging the thicknesses $D^{(n)}$ (n is an integer of 1 to 10) of the 10 toner particles using the following equation.

$$Dav.=\{D^{(1)}+D^{(2)}+D^{(3)}+D^{(4)}+D^{(5)}+D^{(6)}+D^{(7)}+D^{(8)}+D^{(9)}+D^{(10)}\}/10$$

An organosilicon polymer in an embodiment of the present invention can have the maximum ASi/AC in the uppermost surface layer of a toner particle. Such a structure of the toner particle can reduce the bleed of a resin component or a release agent. Thus, the toner can have high storage stability, environmental stability, and development endurance. In an embodiment of the present invention, the uppermost surface layer of the toner particle has a thickness of 0.0 nm or more and 10.0 nm or less from the surface of the toner particle.

The percentage K of line segments $Ar_n$ having $FRA_n$ of 5.0 nm or less (=the percentage that the thickness of the surface layer is 5.0 nm or less) is preferably 20.0% or less, more preferably 10.0% or less, still more preferably 5.0% or less (see FIG. 1).

When the percentage K of line segments $Ar_n$ having $FRA_n$ of 5.0 nm or less is 20.0% or less, the toner has more stable charging characteristics regardless of environmental variations.

The average thickness Dav. of the surface layer containing the organosilicon polymer in the toner particles and the percentage K can be controlled via the number of carbon atoms of R in the formula (T3), the number of carbon atoms of $R^1$ in the formula (1), temperature, reaction time, reaction solvent, and pH. The average thickness Dav. and the percentage K can also be controlled via the organosilicon polymer content.

The percentage K was determined by the following method.

First, the percentage K' is calculated for one toner particle using the following equation.

$$\text{Percentage } K' \text{ of } Ar_n \text{ having } FRA_n \text{ of 5.0 nm or less} = ((\text{Number of line segments having } FRA_n \text{ of 5.0 nm or less})/32)\times 100$$

The percentage K' is then calculated for 10 toner particles. The arithmetic mean of the 10 percentages is calculated as the percentage K.

[Concentration of Silicon Elements on Surface of Toner Particles]

The concentration of silicon elements on the surface of toner particles of a toner according to an embodiment of the present invention is 2.5 atomic percent or more, more preferably 5.0 atomic percent or more, still more preferably 10.0 atomic percent, as measured by electron spectroscopy for chemical analysis (ESCA). ESCA is an elementary analysis of the outermost surface having a thickness of several nanometers. When the concentration of silicon elements in the uppermost surface layer of the toner particles is 2.5 atomic percent or more, the uppermost surface layer can have lower surface free energy. When the concentration of silicon elements is adjusted to be 2.5 atomic percent or more, the toner has improved flowability, and soiling of components and fogging can be further suppressed. The concentration of silicon elements in the uppermost surface layer of the toner particles can be controlled via the number of carbon atoms of R in the formula (T3), the structure of $R^1$ in the formula (1), reaction temperature, reaction time, reaction solvent, and pH. The concentration of silicon elements in the uppermost surface layer of the toner particles can also be controlled via the organosilicon polymer content.

[Compounds for Use in Production of Organosilicon Polymer]

The organosilicon polymer can be produced by polymerization of a polymerizable monomer containing a compound having a structure represented by the following formula (1):

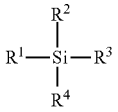

(1)

wherein $R^1$ denotes an alkyl group having 1 to 6 carbon atoms or a phenyl group, and $R^2$, $R^3$, and $R^4$ independently denote a halogen atom, a hydroxy group, an acetoxy group, or an alkoxy group.

The organosilicon polymer in the surface layer of the toner particles can improve the hydrophobicity of the surface of the toner particles. This can improve the environmental stability of the toner. An alkyl group of $R^1$ can improve hydrophobicity. Thus, the toner particles can have good environmental stability. $R^1$ can be an alkyl group having 1 to 6 carbon atoms or a phenyl group. Variations in the amount of electrical charge in various environments tend to increase with the hydrophobicity of $R^1$. Thus, $R^1$ can be an alkyl group having 1 to 3 carbon atoms in terms of environmental stability.

Examples of the alkyl group having 1 to 3 carbon atoms include, but are not limited to, a methyl group, an ethyl group, and a propyl group. Use of such an alkyl group results in improved chargeability and prevention of fogging. From the perspective of environmental stability and storage stability, $R^1$ can be a methyl group. Because of hydrophobicity and chargeability of $R^1$ in the formula (1), it is possible to reduce the bleed of a low-molecular-weight (Mw 1000 or less) resin, a low-Tg (40° C. or less) resin, and, in some cases, a release agent, which are present within the toner rather than in the surface layer and are likely to bleed on the toner surface. This can improve agitation of the toner. Thus, the toner can have high storage stability and good environmental stability and development endurance with respect to printing endurance at a high image printing ratio of 30% or more.

In order to contain the organosilicon polymer in the surface layer, the number of carbon atoms of $R^1$ is preferably 5 or less, more preferably 3 or less, still more preferably 2 or less.

$R^2$, $R^3$, and $R^4$ independently denote a halogen atom, a hydroxy group, or an alkoxy group ($R^2$, $R^3$, and $R^4$ are hereinafter also referred to as reactive groups). These reactive groups undergo hydrolysis, addition polymerization, or condensation polymerization to form a cross-linked structure. Such a cross-linked structure on the surface of the toner particles can improve the development endurance of the toner. In particular, from the perspective of slow hydrolysis and the precipitation and coatability of the organosilicon polymer on the surface of the toner particles, $R^2$, $R^3$, and $R^4$ can independently denote an alkoxy group, such as a methoxy group or an ethoxy group. Hydrolysis, addition polymerization, or condensation polymerization of $R^2$, $R^3$, and $R^4$ can be controlled via the reaction temperature, reaction time, reaction solvent, and pH.

[Method for Producing Organosilicon Polymer]

A typical method for producing an organosilicon polymer according to an embodiment of the present invention is a sol-gel method. In the sol-gel method, a metal alkoxide $M(OR)_n$ (M: metal, O: oxygen, R: hydrocarbon, n: the valence of the metal) is used as a starting material. The metal alkoxide is subjected to hydrolysis and condensation polymerization in a solvent and is transformed into a gel via a sol state. This method is used for the synthesis of glass, ceramics, organic-inorganic hybrids, and nanocomposites. Functional materials having various shapes, such as surface layers, fibers, bulks, and fine particles, can be produced by the method from a liquid phase at low temperatures.

More specifically, the surface layer of the toner particles is formed by hydrolytic polycondensation of a silicon compound, such as an alkoxysilane. Since the surface layer is uniformly formed on the surface of the toner particles, unlike known toners, the toner can have improved environmental stability, be less prone to performance degradation during long-term use, and have high storage stability without sticking or adhering inorganic fine particles to the surface of the toner.

Since a solution is transformed into a gel by the sol-gel method, materials having various fine structures and shapes can be produced. In particular, when toner particles are produced in an aqueous medium, the surface layer can be easily formed on the surface of the toner particles due to the hydrophilicity of a hydrophilic group, such as a silanol group, of an organosilicon compound. When the organosilicon compound has high hydrophobicity (for example, when the organosilicon compound has a hydrophobic functional group), however, the organosilicon compound is rarely precipitated on the surface layer of toner particles, and a surface layer containing an organosilicon polymer is rarely formed on the toner particles. When the structure $R^1$ in the formula (1) of the organosilicon compound has no carbon atom, the toner tends to have low charging stability due to excessively low hydrophobicity. The fine structure and shape can be adjusted via the reaction temperature, reaction time, reaction solvent, pH, and the type and amount of organosilicon compound.

Thus, the organosilicon polymer is produced by using at least one organosilicon compound having three reactive groups ($R^2$, $R^3$, and $R^4$) except $R^1$ in the formula (1) (hereinafter also referred to as a trifunctional silane).

Examples of the compound having the structure represented by the formula (1) include, but are not limited to, trifunctional methylsilanes, such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane, trifunctional silanes, such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltri-ethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane, and trifunctional phenylsilanes, such as phenyltrimethoxysilane, phenyltriethoxysilane, phenyltrichlorosilane, phenyltriacetoxysilane, and phenyltrihydroxysilane.

In an organosilicon polymer used in an embodiment of the present invention, the T unit structure represented by the formula (T3) preferably constitutes 50% or more, more preferably 60% or more, by mole of the organosilicon polymer. When the T unit structure represented by the formula (T3) constitutes 50% or more by mole, the toner can have improved environmental stability.

An organosilicon polymer produced by using an organosilicon compound having the T unit structure represented by the formula (T3) in combination with the following compound may be used in an embodiment of the present invention, provided that the advantages of the present invention are not significantly reduced:

an organosilicon compound having four reactive groups (tetrafunctional silane), an organosilicon compound having two reactive groups (bifunctional silane), or an organosilicon compound having one reactive group (monofunctional silane).

Examples of such an additional organosilicon compound include, but are not limited to, dimethyldiethoxysilane, tetraethoxysilane, hexamethyldisilazane, 3-glycidoxypropyltrimethoxysilane, 3-glycidoxypropylmethyldiethoxysilane, 3-glycidoxypropyltriethoxysilane, p-styryltrimethoxysilane, 3-methacryloxypropylmethyldimethoxysilane, 3-methacryloxypropylmethyldiethoxysilane, 3-methacryloxypropyltriethoxysilane, 3-acryloxypropyltrimethoxysilane, 3-aminopropyltrimethoxysilane, 3-aminopropyltriethoxysilane, 3-(2-aminoethyl)aminopropyltrimethoxysilane, 3-(2-aminoethyl)aminopropyltriethoxysilane, 3-phenylaminopropyltrimethoxysilane, 3-anilinopropyltrimethoxysilane, 3-mercaptopropylmethyldimethoxysilane, 3-mercaptopropyltrimethoxysilane, 3-mercaptopropyltriethoxysilane, 3-glycidoxypropyltrimethoxysilane, 3-glycidoxypropylmethyldimethoxysilane, 3-glycidoxypropylmethyldiethoxysilane, hexamethyldisilane, tetraisocyanatesilane, methyltriisocyanatesilane, t-butyldimethylchlorosilane, t-butyldimethylmethoxysilane, t-butyldimethylethoxysilane, t-butyldiphenylchlorosilane, t-butyldiphenylmethoxysilane, t-butyldiphenylethoxysilane, chloro(decyl)dimethylsilane, methoxy(decyl)dimethylsilane, ethoxy(decyl)dimethylsilane, chlorodimethylphenylsilane, methoxydimethylphenylsilane, ethoxydimethylphenylsilane, chlorotrimethylsilane, methoxytrimethylsilane, ethoxytrimethylsilane, triphenylchlorosilane, triphenylmethoxysilane, triphenylethoxysilane, chloromethyl(dichloro)methylsilane, chloromethyl(dimethoxy)methylsilane, chloromethyl(diethoxy)methylsilane, di-tert-butyldichlorosilane, di-tert-butyldimethoxysilane, di-tert-butyldiethoxysilane, dibutyldichlorosilane, dibutyldimethoxysilane, dibutyldiethoxysilane, dichlorodecylmethylsilane, dimethoxydecylmethylsilane, diethoxydecylmethylsilane, dichlorodimethylsilane, dimethoxydimethylsilane, diethoxydimethylsilane, dichloro(methyl)-n-octylsilane, dimethoxy(methyl)-n-octylsilane, and diethoxy(methyl)-n-octylsilane.

It is known that the bonding state of the resulting siloxane bond generally depends on the acidity of the reaction medium in the sol-gel reaction. More specifically, in the case of acidic reaction media, a hydrogen ion undergoes electrophilic addition to an oxygen of one reactive group (for example, an alkoxy (—OR) group). Oxygen atoms of water molecules coordinate to silicon atoms and form hydrosilyl groups through a substitution reaction. In the presence of sufficient water, one $H^+$ attacks one oxygen of the reactive group (for example, an alkoxy (-OR) group), and a low $H^+$ content of the reaction medium results in a slow substitution reaction of the hydroxy group. Thus, a polycondensation reaction occurs before all of the reactive groups bonded to silane are hydrolyzed, and a one-dimensional linear polymer or a two-dimensional polymer is relatively easily formed.

In the case of alkaline reaction media, a hydroxide ion adds to silicon and forms a five-coordinate intermediate. Thus, all of the reactive groups (for example, an alkoxy (—OR) group) are easily desorbed and are easily substituted by a silanol group. In particular, when the silicon compound has 3 or more reactive groups bonded to the same silane, hydrolysis and polycondensation occur three-dimensionally, and an organosilicon polymer having many three-dimensional cross-links is formed. Furthermore, the reaction is completed in a short time.

Thus, the organosilicon polymer can be formed through a sol-gel reaction in an alkaline reaction medium. More specifically, the organosilicon polymer can be formed in an aqueous medium at a pH of 8.0 or more. The organosilicon polymer thus formed can have higher strength and endurance. The sol-gel reaction is preferably performed at a temperature of 85° C. or more for 5 hours or more. Formation of coalesced particles composed of a silane compound in a sol or gel state on the surface of toner particles can be reduced in the sol-gel reaction at this reaction temperature and for this reaction time.

The organosilicon compound may be used in combination with an organotitanium compound or an organoaluminum compound.

Examples of the organotitanium compound include, but are not limited to, o-allyloxy(poly(ethylene oxide))triisopropoxy titanate, titanium allylacetoacetate triisopropoxide, titanium bis(triethanolamine)diisopropoxide, titanium tetra-n-butoxide, titanium tetra-n-propoxide, titanium chloride triisopropoxide, titanium chloride triisopropoxide, titanium di-n-butoxide(bis-2,4-pentanedionate), titanium chloride diethoxide, titanium diisopropoxide(bis-2,4-pentanedionate), titanium diisopropoxide bis(tetramethylheptanedionate), titanium diisopropoxide bis(ethylacetoacetate), titanium tetraethoxide, titanium 2-ethylhexyoxide, titanium tetraisobutoxide, titanium tetraisopropoxide, titanium lactate, titanium methacrylate isopropoxide, titanium methacryloxyethylacetoacetate triisopropoxide, (2-methacryloxyethoxy)triisopropoxy titanate, titanium tetramethoxide, titanium methoxypropoxide, titanium methylphenoxide, titanium n-nonyloxide, titanium oxide bis(pentanedionate), titanium n-propoxide, titanium stearyloxide, titanium tetrakis(bis2,2-(allyloxymethyl) butoxide), titanium triisostearoyl isopropoxide, titanium methacrylate methoxyethoxide, tetrakis(trimethylsiloxy)titanium, titanium tris(dodecylbenzenesulfonate)isopropoxide, and titanocene diphenoxide.

Examples of the organoaluminum compound include, but are not limited to, aluminum(III) tri-n-butoxide, aluminum(III) tri-s-butoxide, aluminum(III) di-s-butoxide bis(ethylacetoacetate), aluminum(III) tri-t-butoxide, aluminum(III) di-s-butoxide ethylacetoacetate, aluminum(III) diisopropoxide ethylacetoacetate, aluminum(III) triethoxide, aluminum hexafluoropentanedionate, aluminum(III) 3-hydroxy-2-methyl-4-pyronate, aluminum(III) triisopropoxide, aluminum-9-octadecenylacetoacetate diisopropoxide, aluminum (III) 2,4-pentanedionate, aluminum triphenoxide, and aluminum(III) 2,2,6,6-tetramethyl-3,5-heptanedionate.

These organotitanium compounds and organoaluminum compounds may be used alone or in combination. The amount of electrical charge can be altered by combining these compounds or by changing the amount of these compounds.

[Method for Producing Toner Particles]

A method for producing toner particles will be described below.

Specific embodiments for containing an organosilicon polymer in a surface layer of toner particles will be described below. The present invention is not limited to these embodiments.

A method for producing toner particles according to a first embodiment of the present invention includes forming particles of a polymerizable monomer composition containing a polymerizable monomer, a colorant, and an organosilicon compound in an aqueous medium, and polymerizing the polymerizable monomer to produce the toner particles (hereinafter also referred to as a suspension polymerization method).

A method for producing toner particles according to a second embodiment of the present invention includes obtaining a toner base in advance, putting the toner base into an aqueous medium, and forming a surface layer composed of an organosilicon polymer on the toner base in the aqueous medium.

The toner base may be produced by melt-kneading and grinding a binder resin and a colorant. The toner base may also be produced by agglomeration and association of binder resin particles and colorant particles in an aqueous medium. The toner base may also be produced by dissolving a binder resin, a silane compound, and a colorant in an organic solvent to produce an organic phase dispersion liquid, suspending, granulating (forming particles), and polymerizing the organic phase dispersion liquid in an aqueous medium, and removing the organic solvent.

A method for producing toner particles according to a third embodiment of the present invention includes dissolving a binder resin, a silane compound, and a colorant in an organic solvent to produce an organic phase dispersion liquid, suspending, granulating (forming particles), and polymerizing the organic phase dispersion liquid in an aqueous medium, and removing the organic solvent.

A method for producing toner particles according to a fourth embodiment of the present invention includes subjecting binder resin particles, colorant particles, and particles containing an organosilicon compound in a sol or gel state to agglomeration and association in an aqueous medium.

A method for producing toner particles according to a fifth embodiment of the present invention includes spraying a surface of a toner base with a solvent containing an organosilicon compound by a spray-drying method to form a surface layer containing the organosilicon compound. The toner base may be produced by melt-kneading and grinding a binder resin and a colorant. The toner base may also be produced by agglomeration and association of binder resin particles and colorant particles in an aqueous medium. The toner base may also be produced by dissolving a binder resin, a silane compound, and a colorant in an organic solvent to produce an organic phase dispersion liquid, suspending, granulating (forming particles), and polymerizing the organic phase dispersion liquid in an aqueous medium, and removing the organic solvent.

Toner particles produced by these methods have a surface layer containing an organosilicon polymer and have high environmental stability (in particular, good chargeability in severe environments). Furthermore, changes in the surface conditions of toner particles due to bleed of a release agent or a resin contained in toner can be reduced even in severe environments.

The resulting toner particles or toner may be subjected to surface treatment with hot air. Surface treatment of toner particles or toner with hot air can promote condensation polymerization of an organosilicon compound in the vicinity of the surface of the toner particles and improve environmental stability and development endurance.

The surface treatment with hot air may be any treatment in which the surface of toner particles or toner can be treated with hot air, and the toner particles or toner treated with hot air can be cooled with cool air. An apparatus for surface treatment with hot air may be a hybridization system (manufactured by Nara Machinery Co., Ltd.), a Mechanofusion system (manufactured by Hosokawa Micron Corporation), Faculty (manufactured by Hosokawa Micron Corporation), or Meteorainbow MR Type (manufactured by Nippon Pneumatic Mfg. Co., Ltd.).

Examples of aqueous media for use in these production methods include, but are not limited to, water, alcohols, such as methanol, ethanol, and propanol, and mixed solvents thereof.

Among these production methods, the method for producing toner particles may be the suspension polymerization method according to the first embodiment. In the suspension polymerization method, an organosilicon polymer tends to be uniformly precipitated on the surface of toner particles, thus resulting in good adhesion between the surface layer and the interior of the toner particles, and high storage stability, environmental stability, and development endurance. The suspension polymerization method will be further described below.

If necessary, a release agent, a polar resin, and/or a low-molecular-weight resin may be added to the polymerizable monomer composition. After the completion of the polymerization process, the resulting toner particles are washed, are collected by filtration, and are dried. The polymerization temperature may be increased in the latter half of the polymerization process. In order to remove unreacted polymerizable monomers or by-products, the dispersion medium may be partly evaporated from the reaction system in the latter half of the polymerization process or after the completion of the polymerization process.

[Low-Molecular-Weight Resin]

The following low-molecular-weight resin may be used, provided that the advantages of the present invention are not significantly reduced:

homopolymers of styrene and substituted styrene, such as polystyrene and polyvinyltoluene;

styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate copolymer; and poly(methyl methacrylate), poly(butyl methacrylate), poly(vinyl acetate), polyethylene, polypropylene, poly(vinyl butyral), silicone resin, polyester resin, polyamide resin, epoxy resin, polyacrylic resin, rosin, modified rosin, terpene resin, phenolic resin, aliphatic or alicyclic hydrocarbon resin, and aromatic petroleum resin.

These resins may be used alone or in combination.

In a toner according to an embodiment of the present invention, the binder resin may have a polymerizable functional group in order to improve the viscosity change of the toner at high temperatures. Examples of the polymerizable functional group, include, but are not limited to, a vinyl group, an isocyanate group, an epoxy group, an amino group, a carboxy group, and a hydroxy group.

THF soluble matter of the low-molecular-weight resin has a weight-average molecular weight (Mw) of 2000 or more and 6000 or less as measured by GPC.

[Polar Resin]

The polar resin can be a saturated or unsaturated polyester resin.

The polyester resin can be produced by condensation polymerization of the following acid component monomer and alcohol component monomer. Examples of the acid component monomer include, but are not limited to, terephthalic acid, isophthalic acid, phthalic acid, fumaric acid, maleic acid, cyclohexanedicarboxylic acid, and trimellitic acid.

Examples of the alcohol component monomer include, but are not limited to, bisphenol A, hydrogenated bisphenol, ethylene oxide adducts of bisphenol A, propylene oxide adducts of bisphenol A, glycerin, trimethylolpropane, and pentaerythritol.

[Release Agent]

Examples of the release agent include, but are not limited to, petroleum wax and its derivatives, such as paraffin wax, microcrystalline wax, and petrolatum, montan wax and its derivatives, Fischer-Tropsch wax and its derivatives, polyolefin wax and its derivatives, such as polyethylene and polypropylene, natural wax and its derivatives, such as carnauba wax and candelilla wax, higher aliphatic alcohols, fatty acids, such as stearic acid and palmitic acid, and their compounds, acid amide wax, ester wax, ketones, hydrogenated castor oil and its derivatives, plant wax, animal wax, and silicone resin. The derivatives include oxides, block copolymers with vinyl monomers, and graft modified materials.

[Polymerizable Monomer]

Examples of polymerizable monomers for use in the suspension polymerization method include, but are not limited to, the following polymerizable vinyl monomers:

polymerizable styrene monomers, such as styrene, α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

polymerizable acrylic monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphateethyl acrylate, diethylphosphateethyl acrylate, dibutylphosphateethyl acrylate, and 2-benzoyloxyethyl acrylate;

polymerizable methacrylic monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphateethyl methacrylate, and dibutylphosphateethyl methacrylate;

methylene aliphatic monocarboxylate esters;

vinyl esters, such as vinyl acetate, vinyl propionate, vinyl benzoate, vinyl butyrate, vinyl benzoate, and vinyl formate;

vinyl ethers, such as vinyl methyl ether, vinyl ethyl ether, and vinyl isobutyl ether; and vinyl methyl ketone, vinyl hexyl ketone, and vinyl isopropyl ketone.

Among vinyl polymers, a styrene polymer, a styrene-acrylic copolymer, or a styrene-methacrylic copolymer may be used. This results in good adhesion with the organosilicon polymer and improved storage stability and development endurance.

[Polymerization Initiator]

A polymerization initiator may be added in the polymerization of the polymerizable monomers. Examples of the polymerization initiator include, but are not limited to, azo and diazo polymerization initiators, such as 2,2'-azobis-(2,4-divaleronitrile), 2,2'-azobisisobutyronitrile, 1,1'-azobis(cyclohexane-1-carbonitrile), 2,2'-azobis-4-methoxy-2,4-dimethylvaleronitrile, and azobis isobutyronitrile, and peroxide polymerization initiators, such as benzoyl peroxide, methyl ethyl ketone peroxide, diisopropyl peroxydicarbonate, cumene hydroperoxide, 2,4-dichlorobenzoyl peroxide, and lauroyl peroxide. These polymerization initiators may be used alone or in combination. The amount of polymerization initiator is preferably 0.5% or more and 30.0% or less by mass of the amount of the polymerizable monomers.

A chain transfer agent may be added in the polymerization of the polymerizable monomers in order to control the molecular weight of a binder resin constituting toner particles. The amount of chain transfer agent is preferably 0.001% or more and 15.000% or less by mass of the amount of the polymerizable monomers.

A crosslinking agent may be added in the polymerization of polymerizable monomers in order to control the molecular weight of a binder resin constituting toner particles. Examples of the crosslinking agent include, but are not limited to, divinylbenzene, bis(4-acryloxypolyethoxyphenyl)propane, ethylene glycol diacrylate and dimethacrylate, 1,3-butylene glycol diacrylate and dimethacrylate, 1,4-butanediol diacrylate and dimethacrylate, 1,5-pentanediol diacrylate and dimethacrylate, 1,6-hexanediol diacrylate and dimethacrylate, neopentyl glycol diacrylate and dimethacrylate, diethylene glycol diacrylate and dimethacrylate, triethylene glycol diacrylate and dimethacrylate, tetraethylene glycol diacrylate and dimethacrylate, diacrylates and dimethacrylates of poly(ethylene glycol) #200, #400, and #600, dipropylene glycol diacrylate and dimethacrylate, poly(propylene glycol) diacrylate and dimethacrylate, and polyester diacrylates (MANDA Nippon Kayaku Co., Ltd.) and dimethacrylates.

Examples of polyfunctional crosslinking agents include, but are not limited to, pentaerythritol triacrylate, trimethylolethane triacrylate, trimethylolpropane triacrylate, tetramethylolmethane tetraacrylate, oligoester acrylates and methacrylates, 2,2-bis(4-methacryloxy.polyethoxyphenyl)propane, diacryl phthalate, triallyl cyanurate, triallyl isocyanurate, triallyl trimellitate, and diallyl chlorendate. The amount of crosslinking agent is preferably 0.001% or more and 15.000% or less by mass of the amount of the polymerizable monomers.

[Binder Resin]

The binder resin constituting toner particles can be a vinyl resin. The vinyl resin is produced by polymerization of at least one of the polymerizable vinyl monomers. Vinyl resins have high environmental stability. The vinyl resin can be an organosilicon polymer having the T unit structure represented by the formula (T3) or an organosilicon polymer produced by polymerization of a polymerizable monomer containing a compound having the structure represented by the formula (1)

in consideration of precipitation on the surface of toner particles and surface uniformity.

When an aqueous medium is used in the polymerization of the polymerizable monomer, the following dispersion stabilizer for particles of a polymerizable monomer composition can be used:

tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and/or alumina. Examples of organic dispersants include, but are not limited to, poly (vinyl alcohol), gelatin, methylcellulose, methylhydroxypropylcellulose, ethylcellulose, a carboxymethylcellulose sodium salt, and starch.

Commercially available nonionic, anionic, and cationic surfactants can also be used. Examples of such surfactants include, but are not limited to, sodium dodecyl sulfate, sodium tetradecyl sulfate, sodium pentadecyl sulfate, sodium octyl sulfate, sodium oleate, sodium laurate, and potassium stearate.

In an embodiment of the present invention, when an aqueous medium is produced using a poorly water-soluble inorganic dispersion stabilizer, the amount of the dispersion stabilizer is preferably 0.2 parts or more and 2.0 parts or less by mass per 100 parts by mass of polymerizable monomers. The aqueous medium is preferably produced using 300 parts or more and 3,000 parts or less by mass of water per 100 parts by mass of the polymerizable monomer composition.

In an embodiment of the present invention, when such an aqueous medium in which a poorly water-soluble inorganic dispersant is dispersed is produced, a commercially available dispersion stabilizer may be used directly. In order to obtain a dispersion stabilizer having a small uniform particle size, a poorly water-soluble inorganic dispersant may be produced in a liquid medium, such as water, while stirring at high speed. More specifically, when tricalcium phosphate is used as a dispersion stabilizer, aqueous sodium phosphate and aqueous calcium chloride can be mixed while stirring at high speed to form tricalcium phosphate fine particles as a dispersion stabilizer.

[Colorant]

Colorants for use in a toner according to an embodiment of the present invention are not particularly limited and may be the following known colorants.

Examples of yellow pigments include, but are not limited to, yellow iron oxide, condensed azo compounds, isoindolinone compounds, anthraquinone compounds, azo metal complexes, methine compounds, and allylamide compounds. Specific examples of yellow pigments include, but are not limited to, C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 109, C.I. Pigment Yellow 110, C.I. Pigment Yellow 111, C.I. Pigment Yellow 128, C.I. Pigment Yellow 129, C.I. Pigment Yellow 147, C.I. Pigment Yellow 155, C.I. Pigment Yellow 168, and C.I. Pigment Yellow 180.

Examples of orange pigments include, but are not limited to, permanent orange GTR, pyrazolone orange, vulcan orange, benzidine orange G, indanthrene brilliant orange RK, and indanthrene brilliant orange GK.

Examples of red pigments include, but are not limited to, condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples of red pigments include, but are not limited to, C.I. Pigment Red 2, C.I. Pigment Red 3, C.I. Pigment Red 5, C.I. Pigment Red 6, C.I. Pigment Red 7, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

Examples of blue pigments include, but are not limited to, copper phthalocyanine compounds and their derivatives, anthraquinone compounds, and basic dye lake compounds. Specific examples of blue pigments include, but are not limited to C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

Examples of violet pigments include, but are not limited to, fast violet B and methyl violet lake.

Examples of green pigments include, but are not limited to, pigment green B, malachite green lake, and Final Yellow Green G.

Examples of white pigments include, but are not limited to, zinc white, titanium oxide, antimony white, and zinc sulfide.

Examples of black pigments include, but are not limited to, carbon black, aniline black, nonmagnetic ferrite, magnetite, and black pigments composed of the yellow colorant, the red colorant, and the blue colorant. These colorants may be used alone or in combination and may be used in the form of solid solution.

In some toner production methods, attention should be paid to the polymerization inhibition effects of colorants and the migration of dispersion media. If necessary, the surface of colorants may be modified by surface treatment with a substance having no polymerization inhibition effect. In particular, dyes and carbon black often have polymerization inhibition effects, and therefore attention should be paid to the use of such dyes and carbon black.

A dye may be treated by adding a colored polymer, which is produced in advance by polymerization of a polymerizable monomer in the presence of the dye, to a polymerizable monomer composition. Carbon black may be treated in the same manner as the dye or may be treated with a substance that can react with a surface functional group of carbon black (for example, organosiloxane).

The colorant content is preferably 3.0 parts or more and 15.0 parts or less by mass per 100 parts by mass of the binder resin or polymerizable monomers.

[Charge Control Agent]

A toner according to an embodiment of the present invention may contain a charge control agent. The charge control agent may be a known charge control agent. In particular, the charge control agent can have high charging speed and maintain a constant amount of electrical charge. When toner particles are produced by a direct polymerization method, the charge control agent can have small polymerization inhibition effects and can be substantially free of substances soluble in aqueous media.

Examples of charge control agents that can negatively charge toner include, but are not limited to, organometallic compounds and chelate compounds, such as monoazo metallic compounds, acetylacetone metallic compounds, and aromatic oxycarboxylic acid, aromatic dicarboxylic acid, oxycarboxylic acid, and dicarboxylic acid metallic compounds. Other examples of charge control agents that can negatively charge toner include, but are not limited to, aromatic oxycarboxylic acids, aromatic mono and polycarboxylic acids, and their metal salts, anhydrides, esters, and phenol derivatives, such as bisphenols. Other examples of charge control agents that can negatively charge toner include, but are not limited to, urea derivatives, metal-containing salicylic acid compounds, metal-containing naphthoic acid compounds, boron compounds, quaternary ammonium salts, and calixarenes. Examples of charge control agents that can positively charge toner include, but are not limited to, nigrosine and nigrosine modified with fatty acid metal salts, guanidine compounds, imidazole compounds, quaternary ammonium salts, such as tributylbenzylammonium-1-hydroxy-4-naphthosulfonate and tetrabutylammonium tetrafluoroborate, and their analogs including onium salts, such as phosphonium salts, and lake pigments thereof, triphenylmethane dyes and lake pigments thereof (examples of laking agents include phosphotungstic acid, phosphomolybdic acid, phosphotungstenmolybdic acid, tannic acid, lauric acid, gallic acid, ferricyanide, and ferrocyanide), higher fatty acid metal salt, and resin charge control agents.

These charge control agents may be used alone or in combination. Among these charge control agents, metal-containing salicylic acid compounds, particularly aluminum- or zirconium-containing salicylic acid compounds may be used. In particular, the charge control agent can be an aluminum 3,5-di-tert-butyl salicylate compound.

In an embodiment of the present invention, a polymer having a sulfonic acid functional group can be used as a charge control resin. The polymer having a sulfonic acid functional group is a polymer or copolymer having a sulfonic acid group, a sulfonic acid salt group, or a sulfonic ester group.

The polymer or copolymer having a sulfonic acid group, a sulfonic acid salt group, or a sulfonic ester group may be a polymer compound having a sulfonic acid group on its side chain. In particular, the polymer or copolymer having a sulfonic acid group, a sulfonic acid salt group, or a sulfonic ester group may be a styrene copolymer, a styrene-acrylate copolymer, or a styrene-methacrylate copolymer, in which an acrylamide monomer having a sulfonic acid group or a methacrylamide monomer having a sulfonic acid group constitutes 2% or more by mass, preferably 5% or more by mass. The polymer or copolymer having a sulfonic acid group, a sulfonic acid salt group, or a sulfonic ester group preferably has a glass transition temperature (Tg) of 40° C. or more and 90° C. or less.

The acrylamide monomer having a sulfonic acid group or the methacrylamide monomer having a sulfonic acid group can be represented by the following general formula (X) and, more specifically, may be 2-acrylamide-2-methylpropanoic acid or 2-methacrylamide-2-methylpropanoic acid.

(X)

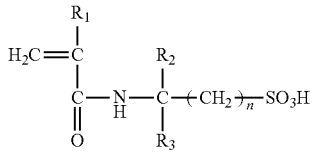

In the general formula (X), $R_1$ denotes a hydrogen atom or a methyl group, $R_1$ and $R_3$ independently denote a hydrogen atom, or an alkyl group, an alkenyl group, an aryl group, or an alkoxy group each having 1 to 10 carbon atoms, and n is an integer of 1 or more and 10 or less.

When the amount of polymer having a sulfonic acid group in the toner particles is 0.1 parts or more and 10 parts or less by mass per 100 parts by mass of the binder resin, the polymer in combination with a water-soluble initiator can further improve the charging state of the toner.

The amount of the charge control agent is preferably 0.01 parts or more and 10.00 parts or less by mass per 100 parts by mass of the binder resin or polymerizable monomers.

[Organic Fine Particles, Inorganic Fine Particles]

In order to impart various characteristics to a toner according to an embodiment of the present invention, various organic fine particles or inorganic fine particles can be externally added to toner particles. The organic fine particles or inorganic fine particles preferably have a particle size of one tenth or less the weight-average particle diameter of the toner particles in terms of endurance.

Examples of the organic fine particles or inorganic fine particles include, but are not limited to, (1) fluidity imparting agents: silica, alumina, titanium oxide, carbon black, and fluorocarbon, (2) abrasives: metal oxides, such as strontium titanate, cerium oxide, alumina, magnesium oxide, and chromium oxide, nitrides, such as silicon nitride, carbides, such as silicon carbide, and metal salts, such as calcium sulfate, barium sulfate, and calcium carbonate, (3) lubricants: fluoropolymer powders, such as vinylidene fluoride and polytetrafluoroethylene, and fatty acid metal salts, such as zinc stearate and calcium stearate, and (4) charge control particles: metal oxides, such as tin oxide, titanium oxide, zinc oxide, silica, and alumina, and carbon black.

The organic fine particles or inorganic fine particles on the surface of the toner particles improve toner flowability and make toner charging uniform. Hydrophobic treatment of the organic fine particles or inorganic fine particles can control toner chargeability and improve charging characteristics in high humidity environments. Thus, the organic fine particles or inorganic fine particles can be subjected to hydrophobic treatment. Moisture absorption of the organic fine particles or inorganic fine particles added to toner reduces toner chargeability and tends to reduce developability and transferability.

Examples of hydrophobic treatment agents for the organic fine particles or inorganic fine particles include, but are not limited to, unmodified silicone varnishes, modified silicone varnishes, unmodified silicone oils, modified silicone oils, silane compounds, silane coupling agents, organosilicon compounds, and organotitanium compounds. These hydrophobic treatment agents may be used alone or in combination.

In particular, the inorganic fine particles treated with silicone oil can be used. The inorganic fine particles can be subjected to a hydrophobic treatment with a coupling agent and simultaneously or subsequently with silicone oil. The inorganic fine particles hydrophobically treated with silicone oil can maintain a large amount of electrical charge of toner even in high humidity environments and reduce selective developability.

The amount of the organic fine particles or inorganic fine particles is preferably 0.01 parts or more and 10.00 parts or less by mass, more preferably 0.02 parts or more and 1.00 part or less by mass, still more preferably 0.03 parts or more and 1.00 part or less by mass, per 100 parts by mass of toner particles. This reduces soiling of components due to burying of the organic fine particles or inorganic fine particles in the toner particles or due to separation of the organic fine particles or inorganic fine particles from the toner particles. These organic fine particles or inorganic fine particles may be used alone or in combination.

The organic fine particles or inorganic fine particles preferably have a BET specific surface area of 10 $m^2/g$ or more and 450 $m^2/g$ or less.

The specific surface area BET of the organic fine particles or inorganic fine particles can be determined by a low-temperature gas adsorption method and a dynamic constant pressure method according to a BET method (a BET multipoint method). For example, nitrogen gas is adsorbed on a surface of a sample in a specific surface area measuring apparatus "Gemini 2375 Ver. 5.0" (manufactured by Shimadzu Corporation), and the BET specific surface area ($m^2/g$) is determined by the BET multipoint method.

The organic fine particles or inorganic fine particles may be firmly stuck or adhered to the surface of toner particles. The organic fine particles or inorganic fine particles may be firmly stuck or adhered to the surface of toner particles according to an embodiment of the present invention by using a Henschel mixer, Mechanofusion (trade name), Cyclomix (trade name), Turbulizer (trade name), Flexomix (trade name), Hybridization (trade name), Mechano Hybrid (trade name), or Nobilta (trade name).

The organic fine particles or inorganic fine particles can be firmly stuck or adhered by increasing the peripheral speed or treatment time.

[Physical Properties of Toner]

The physical properties of toner will be described below.

<Viscosity of Toner at 80° C.>

A toner according to an embodiment of the present invention preferably has a viscosity of 1,000 Pa·s or more and 40,000 Pa·s or less at 80° C. as measured with a constant-load extrusion capillary rheometer. When the viscosity is 1,000 Pa·s or more and 40,000 Pa·s or less at 80° C., the toner has good low-temperature fixability. More preferably, the viscosity is 2,000 Pa·s or more and 20,000 Pa·s or less at 80° C. In an embodiment of the present invention, the viscosity at 80° C. can be adjusted via the amount of low-molecular-weight resin to be added, the type of monomer in the production of a binder resin, the amount of initiator, the reaction temperature, and the reaction time.

The viscosity of toner at 80° C. can be measured by the following method with a constant-load extrusion capillary rheometer.

For example, the viscosity can be measured with a flow tester CFT-500D (manufactured by Shimadzu Corporation) under the following conditions.

Sample: 1.0 g of toner is pressed with a compression molding machine at a load of 100 $kg/cm^2$ for 1 minute to form a sample.

Die orifice diameter: 1.0 mm

Die length: 1.0 mm

Cylinder pressure: $9.807\times10^5$ (Pa)

Measurement mode: temperature rise method

Heating rate: 4.0° C./min

The viscosity (Pa·s) of toner is measured by the method at a temperature of 30° C. or more and 200° C. or less, and the viscosity (Pa·s) at 80° C. is determined. This value is taken as the viscosity of the toner measured with a constant-load extrusion capillary rheometer at 80° C.

<Weight-Average Particle Diameter (D4)>

A toner according to an embodiment of the present invention preferably has a weight-average particle diameter (D4) of 4.0 μm or more and 9.0 μm or less, more preferably 5.0 μm or more and 8.0 μm or less, still more preferably 5.0 μm or more and 7.0 μm or less.

<Glass Transition Temperature>

A toner according to an embodiment of the present invention preferably has a glass transition temperature (Tg) of 35° C. or more and 100° C. or less, more preferably 40° C. or more and 80° C. or less, still more preferably 45° C. or more and 70° C. or less. A glass transition temperature in this range results in improved blocking resistance, low-temperature offset resistance, and transparency of transmission images of overhead projector films.

<THF-Insoluble Matter Content>

The tetrahydrofuran (THF) insoluble matter content of a toner according to an embodiment of the present invention is preferably less than 50.0% by mass, more preferably less than 45.0% by mass, still more preferably 5.0% or more and less than 40.0% by mass, of the toner components other than the colorant and inorganic fine particles. A THF-insoluble matter content of less than 50.0% by mass can result in improved low-temperature fixability.

The THF-insoluble matter content of the toner refers to the mass percentage of an ultra-high molecular weight polymer component (substantially a cross-linked polymer) insoluble in the THF solvent. In an embodiment of the present invention, the THF-insoluble matter content of toner is measured as described below.

1.0 g of toner is weighed (W1g), is placed in a filter paper thimble (for example, No. 86R manufactured by Toyo Roshi Kaisha, Ltd.), and is subjected to extraction for 20 hours in a Soxhlet extractor using 200 mL of THF as a solvent. Soluble components extracted by the solvent are concentrated and are dried under vacuum at 40° C. for several hours, and THF-soluble resin components are weighed (W2g). The weight of components, such as a pigment, of the toner other than the resin component is denoted by W3g. The THF-insoluble matter content is calculated using the following equation.

$$\text{THF-insoluble matter content(\% by mass)}=\{(W1-(W3+W2))/(W1-W3)\}\times100$$

The THF-insoluble matter content of the toner can be adjusted via the degree of polymerization and the degree of cross-linkage of the binder resin.

<Weight-Average Molecular Weight (Mw), Weight-Average Molecular Weight (Mw)/Number-Average Molecular Weight (Mn)>

The tetrahydrofuran (THF) soluble matter of a toner according to an embodiment of the present invention preferably has a weight-average molecular weight (Mw) (hereinafter also referred to as the weight-average molecular weight of the toner) of 5,000 or more and 50,000 or less as measured by gel permeation chromatography (GPC). When the weight-average molecular weight (Mw) of the toner is within this range, blocking resistance and development endurance as well as low-temperature fixability and image gloss can be both satisfied. The weight-average molecular weight (Mw) of a toner according to an embodiment of the present invention can be adjusted via the amount and weight-average molecular weight (Mw) of a low-molecular-weight resin and via the reaction temperature, reaction time, amount of initiator, amount of chain transfer agent, and amount of crosslinking agent in the production of the toner.

The ratio [Mw/Mn] of the weight-average molecular weight (Mw) to the number-average molecular weight (Mn) of the tetrahydrofuran (THF) soluble matter of a toner according to an embodiment of the present invention is preferably 5.0 or more and 100.0 or less, more preferably 5 or more and 30 or less, as measured by gel permeation chromatography (GPC). [Mw/Mn] within this range can result in a wide fixable temperature range.

<Mapping Measurement by Time-of-Flight Secondary Ion Mass Spectrometry (FIB-TOF-SIMS)>

A secondary ion mass spectrometer "FIB-TOF-SIMS" having a FIB processing function (a commercially available single fine particle history analyzer) manufactured by TOYAMA Co., Ltd. is used for FIB-TOF-SIMS measurement.

The analytical conditions are as follows:

Sample preparation: An indium plate is placed on a sample holder, and toner particles are attached to the indium plate. When toner particles move on a sample holder, an indium plate may be placed on the sample holder, a carbon paste may be applied to the indium plate, and toner particles may be fixed to the indium plate. When a fixing aid, such as a carbon paste, or a silicon wafer is used, the background is measured under the same conditions without toner particles.

Sample pretreatment: None

Measurement method: A surface of a toner particle is etched by FIB and is analyzed by SIMS at geometric intervals under the following analytical conditions:

Analytical conditions: Secondary ion mass spectrometry (SIMS, 1 step)

Primary ion source information: Ionic species (natural isotope ratio) $Ga^+$

Accelerating voltage (keV): 30

Beam current (pA): 180

Mapping time (minutes): 12

Number of pixels (pixel): 65536

Charge neutralization mode: ON

Measurement mode: Positive

Analyzed area: 10.0 μm×14.1 μm

Number of pulses (sweep/pix): 5

Number of pixels (pixel/map): 65536

Number of repetitions (/map): 10

Ion irradiation frequency (number of pulses×number of repetitions=sweep): 50

Pulse width (s): $2.00\times10^{-7}$

Number of emitted ions (−): $7.37\times10^{8}$

Dose rate (/m$^2$): $5.2\times10^{18}$

Frequency (Hz): 16000

[Calculation of Number of Primary Ions Ia Emitted onto the Entire Visual Field per Mapping]

The number of primary ions Ia emitted onto the entire visual field per mapping is calculated using the following equation.

$$Ia=(\text{Beam current}(A)\times\text{Pulse width}(s)\times\text{Number of pixels}\times\text{Ion irradiation frequency})/\text{Elementary charge}(C)$$

The following is the number of primary ions Ia under the analytical conditions. The elementary charge is $1.6\times10^{-19}$ (C).

$$(180\times1.0\times10^{-12}\times2.00\times10^{-7}\times65536\times50)/1.6\times10^{-19})=7.37\times10^{8}$$

[Calculation of Number of Primary Ions (−) Imp Emitted onto Particle per Mapping]

Ap: Particle projected area (m$^2$) or number of pixels in particle image

The particle projected area is calculated from the average particle size Dmp (μm) of particles in a mapping area obtained by SEM.

Am: Mapping area (m$^2$) or number of pixels in mapping field

Ap/Am: Ratio of particle projected area to mapping area

Ap/Am may be calculated on an area basis. Ap/Am may also be calculated on a pixel basis: Ap/Am=(Number of pixels in particle image)/(Number of pixels in mapping field).

The number of primary ions (−) Imp emitted onto a particle per mapping can be calculated using the following equation.

$$Imp=Ia\times(Ap/Am)$$

[Calculation of Intensity of Silicon Atoms ISi Relative to Number of Primary Ions Imp Emitted onto Particle Per Mapping]

The total ISi of measured values (intensity counts) in a mass spectrum at M/Z in the range of 27.5 to 28.5 measured under the conditions described above is divided by the number of primary ions (Imp) emitted onto a particle per mapping.

$$ASi=ISi/Imp$$

In the case that the background of the sample holder is measured in an embodiment of the present invention, the total ISiB of measured values (intensity counts) in a mass spectrum at M/Z in the range of 27.5 to 28.5 is divided by the number of primary ions Ia emitted onto the entire visual field per mapping, and correction is made as described below.

$$ASi=(ISi/Imp)-(ISiB/Ia)$$

[Calculation of Intensity of Carbon Atoms IC Relative to Number of Primary Ions Imp Emitted onto Particle Per Mapping]

The total IC of measured values (intensity counts) in a mass spectrum at M/Z in the range of 11.5 to 12.5 measured under the conditions described above is divided by the number of primary ions (Imp) emitted onto a particle per mapping.

$$AC=IC/Imp$$

In the case that the background of the sample holder is measured in an embodiment of the present invention, the total ICB of measured values (intensity counts) in a mass spectrum at M/Z in the range of 11.5 to 12.5 is divided by the number of primary ions Ia emitted onto the entire visual field per mapping, and correction is made as described below.

$$AC=(IC/Imp)-(ICB/Ia)$$

[Percentage of Particles in Etching Field]

Ae: Etching area ($m^2$)

Ap/Ae: Ratio of toner particle projected area to etching area

[Calculation Example under Analytical Conditions Described Above]

IF Ia=$7.37\times10^8$ based on the calculation described above, and Ap/Am=0.3, ISi=20000, IC=15000, ISiB=0, and ICB=0 based on the analysis results are obtained, $$Imp=7.37\times10^8\times0.3=2.21\times10^8,\ ASi=(ISi/Imp)-(ISiB/Ia)=20000/2.21\times10^8=9.04\times10^{-5},\ AC=(ISi/Imp)-(ISiB/Ia)=15000/2.21\times10^8=1.05\times10^{-6},\ \text{and}\ ASi/AC=86.10.$$

[Calculation of Integral Dose Rate EDRt per Etching Area at Irradiation Lapsed Time T]

The integral dose rate EDRt per etching area at an irradiation lapsed time T (s), that is, the total number of primary ions per unit area at an irradiation lapsed time T (s) in etching is determined as described below. Etching Conditions:

Beam current (pA): 180

Etching area: 10.0 (μm)×14.0 (μm)

Number of steps: Eight at irradiation lapsed times T (s)=0.00, 2.07, 4.13, 8.27, 16.53, 33.07, 66.13, and 529.07

$$EDRt=\{\text{Beam current}(A)\times\text{Irradiation lapsed time}(s)\}/\{\text{Elementary charge}(C)(1.6\times10^{-19})\times\text{Etching area}(m^2)\}=180(\text{pA})\times1.0\times10^{-12}\times T(s)/\{1.6\times10^{-19}\times10.0\times1.0\times10^{-6}\times14.0\times1.0\times10^{-6}\}$$

Etching in an embodiment of the present invention is performed in the following 8 stages.

T: Irradiation lapsed time (s), EDRt: Integral dose rate ($/m^2$)

0th stage: T=0.00 (s), EDRt=0.00 ($/m^2$)

1st stage: T=2.07 (s), EDRt=$1.66\times10^{19}$ ($/m^2$)

2nd stage: T=4.13 (s), EDRt=$3.11\times10^{19}$ ($/m^2$)

3rd stage: T=8.27 (s), EDRt=$6.64\times10^{19}$ ($/m^2$)

4th stage: T=16.53 (s), EDRt=$1.33\times10^{20}$ ($/m^2$)

5th stage: T=33.07 (s), EDRt=$2.65\times10^{20}$ ($/m^2$)

6th stage: T=66.13 (s), EDRt=$5.31\times10^{20}$ ($/m^2$)

7th stage: T=529.07 (s), EDRt=$4.25\times10^{21}$ ($/m^2$)

[Calculation of Integral Dose Rate PDRt per Toner Projected Area at Irradiation Lapsed Time T]

The integral dose rate PDRt per toner projected area at an irradiation lapsed time T is calculated using the following equation.

$$PDRt=(\text{Integral dose rate per etching area at irradiation lapsed time } T(s))\times Ap/Ae$$

<Observation of Cross Section of Toner Particle With Transmission Electron Microscope (TEM)>

A cross section of each of toner particles according to an embodiment of the present invention is observed by the following method.

In a specific method for observing a cross section of each of toner particles, the toner particles are dispersed in a room-temperature curing epoxy resin, and the epoxy resin is cured at 40° C. for 2 days. A sample slice is cut from the cured product with a microtome having a diamond tooth. A cross section of each of toner particles of the sample is observed with a transmission electron microscope (TEM) at a magnification in the range of 10,000 to 100,000. In an embodiment of the present invention, a difference in the atomic weight of atoms in the binder resin and organosilicon polymer is utilized, and the fact that the contrast is increased with atomic weight is utilized. The contrast between materials may be increased by ruthenium tetroxide staining and osmium tetroxide staining. The state of various elements in toner particles can be determined by mapping of the elements with a transmission electron microscope.

Particles to be measured with a TEM with respect to the average thickness Dav. and percentage K of a surface layer of toner particles have a circle-equivalent diameter Dtem within ±10% of the weight-average particle diameter of toner determined by a method using a Coulter counter described below. The circle-equivalent diameter Dtem is determined from a cross-sectional area of the toner particles in a TEM photomicrograph.

<Circle-Equivalent Diameter Dtemav. Determined from Cross-Sectional Area of Toner in TEM Photomicrograph>

The circle-equivalent diameter Dtemav. is determined from a cross-sectional area of toner in a TEM photomicrograph by the following method.

First, the circle-equivalent diameter Dtem of one toner particle is calculated from the cross-sectional area of toner in a TEM photomicrograph using the following equation.

$$Dtem=(RA1+RA2+RA3+RA4+RA5+RA6+RA7+RA8+RA9+RA10+RA11+RA12+RA13+RA14+RA15+RA16+RA17+RA18+RA19+RA20+RA21+RA22+RA23+RA24+RA25+RA26+RA27+RA28+RA29+RA30+RA31+RA32)/16$$

These measurement and calculation are performed for 10 toner particles. The average of the circle-equivalent diameters of the 10 toner particles is calculated as the circle-equivalent diameter Dtemav. determined from a cross-sectional area of toner particles.

<Concentration of Silicon Elements (Atomic Percent) on Surface of Toner Particles>

The silicon element content (atomic percent) of a surface of toner particles according to an embodiment of the present invention is determined by surface composition analysis by electron spectroscopy for chemical analysis (ESCA).

The following apparatus and measurement conditions are employed for ESCA.

Apparatus: Quantum 2000 manufactured by ULVAC-PHI, Inc.

ESCA measurement conditions: X-ray source Al Kα

X-rays: 100 μm 25 W 15 kV

Raster: 300 μm×200 μm

Pass Energy: 58.70 eV Step Size: 0.125 eV

Neutralization electron gun: 20 μA, 1 V Ar ion gun: 7 mA, 10 V

Number of sweeps: Si 15, C 10, O 5

In an embodiment of the present invention, the surface atomic concentration (atomic percent) is calculated from the peak intensity of each element using a relative sensitivity factor provided by PHI.

<Method for Measuring Weight-Average Molecular Weight (Mw), Number-Average Molecular Weight (Mn), and Main Peak Molecular Weight (Mp) of Toner and Various Resins>

The weight-average molecular weight (Mw), number-average molecular weight (Mn), and main peak molecular weight (Mp) of toner and various resins are measured by gel permeation chromatography (GPC) under the following conditions.

[Measurement Conditions]

Columns (manufactured by Showa Denko K.K.): Shodex GPC KF-801, KF-802, KF-803, KF-804, KF-805, KF-806, and KF-807 (diameter 8.0 mm, length 30 cm) in series Eluent: tetrahydrofuran (THF)

Temperature: 40° C.

Flow rate: 0.6 mL/min

Detector: RI

Sample concentration and amount: 10 μL of 0.1% by mass sample

[Sample Preparation]

0.04 g of a measurement object (toner, various resins) is dispersed and dissolved in 20 mL of tetrahydrofuran, is left standing for 24 hours, and is passed through a 0.2-μm filter [Myshori Disk H-25-2 (manufactured by Tosoh Corporation)]. The filtrate is used as a sample.

A molecular weight calibration curve prepared with monodisperse polystyrene standard samples is used as a calibration curve. The standard polystyrene samples for preparing the calibration curve are TSK standard polystyrene F-850, F-450, F-288, F-128, F-80, F-40, F-20, F-10, F-4, F-2, F-1, A-5000, A-2500, A-1000, and A-500 manufactured by Tosoh Corporation. At least approximately 10 standard polystyrene samples are used.

In the preparation of GPC molecular weight distribution, measurement is started from the rising point of a chromatogram on the high molecular weight side and is continued up to a molecular weight of approximately 400 on the low-molecular-weight side.

<Method for Measuring Glass Transition Temperature (Tg) of Toner and Various Resins>

The glass transition temperatures (Tg) of toner and various resins are measured with a differential scanning calorimeter (DSC) M-DSC (trade name: Q1000, manufactured by TA Instruments) according to the following procedures. 6 mg of each sample (toner, various resins) is precisely weighed. The sample is placed in an aluminum pan. An empty aluminum pan is used as a reference. Measurement is performed in a measurement temperature range of 20° C. or more and 200° C. or less, at a heating rate of 1° C./min, and at normal temperature and humidity. The measurement is performed at a modulation amplitude ±0.5° C. and a frequency of 1/min. The glass transition temperature (Tg: ° C.) is calculated from the resulting reversing heat flow curve. Tg (° C.) is a central value of intersection points between the baselines before and after heat absorption and tangent lines of an endothermic curve.

Figure 2:
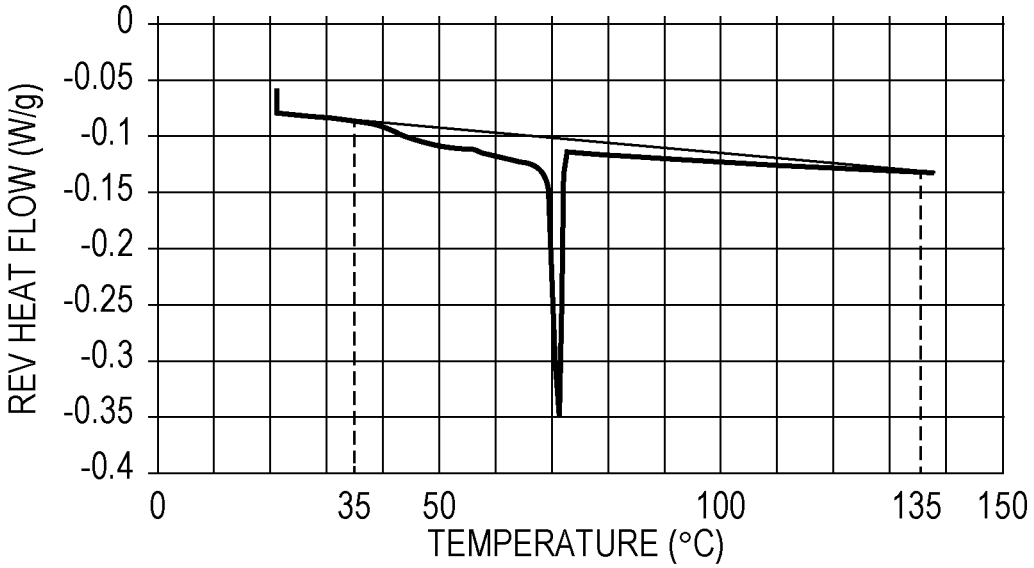
FIG. 2 is a reversing heat flow curve of a toner according to an embodiment of the present invention measured with a differential scanning calorimeter (DSC).

The integral heat quantity (J/g) of 1 g of toner given by the peak area of an endothermic main peak is determined from a DSC endothermic chart during a heating-up period. FIG. 2 shows an example of a reversing flow curve obtained from DSC measurement of toner.

The integral heat quantity (J/g) is determined from the reversing flow curve. The integral heat quantity (J/g) is calculated from a region surrounded by an endothermic curve and a straight line passing through the points of measurement at 35° C. and 135° C. with analysis software Universal Analysis 2000 for Windows 2000/XP Version 4.3A (available from TA Instruments) using an Integral Peak Linear function.

<Method for Measuring Weight-Average Particle Diameter (D4) and Number-Average Particle Diameter (D1) of Toner>

A toner is subjected to measurement with a precision particle size distribution analyzer "Coulter Counter Multisizer 3" (registered trademark, manufactured by Beckman Coulter, Inc.) by an aperture impedance method and with associated dedicated software "Beckman Coulter Multisizer 3 Version 3.51" (available from Beckman Coulter, Inc.) for measurement condition setting and measured data analysis. The precision particle size distribution analyzer is equipped with a 100 μm aperture tube. The number of effective measuring channels is 25,000. The weight-average particle diameter (D4) and the number-average particle diameter (D1) of the toner are calculated by analyzing the measured data.

An aqueous electrolyte used in the measurement may be approximately 1% by mass special grade sodium chloride dissolved in ion-exchanged water, for example, "ISOTON II" (manufactured by Beckman Coulter, Inc.).

Before the measurement and analysis, the dedicated software is set up as described below.

On the "Standard operation mode (SOM) setting screen" of the dedicated software, the total count number in control mode is set at 50,000 particles, the number of measurements is set at 1, and the Kd value is set at a value obtained with "standard particles 10.0 μm" (manufactured by Beckman Coulter, Inc.). A threshold/noise level measurement button is pushed to automatically set the threshold and noise level. The current is set at 1600 μA. The gain is set at 2. Isoton II is chosen as an electrolyte solution. Flushing of aperture tube after measurement is checked.

On the "Conversion of pulse into particle diameter setting screen" of the dedicated software, the bin interval is set at logarithmic particle diameter, the particle diameter bin is set at 256 particle diameter bins, and the particle diameter range is set at 2 μm or more and 60 μm or less.

The specific measurement method is as follows:

(1) A 250-mL round-bottom glass beaker for Multisizer 3 is charged with approximately 200 mL of the aqueous electrolyte and is placed on a sample stand. A stirrer rod is rotated counterclockwise at 24 revolutions per second. Soiling and air bubbles in the aperture tube are removed using the "Aperture flushing" function of the analysis software.

(2) A 100-mL flat-bottom glass beaker is charged with approximately 30 mL of the aqueous electrolyte. To the aqueous electrolyte is added approximately 0.3 mL of a dispersant "Contaminon N" (a 10% by mass aqueous neutral detergent for cleaning precision measuring instruments composed of a nonionic surfactant, an anionic surfactant, and an organic builder, pH 7, manufactured by Wako Pure Chemical Industries, Ltd.) diluted 3-fold by mass with ion-exchanged water.

(3) A predetermined amount of ion-exchanged water is poured into a water tank of an ultrasonic disperser "Ultrasonic Dispersion System Tetora 150" (manufactured by Nikkaki-Bios Co., Ltd.). The ultrasonic disperser includes two oscillators having an oscillation frequency of 50 kHz and has an electrical output of 120 W. The two oscillators have a phase difference of 180 degrees. Approximately 2 mL of Contaminon N is added to the ion-exchanged water.

(4) The beaker prepared in (2) is placed in a beaker-holding hole in the ultrasonic disperser, and the ultrasonic disperser is actuated. The vertical position of the beaker is adjusted such that the surface resonance of the aqueous electrolyte in the beaker is highest.

(5) While the aqueous electrolyte in the beaker prepared in (4) is exposed to ultrasonic waves, approximately 10 mg of toner is added little by little to the aqueous electrolyte and is dispersed. The ultrasonic dispersion treatment is continued for another 60 seconds. During the ultrasonic dispersion, the water temperature of the water tank is controlled at a temperature of 10° C. or more and 40° C. or less.

(6) The aqueous electrolyte containing dispersed toner produced in (5) is added dropwise using a pipette into the round-bottom beaker prepared in (1) placed on the sample stand such that the measurement concentration is approximately 5%. Measurement is continued until the number of measured particles reaches 50,000.

(7) The measured data are analyzed by using the accessory dedicated software to determine the weight-average particle diameter (D4). The weight-average particle diameter (D4) is the average diameter on the analysis/volume statistics (arithmetic mean) screen in the setting of graph/% by volume in the dedicated software. The number-average particle diameter (D1) is the "Average diameter" on the "Analysis/number statistics (arithmetic mean)" screen in the setting of graph/% by number in the dedicated software.

<Method for Measuring Average Circularity and Mode Circularity of Toner>

The average circularity of toner is measured with a flow particle image analyzer "FPIA-3000" (manufactured by SYSMEX Corporation) under the measurement and analysis conditions for calibration.

A proper amount of a surfactant, such as an alkylbenzenesulfonate, is added as a dispersant to 20 mL of ion-exchanged water. 0.02 g of a sample is then added to the ion-exchanged water. The sample is dispersed for 2 minutes with a table-top ultrasonic cleaner dispersing apparatus having an oscillation frequency of 50 kHz and an electrical output of 150 W (for example, "VS-150" manufactured by VELVO-CLEAR), thereby producing a dispersion liquid for measurement. During the dispersion, the dispersion liquid is cooled to a temperature of 10° C. or more and 40° C. or less.

The flow particle image analyzer equipped with a standard objective lens (magnification: 10) is used in the measurement. The sheath liquid is a particle sheath "PSE-900A" (SYSMEX Corporation). The dispersion liquid produced through the procedures described above is introduced into the flow particle image analyzer. 3000 toner particles are measured in an HPF measurement mode and a total count mode. The binarization threshold in particle analysis is 85%. The analysis particle diameter is limited to an circle-equivalent diameter of 1.98 μm or more and 19.92 μm or less. The average circularity of the toner is thus determined.

Before measurement, automatic focusing is adjusted with standard latex particles (for example, 5100A manufactured by Duke Scientific diluted with ion-exchanged water). Focusing can be adjusted every 2 hours after the start of measurement.

In the circularity distribution of toner, a mode circularity of 0.98 or more and 1.00 or less means that most of the toner is close to spherical. This results in a significant decrease in adhesion strength of toner to a photosensitive member due to image force and van der Waals force and a marked increase in transfer efficiency.

With respect to mode circularity, a circularity of 0.40 to 1.00 is divided into 61 divisions in increments of 0.01, that is, 0.40 or more and less than 0.41, 0.41 or more and less than 0.42, . . . , 0.99 or more and less than 1.00, and 1.00. The circularity of each measured particle is assigned to the corresponding division. The mode circularity refers to the circularity of a division having the highest frequency in the circularity frequency distribution.

Exemplary Embodiments

The present invention will be further described below with exemplary embodiments. However, the present invention is not limited to the exemplary embodiments. Unless otherwise specified, "parts" refers to "parts by mass".

A production example of a charge control resin for use in the present invention will be described below.

<Production Example of Charge Control Resin 1>

A reaction vessel equipped with a reflux tube, an agitator, a thermometer, a nitrogen inlet, a dropping apparatus, and a decompressor was charged with 255 parts by mass of methanol, 145 parts by mass of 2-butanone, and 100 parts by mass of 2-propanol as solvents, and 88 parts by mass of styrene, 6.2 parts by mass of 2-ethylhexyl acrylate, and 6.6 parts by mass of 2-acrylamide-2-methylpropanesulfonic acid as monomers. The monomer solution was heated under reflux at normal pressure while stirring. 0.8 parts by mass of a polymerization initiator 2,2'-azobisisobutyronitrile diluted with 20 parts by mass of 2-butanone was added dropwise to the monomer solution for 30 minutes. The solution was stirred for 5 hours. 1.2 parts by mass of 2,2'-azobisisobutyronitrile diluted with 20 parts by mass of 2-butanone was added dropwise to the solution for 30 minutes. The solution was stirred under reflux at normal pressure for 5 hours, thereby completing polymerization.

After the polymerization solvent was evaporated under reduced pressure, the resulting polymer was roughly crushed to 100 μm or less with a cutter mill having a 150-mesh screen and was pulverized with a jet mill. The fine particles were classified through a 250-mesh sieve, and particles having a diameter of 60 μm or less were collected. The particles were then dissolved in methyl ethyl ketone such that the concentration of the particles was 10%. The resulting solution was slowly poured into methanol for reprecipitation. The amount of the methanol was 20 times the amount of the methyl ethyl ketone. The resulting precipitate was washed with methanol, was filtered, and was dried under vacuum at 35° C. for 48 hours. The amount of methanol for washing was one-half the amount of methanol for reprecipitation.

The vacuum-dried particles were redissolved in methyl ethyl ketone such that the concentration of the particles was 10%. The resulting solution was slowly poured into n-hexane for reprecipitation. The amount of the n-hexane was 20 times the amount of the methyl ethyl ketone. The resulting precipitate was washed with n-hexane, was filtered, and was dried under vacuum at 35° C. for 48 hours. The amount of n-hexane for washing was one-half the amount of n-hexane for reprecipitation. The charge control resin thus produced had a Tg of approximately 82° C., a main peak molecular weight (Mp) of 19,300, a number-average molecular weight (Mn) of 12,700, a weight-average molecular weight (Mw) of 21,100, and an acid value of 20.4 mgKOH/g. The resin is hereinafter referred to as a charge control resin 1.

<Production Example of Polyester Resin (1)>

Terephthalic acid: 11.1 mol

Propylene oxide adduct of bisphenol A (PO-BPA, propylene oxide/bisphenol A=2/1 (mol/mol)): 10.8 mol An autoclave was charged with these monomers and an esterification catalyst and was equipped with a decompressor, a water separator, a nitrogen gas induction apparatus, a temperature measuring apparatus, and an agitator. The monomers were allowed to react in a nitrogen atmosphere under reduced pressure at 220° C. in accordance with a common procedure such that the resulting polyester resin (1) had a Tg of 70° C. The polyester resin (1) had a weight-average molecular weight (Mw) of 8,200 and a number-average molecular weight (Mn) of 3,220.

<Production Example of Polyester Resin (2)>

Synthesis of Prepolymer having Isocyanate Group

Ethylene oxide adduct of bisphenol A (ethylene oxide/bisphenol A=2/1 (mol/mol)): 720 parts by mass Phthalic acid: 280 parts by mass Dibutyltin oxide: 2.5 parts by mass These monomers were allowed to react at 220° C. for 7 hours while stirring, were allowed to react under reduced pressure for 5 hours, were cooled to 80° C., and were allowed to react with 190 parts by mass of isophorone diisocyanate in ethyl acetate for 2 hours, thus producing a polyester resin having an isocyanate group. 26 parts by mass of the polyester resin having an isocyanate group was allowed to react with 1 part by mass of isophoronediamine at 50° C. for 2 hours, thus producing a polyester resin (2) composed mainly of a polyester having a urea group. The polyester resin (2) had a weight-average molecular weight (Mw) of 25,000, a number-average molecular weight (Mn) of 3,200, and a peak molecular weight of 6,200.

<Production Example of Toner Particles 1>

A four-neck container equipped with a reflux tube, an agitator, a thermometer, and a nitrogen inlet was charged with 700 parts by mass of ion-exchanged water, 1000 parts by mass of 0.1 mol/L aqueous $Na_3PO_4$, and 24.0 parts by mass of 1.0 mol/L aqueous HCl, and was held at 60° C. while stirring with a high-speed agitator TK-homo mixer at 12,000 rpm. 85 parts by mass of 1.0 mol/L aqueous $CaCl_2$ was slowly added to the resulting mixture to produce an aqueous dispersion medium containing a fine poorly water-soluble dispersion stabilizer $Ca_3(PO_4)_2$.

Styrene: 70.0 parts by mass n-Butyl acrylate: 30.0 parts by mass

Divinylbenzene: 0.10 parts by mass

Methyltriethoxysilane: 15.0 parts by mass

Copper phthalocyanine pigment (Pigment Blue 15:3): 6.5 parts by mass

Polyester resin (1): 5.0 parts by mass

Charge control agent (3,5-di-tert-butylsalicylic acid aluminum compound): 0.5 parts by mass Charge control resin 1: 0.5 parts by mass Release agent (behenyl behenate, endothermic main peak temperature: 72.1° C.): 10.0 parts by mass These materials were dispersed in an attritor for 3 hours to produce a polymerizable monomer composition 1. The polymerizable monomer composition 1 was held at 60° C. for 20 minutes. The polymerizable monomer composition 1 to which 14.0 parts by mass of a polymerization initiator t-butyl peroxypivalate (50% solution in toluene) was added was then poured into the aqueous medium. While the rotational speed of the high-speed agitator was maintained at 12,000 rpm, particles of the polymerizable monomer composition 1 were formed (granulated) for 10 minutes. The high-speed agitator was then replaced with a propeller agitator. The internal temperature was increased to 70° C. The particles of the polymerizable monomer composition 1 were allowed to react for 5 hours while stirring slowly. At this time, the aqueous medium had a pH of 5.1. 8.0 parts by mass of 1.0 mol/L NaOH was added the aqueous medium to adjust the pH to be 7.0. The container was heated to a temperature of 85° C. and was held for 5 hours. 300 parts by mass of ion-exchanged water was then added to the aqueous medium. The reflux tube was removed from the container, and a distillation apparatus was attached to the container. Distillation was then performed at an internal temperature of 100° C. for 5 hours to produce a polymer slurry. The distillate fraction was 310 parts by mass. Diluted hydrochloric acid was added to the container containing the polymer slurry cooled to 30° C., thereby removing the dispersion stabilizer. The polymer slurry was then filtered, washed, and dried to produce toner particles having a weight-average particle diameter of 5.6 μm. The toner particles are hereinafter referred to as toner particles 1. Table 1 lists the formula and conditions for the toner particles 1.

(Production Examples of Toner Particles 2 to 7, 9 to 13, 17 to 21, 23, 28, and 29)

Toner particles 2 to 7, 9 to 13, 17 to 21, 23, 28, and 29 were produced in the same manner as in the production example of the toner particles 1 except that the production conditions and formula were changed as listed in Tables 1 to 6. Tables 1 to 6 list the formula, polymerization conditions, and physical properties of the toner particles.

<Production Example of Toner Particles 8>

Toner particles 8 were produced in the same manner as in the production example of the toner particles 1, except that 15.0 parts by mass of methyltriethoxysilane was replaced with 15.0 parts by mass of methyldiethoxychlorosilane, and the pH was adjusted to be 5.1 with 2.0 parts by mass of 1.0 mol/L aqueous NaOH. Table 2 lists the formula, conditions, and physical properties of the toner particles 8.

<Production Example of Toner Particles 14>

Toner particles 14 were produced in the same manner as in the production example of the toner particles 1, except that the amount of 1.0 mol/L NaOH was changed to 21.0 parts by mass, and the pH was changed to 10.2. Table 3 lists the formula, conditions, and physical properties of the toner particles 14.

<Production Example of Toner Particles 15>

Toner particles 15 were produced in the same manner as in the production example of the toner particles 1 except that 1.0 mol/L NaOH was not added. Table 3 lists the formula, conditions, and physical properties of the toner particles 15.

<Production Example of Toner Particles 16>

A four-neck container equipped with a reflux tube, an agitator, a thermometer, and a nitrogen inlet was charged with 700 parts by mass of ion-exchanged water, 1200 parts by mass of 0.1 mol/L aqueous $Na_3PO_4$, and 30.0 parts by mass of 1.0 mol/L aqueous HCl, and was held at 60° C. while stirring with a high-speed agitator TK-homo mixer at 12,000 rpm. 100 parts by mass of 1.0 mol/L aqueous $CaCl_2$ was slowly added to the resulting mixture to produce an aqueous dispersion medium containing a fine poorly water-soluble dispersion stabilizer $Ca_3(PO_4)_2$.

Styrene: 70.0 parts by mass n-Butyl acrylate: 30.0 parts by mass

Divinylbenzene: 0.10 parts by mass

Methyltriethoxysilane: 15.0 parts by mass

Copper phthalocyanine pigment (Pigment Blue 15:3): 6.5 parts by mass

Polyester resin (1): 5.0 parts by mass

Charge control agent (3,5-di-tert-butylsalicylic acid aluminum compound): 0.5 parts by mass Charge control resin 1: 0.5 parts by mass Release agent (behenyl behenate, endothermic main peak temperature: 72.1° C.): 10.0 parts by mass The monomer mixture was dispersed in an attritor for 3 hours to produce a monomer mixture 1. The monomer mixture 1 was held at 60° C. for 20 minutes. 14.0 parts by mass of a polymerization initiator t-butyl peroxypivalate (50% solution in toluene) was added to the monomer mixture 1 to produce a monomer composition. The monomer composition was poured into the aqueous dispersion medium. While the rotational speed of the high-speed agitator was maintained at 12,000 rpm, particles of the monomer composition were formed (granulated) for 10 minutes. The high-speed agitator was then replaced with a propeller agitator. The internal temperature was increased to 70° C. The particles of the monomer composition were allowed to react for 5 hours while stirring slowly. The pH was 4.1. The internal temperature of the container was increased to 85° C. and was held at a pH of 4.1 for 5 hours. 300 parts by mass of ion-exchanged water was then added to the aqueous medium. The reflux tube was removed from the container, and a distillation apparatus was attached to the container. Distillation was then performed at an internal temperature of 100° C. and at a pH of 4.1 for 5 hours to produce a polymer slurry. The distillate fraction was 310 parts by mass. Diluted hydrochloric acid was added to the container containing the polymer slurry to remove the dispersion stabilizer. The polymer slurry was then filtered, washed, and dried to produce toner particles having a weight-average particle diameter of 5.6 μm. The toner particles are hereinafter referred to as toner particles 16. Table 4 lists the formula, conditions, and physical properties of the toner particles 16.

<Production Example of Toner Particles 22>

Polyester resin (1): 60.0 parts by mass
Polyester resin (2): 40.0 parts by mass
Copper phthalocyanine pigment: 6.5 parts by mass
Charge control agent (3,5-di-tert-butylsalicylic acid aluminum compound): 0.5 parts by mass
Charge control resin 1: 0.5 parts by mass
Release agent (behenyl behenate, endothermic main peak temperature: 72.1° C.): 10.0 parts by mass These materials were mixed in a Henschel mixer and were melt-kneaded in a twin-screw extruder at 135° C. The mixture was cooled, was roughly crushed with a cutter mill, and was ground in a pulverizer using jet stream. The powder was classified with an air classifier to produce a toner base 22 having a weight-average particle diameter of 5.6 μm.

A four-neck container equipped with a Liebig reflux tube was charged with 700 parts by mass of ion-exchanged water, 1000 parts by mass of 0.1 mol/L aqueous $Na_3PO_4$, and 24.0 parts by mass of 1.0 mol/L aqueous HCl, and was held at 60° C. while stirring with a high-speed agitator TK-homo mixer at 12,000 rpm. 85 parts by mass of 1.0 mol/L aqueous $CaCl_2$ was slowly added to the resulting mixture to produce an aqueous dispersion medium containing a fine poorly water-soluble dispersion stabilizer $Ca_3(PO_4)_2$.

Then,

Toner base 22: 100 parts by mass and
Methyltriethoxysilane: 15 parts by mass were mixed in a Henschel mixer.

The mixture of the toner base and methyltriethoxysilane was then added to the aqueous dispersion medium while stirring with a TK-homo mixer at 5,000 rpm and was stirred for 5 minutes. The liquid mixture was then held at 70° C. for 5 hours. The liquid mixture had a pH of 5.1. The liquid mixture was then heated to 85° C. and was held for 5 hours. 300 parts by mass of ion-exchanged water was then added to the aqueous medium. The reflux tube was removed from the container, and a distillation apparatus was attached to the container. Distillation was then performed at an internal temperature of 100° C. for 5 hours to produce a polymer slurry 22. The distillate fraction was 320 parts by mass. Diluted hydrochloric acid was added to the container containing the polymer slurry 22 to remove the dispersion stabilizer. The polymer slurry 22 was then filtered, washed, and dried to produce toner particles having a weight-average particle diameter of 5.6 μm. The toner particles are hereinafter referred to as toner particles 22. Table 5 lists the physical properties of the toner particles 22.

<Production Example of Toner Particles 24>

First, a four-neck container equipped with a Liebig reflux tube was charged with 700 parts by mass of ion-exchanged water, 1000 parts by mass of 0.1 mol/L aqueous $Na_3PO_4$, and 24.0 parts by mass of 1.0 mol/L aqueous HCl, and was held at 60° C. while stirring with a high-speed agitator TK-homo mixer at 12,000 rpm. 85 parts by mass of 1.0 mol/L aqueous $CaCl_2$ was slowly added to the resulting mixture to produce an aqueous dispersion medium containing a fine poorly water-soluble dispersion stabilizer $Ca_3(PO_4)_2$.

Polyester resin (1): 60.0 parts by mass
Polyester resin (2): 40.0 parts by mass
Copper phthalocyanine pigment: 6.5 parts by mass
Charge control agent (3,5-di-tert-butylsalicylic acid aluminum compound): 0.5 parts by mass
Charge control resin 1: 0.5 parts by mass
Methyltriethoxysilane: 15.0 parts by mass
Release agent (behenyl behenate, endothermic main peak temperature: 72.1° C.): 10.0 parts by mass These materials were dissolved in 400 parts by mass of toluene to produce a solution.

100 parts by mass of the solution was then added to the aqueous dispersion medium while stirring with a TK-homo mixer at 12,000 rpm and was stirred for 5 minutes. The liquid mixture was then held at 70° C. for 5 hours. The liquid mixture had a pH of 5.1. The liquid mixture was then heated to 85° C. and was held for 5 hours. 300 parts by mass of ion-exchanged water was then added to the liquid mixture. The reflux tube was removed from the container, and a distillation apparatus was attached to the container. Distillation was then performed at an internal temperature of 100° C. for 5 hours to produce a polymer slurry 24. The distillate fraction was 320 parts by mass. Diluted hydrochloric acid was added to the container containing the polymer slurry 24 to remove the dispersion stabilizer. The polymer slurry 24 was then filtered, washed, and dried to produce toner particles having a weight-average particle diameter of 5.5 μm. Table 5 lists the physical properties of the toner particles 24.

<Production Example of Toner Particles 25>

Synthesis of Polyester Resin (3)

Ethylene oxide adduct of bisphenol A (ethylene oxide/bisphenol A=2/1 (mol/mol)): 10 mol %
Propylene oxide adduct of bisphenol A (propylene oxide/bisphenol A=2/1 (mol/mol)): 90 mol %
Terephthalic acid: 50 mol %
Fumaric acid: 30 mol %
Dodecenylsuccinic acid: 20 mol %

A flask equipped with an agitator, a nitrogen inlet, a temperature sensor, and a rectifying column was charged with these monomers and was heated to 195° C. for 1 hour. It was confirmed that the reaction system was uniformly stirred.

Tin distearate was added to the monomers. The amount of the tin distearate was 0.7% by mass of the total amount of the monomers. The monomers were heated from 195° C. to 250° C. for 5 hours while produced water was distilled off, and a dehydration condensation reaction was performed at 250° C. for another 2 hours. As a result, an amorphous polyester resin (3) was produced. The amorphous polyester resin (3) had a glass transition temperature of 58.5° C., an acid value of 12.1 mgKOH/g, a hydroxyl value of 28.3 mgKOH/g, a weight-average molecular weight of 14,100, a number-average molecular weight of 4,100, and a softening point of 112° C.

Synthesis of Polyester Resin (4)

Ethylene oxide adduct of bisphenol A (ethylene oxide/bisphenol A=2/1 (mol/mol)): 50 mol %

Propylene oxide adduct of bisphenol A (propylene oxide/bisphenol A=2/1 (mol/mol)): 50 mol %

Terephthalic acid: 65 mol %

Dodecenylsuccinic acid: 28 mol %

A flask equipped with an agitator, a nitrogen inlet, a temperature sensor, and a rectifying column was charged with these monomers and was heated to 195° C. for 1 hour. It was confirmed that the reaction system was uniformly stirred.

Tin distearate was added to the monomers. The amount of the tin distearate was 0.7% by mass of the total amount of the monomers. The monomers were heated from 195° C. to 250° C. for 5 hours while produced water was distilled off, and a dehydration condensation reaction was performed at 250° C. for another 2 hours. The temperature was then decreased to 190° C. 7 mol % trimellitic anhydride was slowly added to the reaction system, and the reaction was continued at 190° C. for 1 hour. As a result, an amorphous polyester resin (4) was produced. The amorphous polyester resin (4) had a glass transition temperature of 55.1° C., an acid value of 12.8 mgKOH/g, a hydroxyl value of 27.2 mgKOH/g, a weight-average molecular weight of 52,400, a number-average molecular weight of 6,400, and a softening point of 112° C.

Preparation of Resin Particle Dispersion Liquid (1)

Polyester resin (3): 100.0 parts by mass

Methyl ethyl ketone: 50.0 parts by mass

Isopropyl alcohol: 20.0 parts by mass

A container was charged with the methyl ethyl ketone and isopropyl alcohol. The resin was then slowly charged into the container and was completely dissolved while stirring. Thus, a polyester resin (3) solution was produced. While the amorphous polyester solution was maintained at 65° C., 5 parts by mass of 10% aqueous ammonia was slowly added dropwise to the amorphous polyester solution while stirring, and 230 parts by mass of ion-exchanged water was slowly added dropwise to the amorphous polyester solution at 10 mL/min, thereby causing phase inversion emulsification. The solvent was removed with an evaporator under reduced pressure to produce a resin particle dispersion liquid (1) of the polyester resin (3). The resin particles had a volume-average particle diameter of 145 nm. The resin particle solid content was adjusted with ion-exchanged water to be 20%.

Preparation of Resin Particle Dispersion Liquid (2)

Polyester resin (4): 100.0 parts by mass

Methyl ethyl ketone: 50.0 parts by mass

Isopropyl alcohol: 20.0 parts by mass

A container was charged with the methyl ethyl ketone and isopropyl alcohol. The polyester resin (4) was then slowly charged into the container and was completely dissolved while stirring. Thus, a polyester resin (4) solution was produced. While the polyester resin (4) solution was maintained at 40° C., 3.5 parts by mass of 10% aqueous ammonia was slowly added dropwise to the polyester resin (4) solution while stirring, and 230 parts by mass of ion-exchanged water was slowly added dropwise to the amorphous polyester resin (4) solution at 10 mL/min, thereby causing phase inversion emulsification. The solvent was removed under reduced pressure to produce a resin particle dispersion liquid (2) of the polyester resin (4). The resin particles had a volume-average particle diameter of 165 nm. The resin particle solid content was adjusted with ion-exchanged water to be 20%.

Preparation of Sol-Gel Solution of Resin Particle Dispersion Liquid (1)

100 parts by mass (solid content: 20.0 parts by mass) of the resin particle dispersion liquid (1) was mixed with 40.0 parts by mass of methyltriethoxysilane at 70° C. for 1 hour while stirring, was heated to 80° C. at a heating rate of 20° C./h, and was held for 3 hours. After cooling, fine resin particles covered with sol-gel, that is, a sol-gel solution of the resin particle dispersion liquid (1) was obtained. The resin particles had a volume-average particle diameter of 225 nm. The resin particle solid content was adjusted with ion-exchanged water to be 20%. The sol-gel solution of the resin particle dispersion liquid (1) was stored at 10° C. or less while stirring and was used 48 hours after the adjustment.

Preparation of Colorant Particle Dispersion Liquid 1

Cyan pigment (ECB-308): 45.0 parts by mass

Ionic surfactant Neogen RK (manufactured by Dai-ichi Kogyo Seiyaku Co., Ltd.): 5.0 parts by mass Ion-exchanged water: 190.0 parts by mass These components were dispersed with a homogenizer (IKA Ultra-Turrax) for 10 minutes. Dispersion treatment was performed with Ultimizer (a counter collision type wet mill: manufactured by Sugino Machine Ltd.) at a pressure of 250 MPa for 15 minutes. A colorant particle dispersion liquid 1 was thus produced. The colorant particles had a volume-average particle diameter of 135 nm. The solid content of the colorant particle dispersion liquid 1 was 20%.

Preparation of Release Agent Particle Dispersion Liquid

Olefin wax (melting point: 84° C.): 60.0 parts by mass

Ionic surfactant Neogen RK (manufactured by Dai-ichi Kogyo Seiyaku Co., Ltd.): 2.0 parts by mass Ion-exchanged water: 240 parts by mass These materials were well-dispersed at 100° C. with IKA Ultra-Turrax T50 and were dispersed at 110° C. for 1 hour with a pressure ejection type Gaulin homogenizer. The resulting release agent particle dispersion liquid had a volume-average particle diameter of 170 nm and a solid content of 20%.

Production of Toner Particles

Resin particle dispersion liquid (1): 100.0 parts by mass

Resin particle dispersion liquid (2): 300.0 parts by mass

Sol-Gel Solution of Resin Particle Dispersion Liquid (1): 300.0 parts by mass

Colorant particle dispersion liquid 1: 50.0 parts by mass

Release agent particle dispersion liquid: 50.0 parts by mass

After a stainless steel flask was charged with 2.2 parts by mass of an ionic surfactant Neogen RK, the materials described above were stirred. After the pH of the mixture was adjusted to be 3.8 by dropwise addition of 1 mol/L aqueous nitric acid, 0.35 parts by mass of polyaluminum sulfate was dispersed in the mixture with Ultra-Turrax. The stainless steel flask was heated to 48° C. in a heating oil bath while stirring. After the stainless steel flask was held at 48° C. for 40 minutes, a liquid mixture of 300 parts by mass of the sol-gel solution of the resin particle dispersion liquid (1) was slowly charged into the stainless steel flask.

After the pH of the system was adjusted to be 7.0 by the addition of 1 mol/L aqueous sodium hydroxide, the stainless steel flask was closed, was slowly heated to 85° C. while stirring, and was held at 85° C. for 4 hours. After that, 2.0 parts by mass of an ionic surfactant Neogen RK was charged into the stainless steel flask, and the reaction was performed at 95° C. for 5 hours. After the completion of the reaction, the product was cooled and filtered. The product was redispersed in 5 L of ion-exchanged water at 40° C., was stirred with a stirring blade (300 rpm) for 15 minutes, and was filtered.

The redispersion, filtration, and washing were repeatedly performed until the filtrate had an electrical conductivity of 7.0 μS/cm or less. Thus, toner particles 25 were produced. Table 5 lists the formula, conditions, and physical properties of the toner particles 25.

<Production Example of Toner Particles 26>

While 100.0 parts by mass of a toner base 26 was stirred in a Henschel mixer at high speed, the toner base 26 was sprayed with 3.5 parts by mass of an organosilicon polymer solution. The organosilicon polymer solution was produced by a reaction of 10.0 parts by mass of toluene, 5.0 parts by mass of ethanol, 5.0 parts by mass of water, and 15.0 parts by mass of methyltriethoxysilane at 85° C. for 5 hours.

Particles were dried and polymerized by circulating the particles in a fluidized bed dryer for 30 minutes at an inlet temperature of 80° C. and at an outlet temperature of 45° C. In the same manner, 100 parts by mass of the treated toner was sprayed with 3.5 parts by mass of the organosilicon polymer solution in a Henschel mixer and was circulated in a fluidized bed dryer at an inlet temperature of 80° C. and at an outlet temperature of 45° C.

The spraying and drying of the organosilicon polymer solution were repeated 10 times in the same manner, thereby producing toner particles 26. Table 6 lists the formula, conditions, and physical properties of the toner particles 26.

<Production Example of Toner Particles 27>

Toner particles 27 were produced in the same manner as in the production example of the toner particles 1, except that the amount of styrene monomer was changed from 70.0 parts by mass to 62.0 parts by mass, the amount of n-butyl acrylate was changed from 30.0 parts by mass to 38.0 parts by mass, and 1.0 part by mass of titanium tetra-n-butoxide and 1.0 part by mass of dimethyldiethoxysilane were added. Table 6 lists the formula, conditions, and physical properties of the toner particles 27.

<Production Examples of Comparative Toner Particles 1 to 9>

Comparative toner particles 1 to 9 were produced in the same manner as in the production example of the toner particles 1 except that the production conditions and formula were changed as listed in Tables 7 and 8. Tables 7 and 8 list the formula, polymerization conditions, and physical properties of the comparative toner particles.

<Production Example of Comparative Toner Particles 10>

900 parts by mass of ion-exchanged water and 95 parts by mass of poly(vinyl alcohol) in a four-neck flask equipped with a high-speed agitator TK-homo mixer were heated to 55° C. while stirring at a rotational speed of 1300 rpm, thereby producing an aqueous dispersion medium.

Composition of Monomer Dispersion Liquid

Styrene: 70.0 parts by mass n-Butyl acrylate: 30.0 parts by mass

Carbon black: 10.0 parts by mass

Salicylic acid silane compound: 1.0 part by mass

Release agent (behenyl behenate): 10.0 parts by mass

These materials were dispersed in an attritor for 3 hours. 14.0 parts by mass of a polymerization initiator t-butyl peroxypivalate was added to the materials to produce a monomer dispersion liquid.

The monomer dispersion liquid was added to the dispersion medium in the four-neck flask. The rotational speed was maintained for 10 minutes to form particles of the monomer dispersion liquid (granulation). Polymerization was then performed at 55° C. for 1 hour, at 65° C. for 4 hours, and at 80° C. for 5 hours while stirring at 50 rpm. After the completion of the polymerization, the slurry was cooled and was washed with purified water multiple times to remove the dispersant. The slurry was washed and dried to produce black toner particles as a base material. The black toner particles had a weight average particle size of 5.7 μm.

3 parts by mass of 0.3% by mass sodium dodecylbenzenesulfonate solution was added to a mixture solution of 2.0 parts by mass of isoamyl acetate and silicon compounds: 3.5 parts by mass of tetraethoxysilane and 0.5 parts by mass of methyltriethoxysilane. The mixture was stirred with an ultrasonic homogenizer to produce a mixed solution A of isoamyl acetate, tetraethoxysilane, and methyltriethoxysilane.

The mixed solution A and 1.0 part by mass of the black toner particles were added to 30 parts by mass of 0.3% by mass aqueous sodium dodecylbenzenesulfonate, and was mixed with 5 parts by mass of 29% by mass aqueous $NH_4OH$. The mixture was stirred at room temperature (25° C.) for 12 hours. The mixture was washed with ethanol and then with purified water. Particles were filtered off and were dried to produce comparative toner particles 10. The comparative toner particles 10 had a covering layer formed of bonded agglomerates.

The toner had a weight average particle size of 5.8 μm. Table 8 lists the physical properties of the comparative toner particles 10.

Exemplary Embodiment 1

100 parts by mass of the toner particles 1 were mixed with 0.5 parts by mass of hydrophobic silica (BET specific surface area: 200 $m^2/g$, subjected to hydrophobic treatment with 2.5% by mass of hexamethyldisilazane and 2.5% by mass of 100 cps silicone oil) and 0.2 parts by mass of aluminum oxide (BET specific surface area: 60 $m^2/g$) in a Henschel mixer (manufactured by Mitsui Mining Co., Ltd.), thereby producing a toner 1.

<Evaluation>

Measurement of Triboelectric Charging Amount of Toner

The triboelectric charging amount of toner can be determined by the following method. First, a toner and a standard carrier for negatively chargeable toner (trade name: N-01, manufactured by The Imaging Society of Japan, only those passing through 250 mesh are used) are left to stand for a predetermined time in the following environment. After being left to stand for 24 hours in evaluation at low temperature and low humidity (10° C./15% RH), at normal temperature and humidity (25° C./50% RH), or at high temperature and high humidity (32.5° C./85% RH), or after being left to stand for 168 hours in evaluation in a severe environment (40° C./95% RH), the toner and the standard carrier for negatively chargeable toner are left to stand for 24 hours in a very high temperature and humidity (32.5° C./90% RH) environment. After being left to stand, the toner and the carrier are mixed together in a Turbula mixer in each environment for 120 seconds. The toner constitutes 5% by mass. Within 1 minute after mixing, the triboelectric charging amount of the toner is measured in a normal temperature and humidity (25° C./50% RH) environment. More specifically, a metallic container having an electrical conductive screen on the bottom thereof is charged with a mixed developing agent. The electrical conductive screen has a sieve opening of 20 μm. The toner is sucked with an aspirator through the electrical conductive screen. The difference in mass due to the suction and the potential stored in a capacitor connected to the container are measured. The suction pressure is 4.0 kPa. The triboelectric charging amount of the toner is calculated from the difference in mass, the stored potential, and the capacitance of the capacitor using the following equation.

$$Q(mC/\text{kg})=C\times V/(W)$$

Q: Triboelectric charging amount of charge control resin and toner

C (μF): Capacitance of capacitor

V (volt): Potential stored in capacitor

W (g): Difference in mass due to suction

Measurement of Image Density

Figure 3:
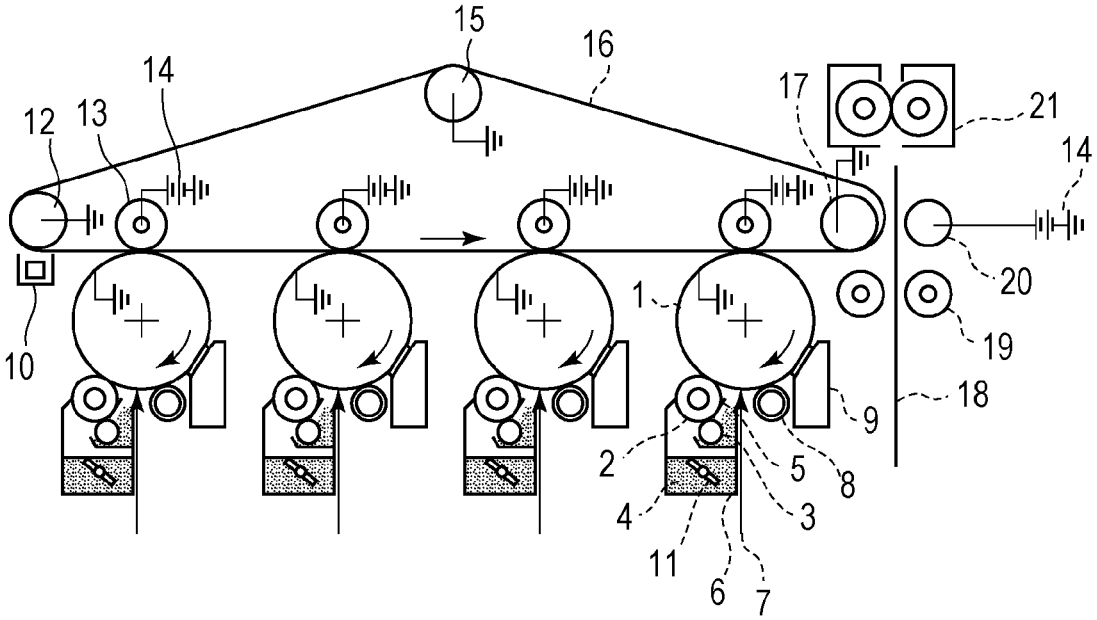
FIG. 3 is a schematic view of an image-forming apparatus used in an embodiment of the present invention.

The image density was measured with a tandem system laser-beam printer LBP7700 manufactured by CANON KABUSHIKI KAISHA as illustrated in FIG. 3.

First, a toner cartridge of the printer was charged with 150 g of the toner 1.

The toner cartridge containing the toner was left to stand in a low temperature and low humidity (10° C./15% RH) environment, in a normal temperature and humidity (25° C./50% RH) environment, or in a high temperature and high humidity (32.5° C./85% RH) environment for 24 hours. After the toner cartridge was left to stand in each environment for 24 hours, an image including a solid image portion and having a printing rate of 30% was printed on 1,100 sheets. The image density of the solid image portion was determined from the initial image and the image on the 1,100th sheet.

The same measurement was performed through the same image formation after the toner cartridge was left to stand in a severe environment (40° C./95% RH) for 168 hours and then at high temperature and high humidity (32.5° C./90% RH) for 24 hours.

The image density was measured with a Macbeth densitometer (RD-914: manufactured by Macbeth) equipped with an SPI auxiliary filter. The evaluation criteria for image density were as follows:

A: 1.45 or more

B: 1.40 or more and less than 1.45

C: 1.30 or more and less than 1.40

D: 1.25 or more and less than 1.30

E: 1.20 or more and less than 1.25

F: Less than 1.20

Evaluation of Soiling of Components

After the 1,100 sheets were printed in the image density measurement, another image was printed on a sheet. The first half of the image was a halftone image (toner bearing amount: 0.25 mg/cm$^2$), and the second half of the image was a solid image (toner bearing amount: 0.40 mg/cm$^2$). Soiling of components was evaluated from the image according to the following criteria. The transferring material was a 70 g/m$^2$ A4-size sheet, and the image was printed in the transverse direction.

A: Neither vertical streaks in the paper ejection direction nor dots having different densities are observed on the developing roller and on the halftone portion and solid portion of the image.

B: Although one or two narrow streaks are observed at both ends of the developing roller in the circumferential direction, and/or one to three melt-adhered particles are observed on the photosensitive drum, neither vertical streaks in the paper ejection direction nor dots having different densities are observed on the halftone portion and solid portion of the image.

C: Three to five narrow streaks are observed at both ends of the developing roller in the circumferential direction, and/or four or five melt-adhered particles are observed on the photosensitive drum. Otherwise, although a very few vertical streaks in the paper ejection direction and/or a very few dots having different densities are observed on the halftone portion and solid portion of the image, the vertical streaks and dots can be deleted by image processing.

D: Six to twenty narrow streaks are observed at both ends of the developing roller in the circumferential direction, and/or six to twenty melt-adhered particles are observed on the photosensitive drum. Otherwise, a few streaks and/or dots having different densities are observed on the halftone portion and solid portion of the image, and the streaks and dots cannot be deleted by image processing.

E: Twenty-one or more narrow streaks are observed at both ends of the developing roller in the circumferential direction, and/or 21 or more melt-adhered particles are observed on the photosensitive drum. Otherwise, streaks or dots having different densities are observed on the halftone portion and solid portion of the image, and the streaks and dots cannot be deleted by image processing.

Evaluation of Low-Temperature Fixability (Low-Temperature Offset Finish Temperature)

A fixing unit of the laser-beam printer LBP7700 manufactured by CANON KABUSHIKI KAISHA was modified so that the fixing temperature could be adjusted. An unfixed toner image was hot-pressed on a recording paper at a toner bearing amount of 0.4 mg/cm$^2$ with the modified fixing unit at a process speed of 230 mm/s. The fixing temperature was changed in 5° C. steps.

With respect to fixability, a fixed image was rubbed 10 times with a Kimwipe [S-200 (Nippon Paper Crecia Co., Ltd.)] at a load of 75 g/cm$^2$. Among temperatures at which the density-decreasing rate due to rubbing was less than 5%, the lowest temperature was considered to be the low-temperature offset finish temperature. The evaluation was performed at normal temperature and humidity (25° C./50% RH).

Evaluation of Fogging

The fogging density (%) was calculated from a difference between the white level of a white ground portion of a printout image and the white level of a transferring material before image formation measured with a "reflectometer" (manufactured by Tokyo Denshoku. Co., Ltd.).

The image fogging was evaluated according to the following criteria.

A: Less than 1.0%

B: 1.0% or more and less than 1.5%

C: 1.5% or more and less than 2.0%

D: 2.0% or more and less than 2.5%

E: 2.5% or more and less than 3.0%

F: 3.0% or more

Storage Stability Test

After approximately 10 g of toner in a 100-mL vial was left to stand at a temperature of 55° C. and at a humidity of 20% for 15 days, the toner was visually inspected.

A: No change

B: Friable agglomerates are observed.

C: Nonfriable agglomerates are observed.

D: No flowability

E: Apparent caking

Long-Term Storage Stability Test

After approximately 10 g of toner in a 100-mL vial was left to stand at a temperature of 45° C. and at a humidity of 95% for 3 months, the toner was visually inspected.

A: No change

B: Friable agglomerates are observed.

C: Nonfriable agglomerates are observed.

D: No flowability

E: Apparent caking

Exemplary Embodiments 2 to 29

Toners 2 to 29 were produced in the same manner as in Exemplary Embodiment 1 except that the toner particles 1 were replaced with the toner particles 2 to 29. The toners 2 to 29 were evaluated in the same manner as in Exemplary Embodiment 1. Tables 13, 14, and 15 list the results.

COMPARATIVE EXAMPLES 1 TO 10

Comparative toners 1 to 10 were produced in the same manner as in Exemplary Embodiment 1 except that the toner particles 1 were replaced with the comparative toner particles 1 to 10. The comparative toners 1 to 10 were evaluated in the same manner as in Exemplary Embodiment 1. Table 16 lists the results.

Exemplary Embodiment 30

Evaluation was performed in the same manner as in Exemplary Embodiment 1 except that the toner 1 was replaced with the toner particles 1 (toner particles without the external additives were used). Table 15 shows the results. The results were comparable to the results in Exemplary Embodiment 1.

Exemplary Embodiment 31

Each toner cartridge of a tandem system laser-beam printer LBP7700 manufactured by CANON KABUSHIKI KAISHA as illustrated in FIG. 3 was charged with 150 g of the toner 1 (cyan), the toner 23 (black), the toner 28 (magenta), or the toner 29 (yellow). The four color toner cartridges were left to stand in a low temperature and low humidity L/L (10° C./15% RH) environment, in a normal temperature and humidity N/N (25° C./50% RH) environment, or in a high temperature and high humidity H/H (32.5° C./85% RH) environment for 24 hours. After the toner cartridges were left to stand in each environment for 24 hours, the color toner cartridges were mounted in LBP7700, and an image including a solid image region and having a printing rate of 30.0% was printed on 1,100 sheets. The initial image and the image on the 1,100th sheet were evaluated for the solid image density and fogging. Soiling of components (filming, development stripes) after 1,100 sheets output was also evaluated. The evaluation results were good.

The color toner cartridges were left to stand in a severe environment (40° C./95% RH) for 168 hours and then at high temperature and high humidity (32.5° C./90% RH) for 24 hours. The same image formation and the same measurement were then performed. As a result, there were no practical difficulties, and good results were obtained.

TABLE 1

| Toner particles | | | Toner particles 1 | Toner particles 2 | Toner particles 3 | Toner particles 4 | Toner particles 5 |
|---|---|---|---|---|---|---|---|
| Monomer | Styrene | Parts by mass | 70.0 | 70.0 | 70.0 | 70.0 | 70.0 |
| | n-Butyl acrylate | Parts by mass | 30.0 | 30.0 | 30.0 | 30.0 | 30.0 |
| | Divinylbenzene | Parts by mass | 0.10 | 0.10 | 0.10 | 0.10 | 0.10 |
| | Silane | Silane 1 | Methyltri-ethoxysilane | Ethyltri-ethoxysilane | n-Propyltri-ethoxysilane | n-Butyltri-ethoxysilane | Phenyltri-ethoxysilane |
| | | Silane 1 parts by mass | 15.0 | 15.0 | 15.0 | 15.0 | 15.0 |
| | | Silane 2 | — | — | — | — | — |
| | | Silane 2 parts by mass | — | — | — | — | — |
| Polyester resin | | Type | (1) | (1) | (1) | (1) | (1) |
| | | Parts by mass | 5.0 | 5.0 | 5.0 | 5.0 | 5.0 |
| Release agent | | Type | Behenyl behenate | Behenyl behenate | Behenyl behenate | Behenyl behenate | Behenyl behenate |
| | | Parts by mass | 10.0 | 10.0 | 10.0 | 10.0 | 10.0 |
| | | Melting point (° C.) | 72.1 | 72.1 | 72.1 | 72.1 | 72.1 |
| | | Amount of heat absorption (J/g) | 210.3 | 210.3 | 210.3 | 210.3 | 210.3 |
| Colorant | | Type of colorant | P.B. 15:3 | P.B. 15:3 | P.B. 15:3 | P.B. 15:3 | P.B. 15:3 |
| | | Parts by mass | 6.5 | 6.5 | 6.5 | 6.5 | 6.5 |
| Negative charge control agent | Charge control resin 1 | Parts by mass | 0.5 | 0.5 | 0.5 | 0.5 | 0.5 |
| | Charge control agent | Parts by mass | 0.5 | 0.5 | 0.5 | 0.5 | 0.5 |
| Oil-soluble initiator | Type | | t-Butyl peroxy-pivalate | t-Butyl peroxy-pivalate | t-Butyl peroxy-pivalate | t-Butyl peroxy-pivalate | t-Butyl peroxy-pivalate |
| | Addition amount | Parts by mass | 14.0 | 14.0 | 14.0 | 14.0 | 14.0 |
| Polymerization conditions | Reaction 1 | Temperature | 70 | 70 | 70 | 70 | 70 |
| | | Holding time (hours) | 5 h | 5 h | 5 h | 5 h | 5 h |
| | | pH | 5.1 | 5.1 | 5.1 | 5.1 | 5.1 |
| | Reaction 2 | Temperature | 85 | 85 | 85 | 85 | 85 |
| | | Holding time (hours) | 5 h | 5 h | 5 h | 5 h | 5 h |
| | | pH | 7.0 | 7.0 | 7.0 | 7.0 | 7.0 |
| | Reaction 3 | Temperature | 100 | 100 | 100 | 100 | 100 |
| | | Holding time (hours) | 5 h | 5 h | 5 h | 5 h | 5 h |
| | | pH | 7.0 | 7.0 | 7.0 | 7.0 | 7.0 |
| Toner physical properties | THF-insoluble matter (%) | | 12.1 | 12.3 | 13.1 | 13 | 11.4 |
| | Average circularity | | 0.981 | 0.982 | 0.983 | 0.982 | 0.981 |
| | Mode circularity | | 1.00 | 1.00 | 1.00 | 1.00 | 1.00 |
| | Weight-average molecular weight of toner particles | | 34000 | 34200 | 34400 | 33700 | 32400 |
| | Weight-average molecular weight/number-average molecular weight of toner particles | | 12.6 | 12.3 | 11.4 | 11.2 | 12.4 |
| | Circle-equivalent diameter Dtem calculated from cross-sectional area of toner (μm) | | 5.6 | 5.6 | 5.7 | 5.6 | 5.5 |
| | Weight-average particle diameter (μm) | | 5.6 | 5.6 | 5.6 | 5.6 | 5.5 |
| | Number-average particle size (μm) | | 5.2 | 5.2 | 5.2 | 5.2 | 5.2 |
| | Endothermic main peak temperature (° C.) | | 70.2 | 70.4 | 70.4 | 70.5 | 70.4 |
| | Integral heat quantity (J/g) | | 19.2 | 19.7 | 19.4 | 19.7 | 19.5 |

TABLE 1-continued

| Toner particles | | | Toner particles 1 | Toner particles 2 | Toner particles 3 | Toner particles 4 | Toner particles 5 |
|---|---|---|---|---|---|---|---|
| | Glass transition point (° C.) | | 50.1 | 48.9 | 50.2 | 50.4 | 50.1 |
| | Flow tester | 80° C. viscosity (Pa · S) | 19000 | 18000 | 19000 | 19000 | 19300 |

TABLE 2

| Toner particles | | | Toner particles 6 | Toner particles 7 | Toner particles 8 | Toner particles 9 | Toner particles 10 |
|---|---|---|---|---|---|---|---|
| Monomer | Styrene | Parts by mass | 70.0 | 70.0 | 70.0 | 70.0 | 70.0 |
| | n-Butyl acrylate | Parts by mass | 30.0 | 30.0 | 30.0 | 30.0 | 30.0 |
| | Divinylbenzene | Parts by mass | 0.10 | 0.10 | 0.10 | 0.10 | 0.10 |
| | Silane | Silane 1 | Methyltri-methoxysilane | Methyltri-isopropoxysilane | Methyldi-ethoxychloro-silane | Methyltri-ethoxysilane | Methyltri-ethoxysilane |
| | | Silane 1 parts by mass | 15.0 | 15.0 | 15.0 | 30.0 | 10.4 |
| | | Silane 2 | — | — | — | — | — |
| | | Silane 2 parts by mass | — | — | — | — | — |
| Polyester resin | | Type | (1) | (1) | (1) | (1) | (1) |
| | | Parts by mass | 5.0 | 5.0 | 5.0 | 5.0 | 5.0 |
| Release agent | | Type | Behenyl behenate | Behenyl behenate | Behenyl behenate | Behenyl behenate | Behenyl behenate |
| | | Parts by mass | 10.0 | 10.0 | 10.0 | 10.0 | 10.0 |
| | | Melting point (° C.) | 72.1 | 72.1 | 72.1 | 72.1 | 72.1 |
| | | Amount of heat absorption (J/g) | 210.3 | 210.3 | 210.3 | 210.3 | 210.3 |
| Colorant | | Type of colorant | P.B. 15:3 | P.B. 15:3 | P.B. 15:3 | P.B. 15:3 | P.B. 15:3 |
| | | Parts by mass | 6.5 | 6.5 | 6.5 | 6.5 | 6.5 |
| Negative charge control agent | Charge control resin 1 | Parts by mass | 0.5 | 0.5 | 0.5 | 0.5 | 0.5 |
| | Charge control agent 1 | Parts by mass | 0.5 | 0.5 | 0.5 | 0.5 | 0.5 |
| Oil-soluble initiator | Type | | t-Butyl peroxy-pivalate | t-Butyl peroxy-pivalate | t-Butyl peroxy-pivalate | t-Butyl peroxy-pivalate | t-Butyl peroxy-pivalate |
| | Addition amount | Parts by mass | 14.0 | 14.0 | 14.0 | 14.0 | 14.0 |
| Polymerization conditions | Reaction 1 | Temperature | 70 | 70 | 70 | 70 | 70 |
| | | Holding time (hours) | 5 h | 5 h | 5 h | 5 h | 5 h |
| | | pH | 5.1 | 5.1 | 5.1 | 5.1 | 5.1 |
| | Reaction 2 | Temperature | 85 | 85 | 85 | 85 | 85 |
| | | Holding time (hours) | 5 h | 5 h | 5 h | 5 h | 5 h |
| | | pH | 7.0 | 7.0 | 7.0 | 7.0 | 7.0 |
| | Reaction 3 | Temperature | 100 | 100 | 100 | 100 | 100 |
| | | Holding time (hours) | 5 h | 5 h | 5 h | 5 h | 5 h |
| | | pH | 7.0 | 7.0 | 7.0 | 7.0 | 7.0 |
| Toner physical properties | THF-insoluble matter (%) | | 12.4 | 12.3 | 12.5 | 10.9 | 11 |
| | Average circularity | | 0.981 | 0.981 | 0.982 | 0.981 | 0.981 |
| | Mode circularity | | 1.00 | 1.00 | 1.00 | 1.00 | 1.00 |
| | Weight-average molecular weight of toner particles | | 34000 | 34000 | 34100 | 34200 | 34100 |
| | Weight-average molecular weight/number-average molecular weight of toner particles | | 11.3 | 11.5 | 11.7 | 11.2 | 11.2 |
| | Circle-equivalent diameter Dtem calculated from cross-sectional area of toner (μm) | | 5.6 | 5.5 | 5.4 | 5.4 | 5.4 |
| | Weight-average particle diameter (μm) | | 5.6 | 5.6 | 5.6 | 5.6 | 5.6 |
| | Number-average particle size (μm) | | 5.2 | 5.2 | 5.2 | 5.2 | 5.2 |
| | Endothermic main peak temperature (° C.) | | 70.3 | 70.3 | 70.3 | 70.3 | 70.4 |
| | Integral heat quantity (J/g) | | 19.4 | 19.3 | 19.3 | 19.2 | 18.9 |
| | Glass transition point (° C.) | | 49.1 | 49.2 | 50.1 | 50.4 | 50.4 |
| | Flow tester | 80° C. viscosity (Pa · S) | 19800 | 18500 | 19000 | 18500 | 19000 |

TABLE 3

| Toner particles | | | Toner particles 11 | Toner particles 12 | Toner particles 13 | Toner particles 14 | Toner particles 15 |
|---|---|---|---|---|---|---|---|
| Monomer | Styrene | Parts by mass | 70.0 | 70.0 | 70.0 | 70.0 | 70.0 |
| | n-Butyl acrylate | Parts by mass | 30.0 | 30.0 | 30.0 | 30.0 | 30.0 |
| | Divinylbenzene | Parts by mass | 0.10 | 0.10 | 0.10 | 0.10 | 0.10 |
| | Silane | Silane 1 | Methyltri-ethoxysilane | Methyltri-ethoxysilane | Methyltri-ethoxysilane | Methyltri-ethoxysilane | Methyltri-ethoxysilane |
| | | Silane 1 parts by mass | 9.5 | 4.0 | 3.0 | 15.0 | 15.0 |
| | | Silane 2 | — | — | — | — | — |
| | | Silane 2 parts by mass | — | — | — | — | — |

TABLE 3-continued

| Toner particles | | | Toner particles 11 | Toner particles 12 | Toner particles 13 | Toner particles 14 | Toner particles 15 |
|---|---|---|---|---|---|---|---|
| Polyester resin | | Type | (1) | (1) | (1) | (1) | (1) |
| | | Parts by mass | 5.0 | 5.0 | 5.0 | 5.0 | 5.0 |
| Release agent | | Type | Behenyl behenate | Behenyl behenate | Behenyl behenate | Behenyl behenate | Behenyl behenate |
| | | Parts by mass | 10.0 | 10.0 | 10.0 | 10.0 | 10.0 |
| | | Melting point (° C.) | 72.1 | 72.1 | 72.1 | 72.1 | 72.1 |
| | | Amount of heat absorption (J/g) | 210.3 | 210.3 | 210.3 | 210.3 | 210.3 |
| Colorant | | Type of colorant | P.B. 15:3 | P.B. 15:3 | P.B. 15:3 | P.B. 15:3 | P.B. 15:3 |
| | | Parts by mass | 6.5 | 6.5 | 6.5 | 6.5 | 6.5 |
| Negative charge control agent | Charge control resin 1 | Parts by mass | 0.5 | 0.5 | 0.5 | 0.5 | 0.5 |
| | Charge control agent 1 | Parts by mass | 0.5 | 0.5 | 0.5 | 0.5 | 0.5 |
| Oil-soluble initiator | Type | | t-Butyl peroxy-pivalate | t-Butyl peroxy-pivalate | t-Butyl peroxy-pivalate | t-Butyl peroxy-pivalate | t-Butyl peroxy-pivalate |
| | Addition amount | Parts by mass | 14.0 | 14.0 | 14.0 | 14.0 | 14.0 |
| Polymerization conditions | Reaction 1 | Temperature | 70 | 70 | 70 | 70 | 70 |
| | | Holding time (hours) | 5 h | 5 h | 5 h | 5 h | 5 h |
| | | pH | 5.1 | 5.1 | 5.1 | 5.1 | 5.1 |
| | Reaction 2 | Temperature | 85 | 85 | 85 | 85 | 85 |
| | | Holding time (hours) | 5 h | 5 h | 5 h | 5 h | 5 h |
| | | pH | 7.0 | 7.0 | 7.0 | 10.2 | 5.1 |
| | Reaction 3 | Temperature | 100 | 100 | 100 | 100 | 100 |
| | | Holding time (hours) | 5 h | 5 h | 5 h | 5 h | 5 h |
| | | pH | 7.0 | 7.0 | 7.0 | 10.2 | 5.1 |
| Toner physical properties | THF-insoluble matter (%) | | 11.2 | 9.8 | 10.4 | 11.2 | 12.1 |
| | Average circularity | | 0.980 | 0.980 | 0.980 | 0.981 | 0.982 |
| | Mode circularity | | 1.00 | 1.00 | 1.00 | 1.00 | 1.00 |
| | Weight-average molecular weight of toner particles | | 34700 | 34600 | 34200 | 34200 | 32200 |
| | Weight-average molecular weight/number-average molecular weight of toner particles | | 11.0 | 11.2 | 11.4 | 11.4 | 11.3 |
| | Circle-equivalent diameter Dtem calculated from cross-sectional area of toner (μm) | | 5.4 | 5.5 | 5.6 | 5.5 | 5.5 |
| | Weight-average particle diameter (μm) | | 5.6 | 5.7 | 5.7 | 5.6 | 5.6 |
| | Number-average particle size (μm) | | 5.2 | 5.2 | 5.2 | 5.2 | 5.2 |
| | Endothermic main peak temperature (° C.) | | 70.1 | 70.6 | 70.8 | 70.2 | 70.4 |
| | Integral heat quantity (J/g) | | 19.4 | 19.4 | 19.2 | 19.3 | 19.7 |
| | Glass transition point (° C.) | | 50.3 | 50.3 | 50.1 | 50.4 | 50.5 |
| | Flow tester | 80° C. viscosity (Pa · S) | 18600 | 18700 | 19200 | 19300 | 19800 |

TABLE 4

| Toner particles | | | Toner particles 16 | Toner particles 17 | Toner particles 18 | Toner particles 19 | Toner particles 20 |
|---|---|---|---|---|---|---|---|
| Monomer | Styrene | Parts by mass | 70.0 | 70.0 | 70.0 | 70.0 | 70.0 |
| | n-Butyl acrylate | Parts by mass | 30.0 | 30.0 | 30.0 | 30.0 | 30.0 |
| | Divinylbenzene | Parts by mass | 0.10 | 0.10 | 0.10 | 0.10 | 0.10 |
| | Silane | Silane 1 | Methyltri-ethoxysilane | Methyltri-ethoxysilane | Methyltri-ethoxysilane | Methyltri-methoxysilane | Methyltri-ethoxysilane |
| | | Silane 1 parts by mass | 15.0 | 7.5 | 12.5 | 7.5 | 15.0 |
| | | Silane 2 | — | Tetraeth-oxysilane | Vinyltri-ethoxysilane | Methyltri-ethoxysilane | — |
| | | Silane 2 parts by mass | — | 7.5 | 2.5 | 7.5 | — |
| Polyester resin | | Type | (1) | (1) | (1) | (1) | (1) |
| | | Parts by mass | 5.0 | 5.0 | 5.0 | 5.0 | 5.0 |
| Release agent | | Type | Behenyl behenate | Behenyl behenate | Behenyl behenate | Behenyl behenate | Behenyl behenate |
| | | Parts by mass | 10.0 | 10.0 | 10.0 | 10.0 | 10.0 |
| | | Melting point (° C.) | 72.1 | 72.1 | 72.1 | 72.1 | 72.1 |
| | | Amount of heat absorption (J/g) | 210.3 | 210.3 | 210.3 | 210.3 | 210.3 |
| Colorant | | Type of colorant | P.B. 15:3 | P.B. 15:3 | P.B. 15:3 | P.B. 15:3 | P.B. 15:3 |
| | | Parts by mass | 6.5 | 6.5 | 6.5 | 6.5 | 6.5 |
| Negative charge control agent | Charge control resin 1 | Parts by mass | 0.5 | 0.5 | 0.5 | 0.5 | 0.5 |
| | Charge control agent 1 | Parts by mass | 0.5 | 0.5 | 0.5 | 0.5 | 0.5 |
| Oil-soluble initiator | Type | | t-Butyl peroxy-pivalate | t-Butyl peroxy-pivalate | t-Butyl peroxy-pivalate | t-Butyl peroxy-pivalate | t-Butyl peroxy-pivalate |
| | Addition amount | Parts by mass | 14.0 | 14.0 | 14.0 | 14.0 | 14.0 |
| Polymerization conditions | Reaction 1 | Temperature | 70 | 70 | 70 | 70 | 70 |
| | | Holding time (hours) | 5 h | 5 h | 5 h | 5 h | 5 h |
| | | pH | 4.1 | 5.1 | 5.1 | 5.1 | 5.1 |

TABLE 4-continued

| Toner particles | | | Toner particles 16 | Toner particles 17 | Toner particles 18 | Toner particles 19 | Toner particles 20 |
|---|---|---|---|---|---|---|---|
| | Reaction 2 | Temperature | 85 | 85 | 85 | 85 | 85 |
| | | Holding time (hours) | 5 h | 5 h | 5 h | 5 h | 10 h |
| | | pH | 4.1 | 7.0 | 7.0 | 7.0 | 7.0 |
| | Reaction 3 | Temperature | 100 | 100 | 100 | 100 | — |
| | | Holding time (hours) | 5 h | 5 h | 5 h | 5 h | |
| | | pH | 4.1 | 7.0 | 7.0 | 7.0 | |
| Toner physical properties | THF-insoluble matter (%) | | 10.2 | 11.6 | 13.4 | 10.4 | 12.1 |
| | Average circularity | | 0.982 | 0.983 | 0.974 | 0.981 | 0.982 |
| | Mode circularity | | 1.00 | 1.00 | 1.00 | 1.00 | 1.00 |
| | Weight-average molecular weight of toner particles | | 31400 | 34200 | 34600 | 34700 | 33700 |
| | Weight-average molecular weight/number-average molecular weight of toner particles | | 11.3 | 11.4 | 11.4 | 11.3 | 11.4 |
| | Circle-equivalent diameter Dtem calculated from cross-sectional area of toner (μm) | | 5.5 | 5.5 | 5.4 | 5.4 | 5.6 |
| | Weight-average particle diameter (μm) | | 5.6 | 5.6 | 5.6 | 5.6 | 5.5 |
| | Number-average particle size (μm) | | 5.2 | 5.2 | 5.2 | 5.2 | 5.2 |
| | Endothermic main peak temperature (° C.) | | 70.4 | 70.4 | 70.4 | 70.3 | 70.3 |
| | Integral heat quantity (J/g) | | 19.3 | 19.6 | 19.4 | 19.6 | 19.4 |
| | Glass transition point (° C.) | | 50.1 | 50.2 | 50.4 | 50.7 | 50.5 |
| | Flow tester | 80° C. viscosity (Pa · S) | 19600 | 18600 | 19100 | 19800 | 18900 |

TABLE 5

| Toner particles | | | Toner particles 21 | Toner particles 22 | Toner particles 23 | Toner particles 24 | Toner particles 25 |
|---|---|---|---|---|---|---|---|
| Monomer | Styrene | Parts by mass | 70.0 | Described in specification | 70.0 | Described in specification | Described in specification |
| | n-Butyl acrylate | Parts by mass | 30.0 | | 30.0 | | |
| | Divinylbenzene | Parts by mass | 0.10 | | 0.10 | | |
| | Silane | Silane 1 | Methyltri-ethoxysilane | | Methyltri-ethoxysilane | | |
| | | Silane 1 parts by mass | 15.0 | | 15.0 | | |
| | | Silane 2 | — | | — | | |
| | | Silane 2 parts by mass | — | | — | | |
| Polyester resin | | Type | (1) | | (1) | | |
| | | Parts by mass | 5.0 | | 5.0 | | |
| Release agent | | Type | Behenyl behenate | | Behenyl behenate | | |
| | | Parts by mass | 10.0 | | 10.0 | | |
| | | Melting point (° C.) | 72.1 | | 72.1 | | |
| | | Amount of heat absorption (J/g) | 210.3 | | 210.3 | | |
| Colorant | | Type of colorant | P.B. 15:3 | | Carbon black | | |
| | | Parts by mass | 6.5 | | 10 | | |
| Negative charge control agent | Charge control resin 1 | Parts by mass | 0.5 | | 0.5 | | |
| | Charge control agent | Parts by mass | 0.5 | | 0.5 | | |
| Oil-soluble initiator | Type | | t-Butyl peroxy-pivalate | | t-Butyl peroxy-pivalate | | |
| | Addition amount | Parts by mass | 14.0 | | 14.0 | | |
| Polymerization conditions | Reaction 1 | Temperature | 70 | | 70 | | |
| | | Holding time (hours) | 10 h | | 5 h | | |
| | | pH | 5.1 | | 5.1 | | |
| | Reaction 2 | Temperature | 85 | | 85 | | |
| | | Holding time (hours) | 5 h | | 5 h | | |
| | | pH | 7.0 | | 7.0 | | |
| | Reaction 3 | Temperature | — | | 100 | | |
| | | Holding time (hours) | | | 5 h | | |
| | | pH | | | 7.0 | | |
| Toner physical properties | THF-insoluble matter (%) | | 11.9 | 28.4 | 12.1 | 26.2 | 9.7 |
| | Average circularity | | 0.982 | 0.976 | 0.981 | 0.978 | 0.967 |
| | Mode circularity | | 1.00 | 0.99 | 1.00 | 1.00 | 0.98 |
| | Weight-average molecular weight of toner particles | | 36200 | 38200 | 34200 | 33800 | 42300 |
| | Weight-average molecular weight/number-average molecular weight of toner particles | | 11.4 | 17.9 | 12.6 | 16.4 | 20.1 |
| | Circle-equivalent diameter Dtem calculated from cross-sectional area of toner (μm) | | 5.6 | 5.6 | 5.7 | 5.5 | 5.6 |
| | Weight-average particle diameter (μm) | | 5.5 | 5.5 | 5.6 | 5.6 | 5.5 |
| | Number-average particle size (μm) | | 5.2 | 5.1 | 5.2 | 5.1 | 5.0 |
| | Endothermic main peak temperature (° C.) | | 70.3 | 70.2 | 70.2 | 70.2 | 70.4 |
| | Integral heat quantity (J/g) | | 19.5 | 19.2 | 19.2 | 19.1 | 19.6 |
| | Glass transition point (° C.) | | 50.4 | 53.2 | 50.1 | 51.2 | 48.4 |
| | Flow tester | 80° C. viscosity (Pa · S) | 19100 | 17200 | 19000 | 25000 | 16500 |

TABLE 6

| Toner particles | | | Toner particles 26 | Toner particles 27 | Toner particles 28 | Toner particles 29 |
|---|---|---|---|---|---|---|
| Monomer | Styrene | Parts by mass | Described in specification | 62.0 | 70.0 | 70.0 |
| | n-Butyl acrylate | Parts by mass | | 38.0 | 30.0 | 30.0 |
| | Divinylbenzene | Parts by mass | | 0.10 | 0.10 | 0.10 |
| | Silane | Silane 1 | | Methyltri-ethoxysilane | Methyltri-ethoxysilane | Methyltri-ethoxysilane |
| | | Silane 1 parts by mass | | 15.0 | 15.0 | 15.0 |
| | | Silane 2 | | Dimethyldi-ethoxysilane, titanium tetra-n-butoxide | — | — |
| | | Silane 2 parts by mass | | 1.0, 1.0 | — | — |
| Polyester resin | | Type | | (1) | (1) | (1) |
| | | Parts by mass | | 5.0 | 5.0 | 5.0 |
| Release agent | | Type | | Behenyl behenate | Behenyl behenate | Behenyl behenate |
| | | Parts by mass | | 10.0 | 10.0 | 10.0 |
| | | Melting point (° C.) | | 72.1 | 72.1 | 72.1 |
| | | Amount of heat absorption (J/g) | | 210.3 | 210.3 | 210.3 |
| Colorant | | Type of colorant | | P.B. 15:3 | P.R. 122 | P.Y. 155 |
| | | Parts by mass | | 6.5 | 8.0 | 6.0 |
| Negative charge control agent | Charge control resin 1 | Parts by mass | | 0.5 | 0.5 | 0.5 |
| | Charge control agent 1 | Parts by mass | | 0.5 | 0.5 | 0.5 |
| Oil-soluble initiator | Type | | | t-Butyl peroxypivalate | t-Butyl peroxypivalate | t-Butyl peroxypivalate |
| | Addition amount | Parts by mass | | 14.0 | 14.0 | 14.0 |
| Polymerization conditions | Reaction 1 | Temperature | | 70 | 70 | 70 |
| | | Holding time (hours) | | 5 h | 5 h | 5 h |
| | | pH | | 5.1 | 5.1 | 5.1 |
| | Reaction 2 | Temperature | | 85 | 85 | 85 |
| | | Holding time (hours) | | 5 h | 5 h | 5 h |
| | | pH | | 7.0 | 7.0 | 7.0 |
| | Reaction 3 | Temperature | | 100 | 100 | 100 |
| | | Holding time (hours) | | 5 h | 5 h | 5 h |
| | | pH | | 7.0 | 7.0 | 7.0 |
| Toner physical properties | THF-insoluble matter (%) | | 18.7 | 11.7 | 12.8 | 11.7 |
| | Average circularity | | 0.984 | 0.981 | 0.978 | 0.982 |
| | Mode circularity | | 1.00 | 1.00 | 1.00 | 1.00 |
| | Weight-average molecular weight of toner particles | | 61000 | 33000 | 37400 | 31200 |
| | Weight-average molecular weight/number-average molecular weight of toner particles | | 22.1 | 12.6 | 14.2 | 11.8 |
| | Circle-equivalent diameter Dtem calculated from cross-sectional area of toner (μm) | | 5.7 | 5.6 | 5.7 | 5.6 |
| | Weight-average particle diameter (μm) | | 5.7 | 5.6 | 5.7 | 5.6 |
| | Number-average particle size (μm) | | 5.1 | 5.2 | 5.3 | 5.3 |
| | Endothermic main peak temperature (° C.) | | 70.4 | 70.2 | 70.3 | 70.2 |
| | Integral heat quantity (J/g) | | 19.1 | 19.2 | 19.0 | 19.4 |
| | Glass transition point (° C.) | | 51.4 | 39.9 | 49.8 | 50.2 |
| | Flow tester | 80° C. viscosity (Pa · S) | 18100 | 8700 | 21200 | 18100 |

TABLE 7

| Toner particles | | | Comparative toner particles 1 | Comparative toner particles 2 | Comparative toner particles 3 | Comparative toner particles 4 | Comparative toner particles 5 |
|---|---|---|---|---|---|---|---|
| Monomer | Styrene | Parts by mass | 70.0 | 70.0 | 70.0 | 70.0 | 70.0 |
| | n-Butyl acrylate | Parts by mass | 30.0 | 30.0 | 30.0 | 30.0 | 30.0 |
| | Divinylbenzene | Parts by mass | 0.10 | 0.10 | 0.10 | 0.10 | 0.10 |
| | Silane | Silane 1 | Methyltri-ethoxysilane | Methyltri-ethoxysilane | Tetraeth-oxysilane | 3-Methacryl-oxypropyl-triethoxysilane | 3-Methacryl-oxypropyl-triethoxysilane |
| | | Silane 1 parts by mass | 2.0 | 1.5 | 15.0 | 15.0 | 15.0 |
| | | Silane 2 | — | — | — | — | — |
| | | Silane 2 parts by mass | — | — | — | — | — |
| Polyester resin | | Type | (1) | (1) | (1) | (1) | (1) |
| | | Parts by mass | 5.0 | 5.0 | 5.0 | 5.0 | 5.0 |
| Release agent | | Type | Behenyl behenate | Behenyl behenate | Behenyl behenate | Behenyl behenate | Behenyl behenate |
| | | Parts by mass | 10.0 | 10.0 | 10.0 | 10.0 | 10.0 |
| | | Melting point (° C.) | 72.1 | 72.1 | 72.1 | 72.1 | 72.1 |

TABLE 7-continued

| Toner particles | | | Comparative toner particles 1 | Comparative toner particles 2 | Comparative toner particles 3 | Comparative toner particles 4 | Comparative toner particles 5 |
|---|---|---|---|---|---|---|---|
| | | Amount of heat absorption (J/g) | 210.3 | 210.3 | 210.3 | 210.3 | 210.3 |
| Colorant | | Type of colorant | P.B. 15:3 | P.B. 15:3 | P.B. 15:3 | P.B. 15:3 | P.B. 15:3 |
| | | Parts by mass | 6.5 | 6.5 | 6.5 | 6.5 | 6.5 |
| Negative charge control agent | Charge control resin 1 | Parts by mass | 0.5 | 0.5 | 0.5 | 0.5 | 0.5 |
| | Charge control agent 1 | Parts by mass | 0.5 | 0.5 | 0.5 | 0.5 | 0.5 |
| Oil-soluble initiator | Type | | t-Butyl peroxy-pivalate | t-Butyl peroxy-pivalate | t-Butyl peroxy-pivalate | t-Butyl peroxy-pivalate | t-Butyl peroxy-pivalate |
| | Addition amount | Parts by mass | 14.0 | 14.0 | 14.0 | 14.0 | 14.0 |
| Polymerization conditions | Reaction 1 | Temperature | 70 | 70 | 70 | 70 | 70 |
| | | Holding time (hours) | 5 h | 5 h | 5 h | 5 h | 5 h |
| | | pH | 5.1 | 5.1 | 5.1 | 5.1 | 5.1 |
| | Reaction 2 | Temperature | 85 | 85 | 85 | 85 | 70 |
| | | Holding time (hours) | 5 h | 5 h | 5 h | 5 h | 10 h |
| | | pH | 7.0 | 7.0 | 7.0 | 7.0 | 7.0 |
| | Reaction 3 | Temperature | 100 | 100 | 100 | 100 | — |
| | | Holding time (hours) | 5 h | 5 h | 5 h | 5 h | |
| | | pH | 7.0 | 7.0 | 7.0 | 7.0 | |
| Toner physical properties | THF-insoluble matter (%) | | 10.4 | 11.2 | 11.6 | 32.3 | 32.4 |
| | Average circularity | | 0.978 | 0.981 | 0.982 | 0.982 | 0.982 |
| | Mode circularity | | 1.00 | 1.00 | 1.00 | 1.00 | 1.00 |
| | Weight-average molecular weight of toner particles | | 34500 | 34200 | 34100 | 37200 | 37400 |
| | Weight-average molecular weight/number-average molecular weight of toner particles | | 11.4 | 10.8 | 10.9 | 11.5 | 11.8 |
| | Circle-equivalent diameter Dtem calculated from cross-sectional area of toner (μm) | | 5.6 | 5.6 | 5.5 | 5.7 | 5.6 |
| | Weight-average particle diameter (μm) | | 5.7 | 5.6 | 5.6 | 5.6 | 5.6 |
| | Number-average particle size (μm) | | 5.2 | 5.3 | 5.3 | 5.2 | 5.1 |
| | Endothermic main peak temperature (° C.) | | 70.6 | 70.1 | 70.8 | 70.6 | 70.4 |
| | Integral heat quantity (J/g) | | 19.2 | 19.4 | 19.8 | 19.4 | 19.3 |
| | Glass transition point (° C.) | | 50.1 | 50.3 | 49.9 | 50.9 | 50.4 |
| | Flow tester | 80° C. viscosity (Pa · S) | 19200 | 19400 | 19200 | 19500 | 19100 |

TABLE 8

| Toner particles | | | Comparative toner particles 6 | Comparative toner particles 7 | Comparative toner particles 8 | Comparative toner particles 9 | Comparative toner particles 10 |
|---|---|---|---|---|---|---|---|
| Monomer | Styrene | Parts by mass | 70.0 | 70.0 | 70.0 | 70.0 | Described in specification |
| | n-Butyl acrylate | Parts by mass | 30.0 | 30.0 | 30.0 | 30.0 | |
| | Divinylbenzene | Parts by mass | 0.10 | 0.10 | 0.10 | 0.10 | |
| | Silane | Silane 1 | 3-Methacryl-oxypropyl-triethoxysilane | 3-Methacryl-oxypropyl-triethoxysilane | Aminopropyltri-methoxysilane | | |
| | | Silane 1 parts by mass | 15.0 | 3.1 | 5.0 | 0.0 | |
| | | Silane 2 | — | — | — | — | |
| | | Silane 2 parts by mass | — | — | — | — | |
| Polyester resin | | Type | (1) | (1) | (1) | (1) | |
| | | Parts by mass | 5.0 | 5.0 | 5.0 | 5.0 | |
| Release agent | | Type | Behenyl behenate | Behenyl behenate | Behenyl behenate | Behenyl behenate | |
| | | Parts by mass | 10.0 | 10.0 | 10.0 | 10.0 | |
| | | Melting point (° C.) | 72.1 | 72.1 | 72.1 | 72.1 | |
| | | Amount of heat absorption (J/g) | 210.3 | 210.3 | 210.3 | 210.3 | |
| Colorant | | Type of colorant | P.B. 15:3 | P.B. 15:3 | P.B. 15:3 | P.B. 15:3 | |
| | | Parts by mass | 6.5 | 6.5 | 6.5 | 6.5 | |

TABLE 8-continued

| Toner particles | | | Comparative toner particles 6 | Comparative toner particles 7 | Comparative toner particles 8 | Comparative toner particles 9 | Comparative toner particles 10 |
|---|---|---|---|---|---|---|---|
| Negative charge control agent | Charge control resin 1 | Parts by mass | 0.5 | 0.5 | 0.5 | 0.5 | |
| | Charge control agent 1 | Parts by mass | 0.5 | 0.5 | 0.5 | 0.5 | |
| Oil-soluble initiator | Type | | t-Butyl peroxy-pivalate | t-Butyl peroxy-pivalate | t-Butyl peroxy-pivalate | t-Butyl peroxy-pivalate | |
| | Addition amount | Parts by mass | 14.0 | 14.0 | 14.0 | 14.0 | |
| Polymerization conditions | Reaction 1 | Temperature | 80 | 70 | 70 | 70 | |
| | | Holding time (hours) | 5 h | 5 h | 5 h | 5 h | |
| | | pH | 5.1 | 5.1 | 5.1 | 5.1 | |
| | Reaction 2 | Temperature | 80 | 85 | 85 | 85 | |
| | | Holding time (hours) | 10 h | 5 h | 5 h | 5 h | |
| | | pH | 7.0 | 7.0 | 7.0 | 7.0 | |
| | Reaction 3 | Temperature | — | 100 | 100 | 100 | |
| | | Holding time (hours) | | 5 h | 5 h | 5 h | |
| | | pH | | 7.0 | 7.0 | 7.0 | |
| Toner physical properties | THF-insoluble matter (%) | | 32.1 | 16.8 | 12.6 | 12.1 | 12.4 |
| | Average circularity | | 0.988 | 0.982 | 0.982 | 0.984 | 0.982 |
| | Mode circularity | | 1.00 | 1.00 | 1.00 | 1.00 | 1.00 |
| | Weight-average molecular weight of toner particles | | 28400 | 35200 | 34100 | 34300 | 34500 |
| | Weight-average molecular weight/number-average molecular weight of toner particles | | 9.8 | 10.8 | 11.4 | 12.3 | 11.4 |
| | Circle-equivalent diameter Dtem calculated from cross-sectional area of toner (μm) | | 5.6 | 5.7 | 5.7 | 5.6 | 5.6 |
| | Weight-average particle diameter (μm) | | 5.6 | 5.6 | 5.6 | 5.6 | 5.6 |
| | Number-average particle size (μm) | | 5.2 | 5.8 | 8.4 | 5.8 | 7 |
| | Endothermic main peak temperature (° C.) | | 70.3 | 70.5 | 70.3 | 70.3 | 70.8 |
| | Integral heat quantity (J/g) | | 19.4 | 19.8 | 19.1 | 19.1 | 19.6 |
| | Glass transition point (° C.) | | 50.6 | 50.1 | 50.6 | 50.7 | 50.9 |
| | Flow tester | 80° C. viscosity (Pa · S) | 16000 | 19400 | 19300 | 19800 | 19100 |

TABLE 9

| Toner particle No. | | | Toner particles 1 | Toner particles 2 | Toner particles 3 | Toner particles 4 | Toner particles 5 | Toner particles 6 |
|---|---|---|---|---|---|---|---|---|
| R in formula (T3) | | | Methyl group | Ethyl group | n-Propyl group | n-Butyl group | Phenyl group | Methyl group |
| Number of carbon atoms of R in formula (T3) | | | 1 | 2 | 3 | 4 | 6 | 1 |
| $R^1$ in formula (1) | | | Methyl group | Ethyl group | n-Propyl group | n-Butyl group | Phenyl group | Methyl group |
| Number of carbon atoms of $R^1$ in formula (1) | | | 1 | 2 | 3 | 4 | 6 | 1 |
| $R^2$, $R^3$, $R^4$ in formula (1) | | | Ethoxy group | Ethoxy group | Ethoxy group | Ethoxy group | Ethoxy group | Methoxy group |
| Average thickness Dav. of toner surface layer containing organosilicon polymer (nm) | | | 55.20 | 8.40 | 7.20 | 6.20 | 10.10 | 0.00 |
| ASi/AC in mapping measurement with FIB-TOF-SIMS | After etching with FIB (integral dose rate) | No etching with FIB | 96.30 | 48.20 | 44.20 | 40.50 | 41.20 | 94.20 |
| | | $1.66 \times 10^{19}/m^2$ (specified in Claim 1) | 71.26 | 38.56 | 36.24 | 33.62 | 34.52 | 68.20 |
| | | $3.11 \times 10^{19}/m^2$ | 44.18 | 26.99 | 26.10 | 24.88 | 22.42 | 42.50 |
| | | $6.64 \times 10^{19}/m^2$ | 14.80 | 12.15 | 12.00 | 12.19 | 11.20 | 14.24 |
| | | $1.33 \times 10^{20}/m^2$ | 5.59 | 4.84 | 5.14 | 5.64 | 4.30 | 5.30 |
| | | $5.31 \times 10^{20}/m^2$ | 1.23 | 1.02 | 1.03 | 1.07 | 1.01 | 1.17 |
| | | $1.06 \times 10^{21}/m^2$ | 0.94 | 0.76 | 0.76 | 0.77 | 0.68 | 0.87 |
| | | $4.25 \times 10^{21}/m^2$ | 0.65 | 0.53 | 0.46 | 0.46 | 0.42 | 0.52 |
| ASi in mapping measurement with FIB-TOF-SIMS | After etching with FIB (integral dose rate) | No etching with FIB | $4.89 \times 10^{-4}$ | $1.32 \times 10^{-4}$ | $1.24 \times 10^{-4}$ | $1.01 \times 10^{-4}$ | $1.02 \times 10^{-5}$ | $4.67 \times 10^{-4}$ |
| | | $1.66 \times 10^{19}/m^2$ | $3.55 \times 10^{-4}$ | $8.45 \times 10^{-5}$ | $7.69 \times 10^{-5}$ | $6.06 \times 10^{-5}$ | $5.11 \times 10^{-5}$ | $3.24 \times 10^{-4}$ |
| | | $3.11 \times 10^{19}/m^2$ | $2.19 \times 10^{-4}$ | $5.07 \times 10^{-5}$ | $4.23 \times 10^{-5}$ | $3.15 \times 10^{-5}$ | $2.76 \times 10^{-5}$ | $2.02 \times 10^{-4}$ |
| | | $6.64 \times 10^{19}/m^2$ | $7.34 \times 10^{-5}$ | $2.33 \times 10^{-5}$ | $1.95 \times 10^{-5}$ | $1.54 \times 10^{-5}$ | $1.34 \times 10^{-5}$ | $6.77 \times 10^{-5}$ |
| | | $1.33 \times 10^{20}/m^2$ | $2.77 \times 10^{-5}$ | $9.33 \times 10^{-6}$ | $8.17 \times 10^{-6}$ | $7.41 \times 10^{-6}$ | $7.22 \times 10^{-6}$ | $2.56 \times 10^{-5}$ |
| | | $5.31 \times 10^{20}/m^2$ | $6.10 \times 10^{-6}$ | $1.96 \times 10^{-6}$ | $1.63 \times 10^{-6}$ | $1.41 \times 10^{-6}$ | $1.34 \times 10^{-6}$ | $5.63 \times 10^{-6}$ |

TABLE 9-continued

| | | | | | | |
|---|---|---|---|---|---|---|
| $1.06 \times 10^{21}/m^2$ | $4.64 \times 10^{-6}$ | $1.47 \times 10^{-6}$ | $1.21 \times 10^{-6}$ | $1.01 \times 10^{-6}$ | $1.00 \times 10^{-6}$ | $4.22 \times 10^{-6}$ |
| $4.25 \times 10^{21}/m^2$ | $3.25 \times 10^{-6}$ | $1.03 \times 10^{-6}$ | $7.25 \times 10^{-7}$ | $6.08 \times 10^{-7}$ | $6.02 \times 10^{-7}$ | $2.53 \times 10^{-6}$ |
| Silicon concentration of surface of toner particles in ESCA measurement (atomic %) | 25.4 | 15.3 | 14.8 | 10.4 | 10.1 | 25.1 |
| Percentage K of $Ar_n$ having $FRA_n$ of 5.0 nm or less (%) | 0.0 | 9.4 | 21.9 | 75.0 | 26.4 | 3.1 |
| Production method | First production method | First production method | First production method | First production method | First production method | First production method |

| Toner particle No. | | | Toner particles 7 | Toner particles 8 | Toner particles 9 | Toner particles 10 |
|---|---|---|---|---|---|---|
| R in formula (T3) | | | Methyl group | Methyl group | Methyl group | Methyl group |
| Number of carbon atoms of R in formula (T3) | | | 1 | 1 | 1 | 1 |
| $R^1$ in formula (1) | | | Methyl group | Methyl group | Methyl group | Methyl group |
| Number of carbon atoms of $R^1$ in formula (1) | | | 1 | 1 | 1 | 1 |
| $R^2$, $R^3$, $R^4$ in formula (1) | | | Isopropoxy group | Chloro group, Ethoxy group | Ethoxy group | Ethoxy group |
| Average thickness Dav. of toner surface layer containing organosilicon polymer (nm) | | | 55.00 | 54.80 | 85.40 | 40.20 |
| ASi/AC in mapping measurement with FIB-TOF-SIMS | After etching with FIB (integral dose rate) | No etching with FIB | 93.40 | 91.40 | 152.40 | 62.40 |
| | | $1.66 \times 10^{19}/m^2$ (specified in Claim 1) | 67.20 | 66.10 | 124.97 | 44.93 |
| | | $3.11 \times 10^{19}/m^2$ | 42.00 | 41.20 | 94.98 | 24.71 |
| | | $6.64 \times 10^{19}/m^2$ | 14.70 | 14.83 | 59.83 | 6.18 |
| | | $1.33 \times 10^{20}/m^2$ | 5.29 | 5.19 | 14.36 | 1.24 |
| | | $5.31 \times 10^{20}/m^2$ | 1.16 | 1.14 | 3.16 | 0.28 |
| | | $1.06 \times 10^{21}/m^2$ | 0.86 | 0.87 | 2.40 | 0.21 |
| | | $4.25 \times 10^{21}/m^2$ | 0.52 | 0.52 | 1.44 | 0.13 |
| ASi in mapping measurement with FIB-TOF-SIMS | After etching with FIB (integral dose rate) | No etching with FIB | $4.60 \times 10^{-4}$ | $4.51 \times 10^{-4}$ | $6.34 \times 10^{-4}$ | $3.58 \times 10^{-4}$ |
| | | $1.66 \times 10^{19}/m^2$ | $3.15 \times 10^{-4}$ | $3.05 \times 10^{-4}$ | $5.14 \times 10^{-4}$ | $2.58 \times 10^{-4}$ |
| | | $3.11 \times 10^{19}/m^2$ | $1.94 \times 10^{-4}$ | $1.90 \times 10^{-4}$ | $4.76 \times 10^{-4}$ | $1.97 \times 10^{-4}$ |
| | | $6.64 \times 10^{19}/m^2$ | $6.79 \times 10^{-5}$ | $6.84 \times 10^{-5}$ | $3.00 \times 10^{-4}$ | $4.92 \times 10^{-5}$ |
| | | $1.33 \times 10^{20}/m^2$ | $2.44 \times 10^{-5}$ | $2.39 \times 10^{-5}$ | $7.19 \times 10^{-5}$ | $9.85 \times 10^{-6}$ |
| | | $5.31 \times 10^{20}/m^2$ | $5.38 \times 10^{-6}$ | $5.27 \times 10^{-6}$ | $1.58 \times 10^{-5}$ | $2.26 \times 10^{-6}$ |
| | | $1.06 \times 10^{21}/m^2$ | $3.98 \times 10^{-6}$ | $4.00 \times 10^{-6}$ | $1.20 \times 10^{-5}$ | $1.68 \times 10^{-6}$ |
| | | $4.25 \times 10^{21}/m^2$ | $2.39 \times 10^{-6}$ | $2.40 \times 10^{-6}$ | $7.21 \times 10^{-6}$ | $1.01 \times 10^{-6}$ |
| Silicon concentration of surface of toner particles in ESCA measurement (atomic %) | | | 25.1 | 24.8 | 26.2 | 20.6 |
| Percentage K of $Ar_n$ having $FRA_n$ of 5.0 nm or less (%) | | | 3.1 | 21.4 | 0.0 | 0.0 |
| Production method | | | First production method | First production method | First production method | First production method |

TABLE 10

| Toner particle No. | | | Toner particles 11 | Toner particles 12 | Toner particles 13 | Toner particles 14 | Toner particles 15 | Toner particles 16 |
|---|---|---|---|---|---|---|---|---|
| R in formula (T) | | | Methyl group | Methyl group | Methyl group | Methyl group | Methyl group | Methyl group |
| Number of carbon atoms of R in formula (T) | | | 1 | 1 | 1 | 1 | 1 | 1 |
| $R^1$ in formula (1) | | | Methyl group | Methyl group | Methyl group | Methyl group | Methyl group | Methyl group |
| Number of carbon atoms of $R^1$ in formula (1) | | | 1 | 1 | 1 | 1 | 1 | 1 |
| $R^2$, $R^3$, $R^4$ in formula (1) | | | Ethoxy group | Ethoxy group | Ethoxy group | Ethoxy group | Ethoxy group | Ethoxy group |
| Average thickness Dav. of toner surface layer containing organosilicon polymer (μm) | | | 39.80 | 10.40 | 5.40 | 58.20 | 38.40 | 34.20 |
| ASi/AC in mapping measurement with FIB-TOF-SIMS | After etching with FIB (integral dose rate) | No etching with FIB | 59.40 | 45.20 | 40.60 | 62.40 | 59.60 | 58.40 |
| | | $1.66 \times 10^{19}/m^2$ | 42.77 | 29.38 | 26.39 | 47.42 | 41.72 | 40.30 |
| | | $3.11 \times 10^{19}/m^2$ | 23.52 | 15.28 | 13.72 | 30.83 | 25.03 | 23.77 |
| | | $6.64 \times 10^{19}/m^2$ | 5.41 | 3.36 | 2.88 | 11.41 | 7.51 | 7.13 |
| | | $1.33 \times 10^{20}/m^2$ | 1.03 | 0.57 | 0.46 | 3.42 | 2.25 | 2.14 |
| | | $5.31 \times 10^{20}/m^2$ | 0.24 | 0.13 | 0.10 | 0.75 | 0.52 | 0.51 |
| | | $1.06 \times 10^{21}/m^2$ | 0.17 | 0.10 | 0.08 | 0.28 | 0.16 | 0.15 |
| | | $4.25 \times 10^{21}/m^2$ | 0.10 | 0.06 | 0.05 | 0.21 | 0.11 | 0.11 |
| ASi in mapping measurement with FIB-TOF-SIMS | After etching with FIB (integral dose rate) | No etching with FIB | $3.31 \times 10^{-4}$ | $1.42 \times 10^{-4}$ | $1.22 \times 10^{-4}$ | $3.54 \times 10^{-4}$ | $3.24 \times 10^{-4}$ | $3.13 \times 10^{-4}$ |
| | | $1.66 \times 10^{19}/m^2$ | $2.38 \times 10^{-4}$ | $9.23 \times 10^{-5}$ | $7.93 \times 10^{-5}$ | $2.57 \times 10^{-4}$ | $2.40 \times 10^{-4}$ | $2.32 \times 10^{-4}$ |
| | | $3.11 \times 10^{19}/m^2$ | $1.82 \times 10^{-4}$ | $7.38 \times 10^{-5}$ | $6.34 \times 10^{-5}$ | $2.18 \times 10^{-4}$ | $2.04 \times 10^{-4}$ | $1.97 \times 10^{-4}$ |
| | | $6.64 \times 10^{19}/m^2$ | $4.19 \times 10^{-5}$ | $1.62 \times 10^{-5}$ | $1.33 \times 10^{-5}$ | $9.51 \times 10^{-5}$ | $7.19 \times 10^{-5}$ | $6.95 \times 10^{-5}$ |
| | | $1.33 \times 10^{20}/m^2$ | $7.96 \times 10^{-6}$ | $2.76 \times 10^{-6}$ | $2.13 \times 10^{-6}$ | $6.99 \times 10^{-5}$ | $6.12 \times 10^{-5}$ | $5.92 \times 10^{-5}$ |

TABLE 10-continued

| | | | | | | |
|---|---|---|---|---|---|---|
| $5.31 \times 10^{20}/m^2$ | $1.83 \times 10^{-6}$ | $6.08 \times 10^{-7}$ | $4.69 \times 10^{-7}$ | $1.54 \times 10^{-5}$ | $1.41 \times 10^{-5}$ | $1.42 \times 10^{-5}$ |
| $1.06 \times 10^{21}/m^2$ | $1.34 \times 10^{-6}$ | $4.62 \times 10^{-7}$ | $3.47 \times 10^{-7}$ | $1.15 \times 10^{-5}$ | $1.07 \times 10^{-5}$ | $1.08 \times 10^{-5}$ |
| $4.25 \times 10^{21}/m^2$ | $8.01 \times 10^{-7}$ | $2.77 \times 10^{-7}$ | $2.08 \times 10^{-7}$ | $1.01 \times 10^{-6}$ | $7.60 \times 10^{-6}$ | $7.55 \times 10^{-6}$ |
| Silicon concentration in measurement by Electron Spectroscopy for Chemical Analysis (ESCA) of surface of toner particles (atomic %) | 19.8 | 14.2 | 5.1 | 26.5 | 18.8 | 16.4 |
| Percentage K of surface layer containing organosilicon polymer having surface layer thickness FRAn of 5.0 nm or less (% by number) | 0.0 | 18.8 | 25.0 | 0.0 | 12.5 | 20.6 |
| Production method | First production method | First production method | First production method | First production method | First production method | First production method |

| Toner particle No. | | | Toner particles 17 | Toner particles 18 | Toner particles 19 | Toner particles 20 |
|---|---|---|---|---|---|---|
| R in formula (T) | | | Methyl group | Methyl group, vinyl group | Methyl group, methyl group | Methyl group |
| Number of carbon atoms of R in formula (T) | | | 1, 0 | 1, 2 | 1 | 1 |
| $R^1$ in formula (1) | | | Methyl group | Methyl group, vinyl group | Methyl group, methyl group | Methyl group |
| Number of carbon atoms of $R^1$ in formula (1) | | | 1, 0 | 1, 2 | 1 | 1 |
| $R^2$, $R^3$, $R^4$ in formula (1) | | | Ethoxy group, ethoxy group | Ethoxy group, ethoxy group | Ethoxy group, methoxy group | Ethoxy group |
| Average thickness Dav. of toner surface layer containing organosilicon polymer (μm) | | | 36.20 | 52.20 | 51.40 | 23.20 |
| ASi/AC in mapping measurement with FIB-TOF-SIMS | After etching with FIB (integral dose rate) | No etching with FIB | 44.20 | 58.40 | 57.30 | 40.20 |
| | | $1.66 \times 10^{19}/m^2$ | 26.96 | 40.88 | 41.83 | 27.34 |
| | | $3.11 \times 10^{19}/m^2$ | 14.56 | 24.53 | 26.35 | 16.40 |
| | | $6.64 \times 10^{19}/m^2$ | 3.64 | 11.04 | 9.49 | 4.92 |
| | | $1.33 \times 10^{20}/m^2$ | 0.84 | 4.42 | 3.04 | 1.23 |
| | | $5.31 \times 10^{20}/m^2$ | 0.18 | 1.06 | 0.67 | 0.28 |
| | | $1.06 \times 10^{21}/m^2$ | 0.04 | 0.48 | 0.24 | 0.08 |
| | | $4.25 \times 10^{21}/m^2$ | 0.03 | 0.22 | 0.17 | 0.06 |
| ASi in mapping measurement with FIB-TOF-SIMS | After etching with FIB (integral dose rate) | No etching with FIB | $2.25 \times 10^{-4}$ | $3.02 \times 10^{-4}$ | $3.57 \times 10^{-4}$ | $1.97 \times 10^{-4}$ |
| | | $1.66 \times 10^{19}/m^2$ | $1.40 \times 10^{-4}$ | $2.20 \times 10^{-4}$ | $2.57 \times 10^{-4}$ | $1.36 \times 10^{-4}$ |
| | | $3.11 \times 10^{19}/m^2$ | $1.26 \times 10^{-4}$ | $1.87 \times 10^{-4}$ | $1.65 \times 10^{-4}$ | $8.16 \times 10^{-5}$ |
| | | $6.64 \times 10^{19}/m^2$ | $3.49 \times 10^{-5}$ | $9.92 \times 10^{-5}$ | $9.25 \times 10^{-5}$ | $3.94 \times 10^{-5}$ |
| | | $1.33 \times 10^{20}/m^2$ | $2.90 \times 10^{-5}$ | $7.49 \times 10^{-5}$ | $5.26 \times 10^{-5}$ | $2.01 \times 10^{-5}$ |
| | | $5.31 \times 10^{20}/m^2$ | $6.09 \times 10^{-6}$ | $1.80 \times 10^{-5}$ | $1.16 \times 10^{-5}$ | $4.63 \times 10^{-6}$ |
| | | $1.06 \times 10^{21}/m^2$ | $4.38 \times 10^{-6}$ | $1.26 \times 10^{-5}$ | $8.80 \times 10^{-6}$ | $3.48 \times 10^{-6}$ |
| | | $4.25 \times 10^{21}/m^2$ | $3.07 \times 10^{-6}$ | $5.91 \times 10^{-6}$ | $6.16 \times 10^{-6}$ | $2.43 \times 10^{-6}$ |
| Silicon concentration in measurement by Electron Spectroscopy for Chemical Analysis (ESCA) of surface of toner particles (atomic %) | | | 18.2 | 23.4 | 24.5 | 18.2 |
| Percentage K of surface layer containing organosilicon polymer having surface layer thickness FRAn of 5.0 nm or less (% by number) | | | 21.9 | 0.0 | 0.0 | 15.6 |
| Production method | | | First production method | First production method | First production method | First production method |

TABLE 11

| Toner particle No. | | | Toner particles 21 | Toner particles 22 | Toner particles 23 | Toner particles 24 | Toner particles 25 |
|---|---|---|---|---|---|---|---|
| R in formula (T) | | | Methyl group | Methyl group | Methyl group | Methyl group | Methyl group |
| Number of carbon atoms of R in formula (T) | | | 1 | 1 | 1 | 1 | 1 |
| $R^1$ in formula (1) | | | Methyl group | Methyl group | Methyl group | Methyl group | Methyl group |
| Number of carbon atoms of $R^1$ in formula (1) | | | 1 | 1 | 1 | 1 | 1 |
| $R^2$, $R^3$, $R^4$ in formula (1) | | | Ethoxy group | Ethoxy group | Ethoxy group | Ethoxy group | Ethoxy group |
| Average thickness Dav. of toner surface layer containing organosilicon polymer (μm) | | | 14.30 | 45.40 | 55.00 | 51.20 | 40.10 |
| ASi/AC in mapping measurement with FIB-TOF-SIMS | After etching with FIB (integral dose rate) | No etching with FIB | 40.30 | 70.40 | 96.20 | 71.20 | 60.10 |
| | | $1.66 \times 10^{19}/m^2$ | 26.20 | 42.10 | 70.23 | 43.10 | 41.20 |
| | | $3.11 \times 10^{19}/m^2$ | 15.46 | 12.80 | 44.94 | 13.20 | 21.40 |
| | | $6.64 \times 10^{19}/m^2$ | 4.33 | 3.10 | 15.28 | 4.42 | 7.17 |

TABLE 11-continued

| | | | | | | | |
|---|---|---|---|---|---|---|---|
| | | $1.33 \times 10^{20}/m^2$ | 0.95 | 0.81 | 5.20 | 1.67 | 2.71 |
| | | $5.31 \times 10^{20}/m^2$ | 0.21 | 0.18 | 1.19 | 0.37 | 0.60 |
| | | $1.06 \times 10^{21}/m^2$ | 0.06 | 0.13 | 0.42 | 0.12 | 0.20 |
| | | $4.25 \times 10^{21}/m^2$ | 0.04 | 0.09 | 0.29 | 0.09 | 0.14 |
| ASi in mapping measurement with FIB-TOF-SIMS | After etching with FIB (integral dose rate) | No etching with FIB | $1.90 \times 10^{-4}$ | $3.95 \times 10^{-4}$ | $4.86 \times 10^{-4}$ | $4.64 \times 10^{-4}$ | $2.18 \times 10^{-4}$ |
| | | $1.66 \times 10^{19}/m^2$ | $1.31 \times 10^{-4}$ | $3.27 \times 10^{-4}$ | $3.55 \times 10^{-4}$ | $3.42 \times 10^{-4}$ | $1.75 \times 10^{-4}$ |
| | | $3.11 \times 10^{19}/m^2$ | $7.87 \times 10^{-5}$ | $2.01 \times 10^{-4}$ | $2.24 \times 10^{-4}$ | $2.05 \times 10^{-4}$ | $1.19 \times 10^{-4}$ |
| | | $6.64 \times 10^{19}/m^2$ | $3.54 \times 10^{-5}$ | $7.21 \times 10^{-5}$ | $8.24 \times 10^{-5}$ | $6.89 \times 10^{-5}$ | $8.94 \times 10^{-5}$ |
| | | $1.33 \times 10^{20}/m^2$ | $1.81 \times 10^{-5}$ | $5.65 \times 10^{-5}$ | $2.60 \times 10^{-5}$ | $2.24 \times 10^{-5}$ | $1.77 \times 10^{-5}$ |
| | | $5.31 \times 10^{20}/m^2$ | $3.98 \times 10^{-6}$ | $1.24 \times 10^{-5}$ | $5.98 \times 10^{-6}$ | $4.93 \times 10^{-5}$ | $3.89 \times 10^{-6}$ |
| | | $1.06 \times 10^{21}/m^2$ | $2.99 \times 10^{-6}$ | $9.45 \times 10^{-6}$ | $4.49 \times 10^{-6}$ | $3.70 \times 10^{-6}$ | $2.92 \times 10^{-6}$ |
| | | $4.25 \times 10^{21}/m^2$ | $2.09 \times 10^{-6}$ | $6.61 \times 10^{-6}$ | $3.14 \times 10^{-6}$ | $2.59 \times 10^{-6}$ | $2.04 \times 10^{-6}$ |
| Silicon concentration in measurement by Electron Spectroscopy for Chemical Analysis (ESCA) of surface of toner particles (atomic %) | | | 8.4 | 21.2 | 25.3 | 24.1 | 19.4 |
| Percentage K of surface layer containing organosilicon polymer having surface layer thickness FRAn of 5.0 nm or less (% by number) | | | 14.3 | 21.9 | 0.0 | 0.0 | 0.0 |
| Production method | | | First production method | Second production method | First production method | Third production method | Fourth production method |

| Toner particle No. | | | Toner particles 26 | Toner particles 27 | Toner particles 28 | Toner particles 29 |
|---|---|---|---|---|---|---|
| R in formula (T) | | | Methyl group | Methyl group | Methyl group | Methyl group |
| Number of carbon atoms of R in formula (T) | | | 1 | 1 | 1 | 1 |
| $R^1$ in formula (1) | | | Methyl group | Methyl group | Methyl group | Methyl group |
| Number of carbon atoms of $R^1$ in formula (1) | | | 1 | 1 | 1 | 1 |
| $R^2$, $R^3$, $R^4$ in formula (1) | | | Ethoxy group | Ethoxy group | Ethoxy group | Ethoxy group |
| Average thickness Dav. of toner surface layer containing organosilicon polymer (μm) | | | 41.30 | 55.10 | 53.10 | 56.10 |
| ASi/AC in mapping measurement with FIB-TOF-SIMS | After etching with FIB (integral dose rate) | No etching with FIB | 64.06 | 94.20 | 94.20 | 96.34 |
| | | $1.66 \times 10^{19}/m^2$ | 38.31 | 69.71 | 70.24 | 72.10 |
| | | $3.11 \times 10^{19}/m^2$ | 11.65 | 43.22 | 43.67 | 45.12 |
| | | $6.64 \times 10^{19}/m^2$ | 2.82 | 14.48 | 14.70 | 14.90 |
| | | $1.33 \times 10^{20}/m^2$ | 0.74 | 5.47 | 5.34 | 5.71 |
| | | $5.31 \times 10^{20}/m^2$ | 0.15 | 1.26 | 1.18 | 1.34 |
| | | $1.06 \times 10^{21}/m^2$ | 0.11 | 0.42 | 0.90 | 0.98 |
| | | $4.25 \times 10^{21}/m^2$ | 0.08 | 0.30 | 0.60 | 0.67 |
| ASi in mapping measurement with FIB-TOF-SIMS | After etching with FIB (integral dose rate) | No etching with FIB | $3.58 \times 10^{-4}$ | $4.75 \times 10^{-4}$ | $4.77 \times 10^{-4}$ | $4.97 \times 10^{-4}$ |
| | | $1.66 \times 10^{19}/m^2$ | $3.37 \times 10^{-4}$ | $3.42 \times 10^{-4}$ | $3.31 \times 10^{-4}$ | $3.76 \times 10^{-4}$ |
| | | $3.11 \times 10^{19}/m^2$ | $2.70 \times 10^{-4}$ | $2.14 \times 10^{-4}$ | $2.10 \times 10^{-4}$ | $2.28 \times 10^{-4}$ |
| | | $6.64 \times 10^{19}/m^2$ | $2.01 \times 10^{-4}$ | $7.12 \times 10^{-5}$ | $7.21 \times 10^{-5}$ | $7.39 \times 10^{-5}$ |
| | | $1.33 \times 10^{20}/m^2$ | $2.01 \times 10^{-5}$ | $2.64 \times 10^{-5}$ | $2.54 \times 10^{-5}$ | $2.96 \times 10^{-5}$ |
| | | $5.31 \times 10^{20}/m^2$ | $4.02 \times 10^{-6}$ | $6.07 \times 10^{-6}$ | $5.97 \times 10^{-6}$ | $6.34 \times 10^{-6}$ |
| | | $1.06 \times 10^{21}/m^2$ | $2.73 \times 10^{-6}$ | $4.49 \times 10^{-6}$ | $4.41 \times 10^{-6}$ | $4.76 \times 10^{-6}$ |
| | | $4.25 \times 10^{21}/m^2$ | $1.91 \times 10^{-6}$ | $3.15 \times 10^{-6}$ | $3.02 \times 10^{-6}$ | $3.34 \times 10^{-6}$ |
| Silicon concentration in measurement by Electron Spectroscopy for Chemical Analysis (ESCA) of surface of toner particles (atomic %) | | | 20.1 | 24.3 | 25.4 | 24.3 |
| Percentage K of surface layer containing organosilicon polymer having surface layer thickness FRAn of 5.0 nm or less (% by number) | | | 28.1 | 0.0 | 0.0 | 0.0 |
| Production method | | | Fifth production method | First production method | First production method | First production method |

TABLE 12

| Toner particle No. | Comparative toner particles 1 | Comparative toner particles 2 | Comparative toner particles 3 | Comparative toner particles 4 | Comparative toner particles 5 | Comparative toner particles 6 |
|---|---|---|---|---|---|---|
| R in formula (T3) | Methyl group | Methyl group | None | 3-Methacryloxy-propyl group | 3-Methacryloxy-propyl group | 3-Methacryloxy-propyl group |
| Number of carbon atoms of R in formula (T3) | 1 | 1 | 0 | 7 | 7 | 7 |
| $R^1$ in formula (1) | Methyl group | Methyl group | None | 3-Methacryloxy-propyl group | 3-Methacryloxy-propyl group | 3-Methacryloxy-propyl group |

TABLE 12-continued

| | | | | | | | | |
|---|---|---|---|---|---|---|---|---|
| Number of carbon atoms of $R^1$ in formula (1) | | | 1 | 1 | 0 | 7 | 7 | 7 |
| $R^2$, $R^3$, $R^4$ in formula (1) | | | Ethoxy group | Ethoxy group | Ethoxy group | Methoxy group | Methoxy group | Methoxy group |
| Average thickness Dav. of toner surface layer containing organosilicon polymer (μm) | | | 4.2 | 4 | 4.8 | 3.5 | 2.4 | 3.7 |
| ASi/AC in mapping measurement with FIB-TOF-SIMS | After etching with FIB (integral dose rate) | No etching with FIB | 19.1 | 18.4 | 34.4 | 1.3 | 1 | 1.2 |
| | | $1.66 \times 10^{19}/m^2$ | 13.67 | 12.51 | 20.30 | 0.59 | 0.45 | 0.54 |
| | | $3.11 \times 10^{19}/m^2$ | 2.73 | 2.75 | 9.50 | 0.53 | 0.41 | 0.48 |
| | | $6.64 \times 10^{19}/m^2$ | 0.27 | 0.28 | 1.90 | 0.45 | 0.34 | 0.40 |
| | | $1.33 \times 10^{20}/m^2$ | 0.03 | 0.03 | 0.19 | 0.38 | 0.29 | 0.34 |
| | | $5.31 \times 10^{20}/m^2$ | 0.01 | 0.01 | 0.11 | 0.26 | 0.20 | 0.23 |
| | | $1.06 \times 10^{21}/m^2$ | 0.00 | 0.00 | 0.09 | 0.21 | 0.16 | 0.19 |
| | | $4.25 \times 10^{21}/m^2$ | 0.00 | 0.00 | 0.01 | 0.13 | 0.10 | 0.11 |
| ASi in mapping measurement with FIB-TOF-SIMS | After etching with FIB (integral dose rate) | No etching with FIB | $7.32 \times 10^{-5}$ | $6.98 \times 10^{-5}$ | $1.07 \times 10^{-4}$ | $3.49 \times 10^{-6}$ | $2.34 \times 10^{-6}$ | $2.98 \times 10^{-6}$ |
| | | $1.66 \times 10^{19}/m^2$ | $4.98 \times 10^{-5}$ | $4.68 \times 10^{-5}$ | $5.52 \times 10^{-5}$ | $1.58 \times 10^{-6}$ | $1.05 \times 10^{-6}$ | $1.34 \times 10^{-6}$ |
| | | $3.11 \times 10^{19}/m^2$ | $3.19 \times 10^{-5}$ | $2.95 \times 10^{-5}$ | $2.59 \times 10^{-5}$ | $1.45 \times 10^{-6}$ | $4.42 \times 10^{-7}$ | $5.63 \times 10^{-7}$ |
| | | $6.64 \times 10^{19}/m^2$ | $3.15 \times 10^{-6}$ | $2.96 \times 10^{-6}$ | $5.18 \times 10^{-6}$ | $1.22 \times 10^{-6}$ | $3.80 \times 10^{-7}$ | $4.67 \times 10^{-7}$ |
| | | $1.33 \times 10^{20}/m^2$ | $3.12 \times 10^{-7}$ | $3.24 \times 10^{-7}$ | $5.44 \times 10^{-7}$ | $1.01 \times 10^{-6}$ | $3.19 \times 10^{-7}$ | $3.83 \times 10^{-7}$ |
| | | $5.31 \times 10^{20}/m^2$ | $6.07 \times 10^{-6}$ | $6.07 \times 10^{-6}$ | $6.07 \times 10^{-6}$ | $6.07 \times 10^{-6}$ | $6.07 \times 10^{-6}$ | $6.07 \times 10^{-6}$ |
| | | $1.06 \times 10^{21}/m^2$ | $4.49 \times 10^{-6}$ | $4.49 \times 10^{-6}$ | $4.49 \times 10^{-6}$ | $4.49 \times 10^{-6}$ | $4.49 \times 10^{-6}$ | $4.49 \times 10^{-6}$ |
| | | $4.25 \times 10^{21}/m^2$ | $3.15 \times 10^{-6}$ | $3.15 \times 10^{-6}$ | $3.15 \times 10^{-6}$ | $3.15 \times 10^{-6}$ | $3.15 \times 10^{-6}$ | $3.15 \times 10^{-6}$ |
| Silicon concentration in measurement by Electron Spectroscopy for Chemical Analysis (ESCA) of surface of toner particles (atomic %) | | | 4.7 | 2.3 | 25.4 | 2.4 | 1.5 | 2.2 |
| Percentage K of surface layer containing organosilicon polymer having surface layer thickness FRAn of 5.0 nm or less (% by number) | | | 78.1 | 93.8 | 50.0 | 94.4 | 100.0 | 97.2 |
| Production method | | | First production method | First production method | First production method | First production method | First production method | First production method |

| Toner particle No. | | | Comparative toner particles 7 | Comparative toner particles 8 | Comparative toner particles 9 | Comparative toner particles 10 |
|---|---|---|---|---|---|---|
| R in formula (T3) | | | 3-Methacryloxy-propyl group | Aminopropyl group | | Methyl group |
| Number of carbon atoms of R in formula (T3) | | | 7 | Hydrocarbon× | | 0, 1 |
| $R^1$ in formula (1) | | | 3-Methacryloxy-propyl group | Aminopropyl group | | Methyl group |
| Number of carbon atoms of $R^1$ in formula (1) | | | 7 | Hydrocarbon× | | 0, 1 |
| $R^2$, $R^3$, $R^4$ in formula (1) | | | Methoxy group | Methoxy group | | Ethoxy group |
| Average thickness Dav. of toner surface layer containing organosilicon polymer (μm) | | | 2.2 | 24 | 0.0 | 2.4 |
| ASi/AC in mapping measurement with FIB-TOF-SIMS | After etching with FIB (integral dose rate) | No etching with FIB | 0.7 | 32.4 | 0.0 | 9.8 |
| | | $1.66 \times 10^{19}/m^2$ | 0.32 | 22.68 | 0.00 | 7.15 |
| | | $3.11 \times 10^{19}/m^2$ | 0.28 | 15.42 | 0.00 | 4.44 |
| | | $6.64 \times 10^{19}/m^2$ | 0.24 | 3.08 | 0.0 | 1.33 |
| | | $1.33 \times 10^{20}/m^2$ | 0.20 | 0.31 | 0.00 | 0.27 |
| | | $5.31 \times 10^{20}/m^2$ | 0.14 | 0.19 | 0.00 | 0.06 |
| | | $1.06 \times 10^{21}/m^2$ | 0.11 | 0.09 | 0.00 | 0.04 |
| | | $4.25 \times 10^{21}/m^2$ | 0.07 | 0.01 | 0.00 | 0.00 |
| ASi in mapping measurement with FIB-TOF-SIMS | After etching with FIB (integral dose rate) | No etching with FIB | $1.04 \times 10^{-6}$ | $4.84 \times 10^{-5}$ | 0.00 | $3.24 \times 10^{-5}$ |
| | | $1.66 \times 10^{19}/m^2$ | $4.68 \times 10^{-7}$ | $3.39 \times 10^{-5}$ | 0.00 | $2.40 \times 10^{-5}$ |
| | | $3.11 \times 10^{19}/m^2$ | $1.97 \times 10^{-7}$ | $2.30 \times 10^{-5}$ | 0.00 | $1.51 \times 10^{-5}$ |
| | | $6.64 \times 10^{19}/m^2$ | $1.61 \times 10^{-7}$ | $4.61 \times 10^{-6}$ | 0.00 | $4.53 \times 10^{-6}$ |
| | | $1.33 \times 10^{20}/m^2$ | $1.32 \times 10^{-7}$ | $4.82 \times 10^{-7}$ | 0.00 | $9.06 \times 10^{-7}$ |
| | | $5.31 \times 10^{20}/m^2$ | $6.07 \times 10^{-6}$ | $6.07 \times 10^{-6}$ | 0.00 | $6.07 \times 10^{-6}$ |
| | | $1.06 \times 10^{21}/m^2$ | $4.49 \times 10^{-6}$ | $4.49 \times 10^{-6}$ | 0.00 | $4.49 \times 10^{-6}$ |
| | | $4.25 \times 10^{21}/m^2$ | $3.15 \times 10^{-6}$ | $3.15 \times 10^{-6}$ | 0.00 | $3.15 \times 10^{-6}$ |
| Silicon concentration in measurement by Electron Spectroscopy for Chemical Analysis (ESCA) of surface of toner particles (atomic %) | | | 1.2 | 22.4 | 0.0 | 2.6 |
| Percentage K of surface layer containing organosilicon polymer having surface layer thickness FRAn of 5.0 nm or less (% by number) | | | 100.0 | 24.0 | 100.0 | 96.8 |
| Production method | | | First production method | First production method | First production method | First production method |

TABLE 13

| | | | | Example 1 Toner 1 | Example 2 Toner 2 | Example 3 Toner 3 | Example 4 Toner 4 | Example 5 Toner 5 | Example 6 Toner 6 |
|---|---|---|---|---|---|---|---|---|---|
| Heat resistance | | | Storage stability (50° C./15 day) | A | A | B | C | B | A |
| | | | Long-term storage stability (45° C./95% 3 months) | A | B | C | C | B | A |
| Environmental stability | NN | Initial | Triboelectric charging amount (-mC/kg) | 40.1 | 38.1 | 37.4 | 37.0 | 38.2 | 40.2 |
| | | | NN fogging | 0.2 (A) | 0.4 (A) | 0.5 (A) | 0.6 (A) | 0.4 (A) | 0.2 (A) |
| | | | Density | 1.50 (A) | 1.47 (A) | 1.46 (A) | 1.45 (A) | 1.47 (A) | 1.49 (A) |
| | | After 1,100-sheet endurance | NN fogging | 0.3 (A) | 0.8 (A) | 1.1 (B) | 1.7 (C) | 0.6 (A) | 0.3 (A) |
| | | | Density | 1.50 (A) | 1.47 (A) | 1.45 (A) | 1.43 (B) | 1.46 (A) | 1.49 (A) |
| | | | Soiling of components | A | A | A | A | A | A |
| | LL | Initial | Triboelectric charging amount (-mC/kg) | 43.1 | 45.2 | 46.4 | 47.4 | 42.1 | 43.1 |
| | | | LL fogging | 0.3 (A) | 0.8 (A) | 1.0 (B) | 1.7 (C) | 0.5 (A) | 0.3 (A) |
| | | | Density | 1.51 (A) | 1.47 (A) | 1.42 (B) | 1.40 (B) | 1.47 (A) | 1.48 (A) |
| | | After 1,100-sheet endurance | LL fogging | 0.3 (A) | 0.8 (A) | 1.1 (B) | 1.9 (C) | 0.7 (A) | 0.3 (A) |
| | | | Density | 1.51 (A) | 1.47 (A) | 1.41 (B) | 1.38 (C) | 1.46 (A) | 1.48 (A) |
| | | | Soiling of components | A | A | A | B | A | A |
| | HH | Initial | Triboelectric charging amount (-mC/kg) | 39.4 | 33.1 | 31.2 | 30.2 | 35.4 | 39.6 |
| | | | HH fogging | 0.4 (A) | 0.9 (A) | 1.2 (B) | 1.5 (B) | 0.6 (A) | 0.5 (A) |
| | | | Density | 1.51 (A) | 1.42 (B) | 1.4 (B) | 1.38 (C) | 1.47 (A) | 1.48 (A) |
| | | After 1,100-sheet endurance | HH fogging | 0.4 (A) | 0.9 (A) | 1.3 (B) | 1.7 (C) | 0.7 (A) | 0.5 (A) |
| | | | Density | 1.51 (A) | 1.42 (B) | 1.39 (C) | 1.37 (C) | 1.46 (A) | 1.48 (A) |
| | | | Soiling of components | A | A | A | B | A | A |
| | SHH after left to stand in severe environment for 168 hours | Initial | Triboelectric charging amount (-mC/kg) | 37.4 | 26.5 | 25.4 | 20.2 | 30.5 | 36.8 |
| | | | SHH fogging | 0.6 (A) | 1.0 (B) | 1.6 (C) | 1.9 (C) | 1.2 (B) | 0.7 (A) |
| | | | Density | 1.49 (A) | 1.39 (C) | 1.38 (C) | 1.35 (C) | 1.45 (A) | 1.46 (A) |
| | | After 1,100-sheet endurance | SHH fogging | 0.6 (A) | 1.0 (B) | 1.7 (C) | 1.9 (C) | 1.2 (B) | 0.7 (A) |
| | | | Density | 1.49 (A) | 1.39 (C) | 1.37 (C) | 1.35 (C) | 1.42 (B) | 1.46 (A) |
| | | | Soiling of components | A | A | B | C | B | A |
| Low-temperature offset finish temperature | | | | 115 | 115 | 115 | 115 | 115 | 115 |

| | | | | Example 7 Toner 7 | Example 8 Toner 8 | Example 9 Toner 9 | Example 10 Toner 10 |
|---|---|---|---|---|---|---|---|
| Heat resistance | | | Storage stability (50° C./15 day) | A | A | A | A |
| | | | Long-term storage stability (45° C./95% 3 months) | A | A | A | A |
| Environmental stability | NN | Initial | Triboelectric charging amount (-mC/kg) | 40.1 | 40.0 | 42.4 | 40.4 |
| | | | NN fogging | 0.2 (A) | 0.2 (A) | 0.3 (A) | 0.4 (A) |
| | | | Density | 1.50 (A) | 1.49 (A) | 1.50 (A) | 1.50 (A) |
| | | After 1,100-sheet endurance | NN fogging | 0.4 (A) | 0.3 (A) | 0.3 (A) | 0.6 (A) |
| | | | Density | 1.50 (A) | 1.49 (A) | 1.50 (A) | 1.50 (A) |
| | | | Soiling of components | A | A | A | A |
| | LL | Initial | Triboelectric charging amount (-mC/kg) | 42.7 | 42.5 | 46.4 | 42.4 |
| | | | LL fogging | 0.4 (A) | 0.3 (A) | 0.3 (A) | 0.6 (A) |
| | | | Density | 1.48 (A) | 1.48 (A) | 1.48 (A) | 1.47 (A) |
| | | After 1,100-sheet endurance | LL fogging | 0.4 (A) | 0.3 (A) | 0.3 (A) | 0.6 (A) |
| | | | Density | 1.48 (A) | 1.48 (A) | 1.48 (A) | 1.47 (A) |
| | | | Soiling of components | A | A | A | A |
| | HH | Initial | Triboelectric charging amount (-mC/kg) | 39.3 | 39.2 | 41.2 | 38.2 |
| | | | HH fogging | 0.4 (A) | 0.5 (A) | 0.4 (A) | 0.7 (A) |
| | | | Density | 1.47 (A) | 1.46 (A) | 1.48 (A) | 1.53 (A) |
| | | After 1,100-sheet endurance | HH fogging | 0.4 (A) | 0.5 (A) | 0.4 (A) | 0.7 (A) |
| | | | Density | 1.47 (A) | 1.46 (A) | 1.48 (A) | 1.53 (A) |
| | | | Soiling of components | A | A | A | A |
| | SHH after left to stand in severe environment for 168 hours | Initial | Triboelectric charging amount (-mC/kg) | 37.4 | 32.4 | 40.2 | 36.2 |
| | | | SHH fogging | 0.6 (A) | 1.0 (B) | 0.5 (A) | 0.9 (A) |
| | | | Density | 1.45 (A) | 1.38 (C) | 1.48 (A) | 1.47 (A) |
| | | After 1,100-sheet endurance | SHH fogging | 0.6 (A) | 1.0 (B) | 0.5 (A) | 0.9 (A) |
| | | | Density | 1.45 (A) | 1.38 (C) | 1.48 (A) | 1.47 (A) |
| | | | Soiling of components | A | B | A | A |
| Low-temperature offset finish temperature | | | | 115 | 115 | 120 | 115 |

TABLE 14

| | | | | Example 11 Toner 11 | Example 12 Toner 12 | Example 13 Toner 13 | Example 14 Toner 14 | Example 15 Toner 15 | Example 16 Toner 16 |
|---|---|---|---|---|---|---|---|---|---|
| Heat resistance | | | Storage stability (50° C./15 day) | A | A | B | A | A | A |
| | | | Long-term storage stability (45° C./95% 3 months) | A | B | C | A | A | A |
| Environmental stability | NN | Initial | Triboelectric charging amount (-μC/g) | 39.8 | 39.4 | 39.0 | 40.4 | 40.2 | 38.4 |
| | | | NN fogging | 0.4 (A) | 0.5 (A) | 0.5 (A) | 0.2 (A) | 0.4 (A) | 0.6 (A) |
| | | | Density | 1.48 (A) | 1.48 (A) | 1.46 (A) | 1.51 (A) | 1.50 (A) | 1.48 (A) |
| | | After 1,100-sheet endurance | NN fogging | 0.6 (A) | 0.6 (A) | 0.1 (A) | 0.2 (A) | 0.6 (A) | 0.8 (A) |
| | | | Density | 1.48 (A) | 1.48 (A) | 1.45 (A) | 1.51 (A) | 1.50 (A) | 1.48 (A) |
| | | | Soiling of components | A | A | A | A | A | A |
| | LL | Initial | Triboelectric charging amount (-μC/g) | 42.0 | 41.5 | 48.0 | 41.4 | 42.3 | 44.2 |
| | | | LL fogging | 0.6 (A) | 0.6 (A) | 0.9 (A) | 0.2 (A) | 0.6 (A) | 0.8 (A) |
| | | | Density | 1.46 (A) | 1.44 (B) | 1.42 (B) | 1.51 (A) | 1.47 (A) | 1.43 (B) |
| | | After 1,100-sheet endurance | LL fogging | 0.6 (A) | 0.6 (A) | 1.0 (B) | 0.2 (A) | 0.6 (A) | 0.8 (A) |
| | | | Density | 1.46 (A) | 1.44 (B) | 1.41 (B) | 1.51 (A) | 1.47 (A) | 1.43 (B) |
| | | | Soiling of components | A | A | A | A | A | A |
| | HH | Initial | Triboelectric charging amount (-μC/g) | 36.4 | 35.4 | 31.9 | 40.0 | 38.1 | 36.1 |
| | | | HH fogging | 0.8 (A) | 0.9 (A) | 1.4 (B) | 0.3 (A) | 0.8 (A) | 1.4 (B) |
| | | | Density | 1.52 (A) | 1.49 (A) | 1.38 (C) | 1.50 (A) | 1.45 (A) | 1.41 (B) |
| | | After 1,100-sheet endurance | HH fogging | 0.8 (A) | 0.9 (A) | 1.5 (B) | 0.3 (A) | 0.8 (A) | 1.4 (B) |
| | | | Density | 1.52 (A) | 1.49 (A) | 1.37 (C) | 1.50 (A) | 1.45 (A) | 1.41 (B) |
| | | | Soiling of components | A | A | B | A | A | A |
| | SHH after left to stand in severe environment for 168 hours | Initial | Triboelectric charging amount (-μC/g) | 33.4 | 33.2 | 30.2 | 38.9 | 36.0 | 34.2 |
| | | | SHH fogging | 1.2 (B) | 1.6 (C) | 1.8 (C) | 0.4 (A) | 0.9 (A) | 1.6 (C) |
| | | | Density | 1.42 (B) | 1.38 (C) | 1.35 (C) | 1.50 (A) | 1.46 (A) | 1.38 (C) |
| | | After 1,100-sheet endurance | SHH fogging | 1.2 (B) | 1.6 (C) | 1.9 (C) | 0.4 (A) | 0.9 (A) | 1.6 (C) |
| | | | Density | 1.42 (B) | 1.38 (C) | 1.35 (C) | 1.50 (A) | 1.46 (A) | 1.38 (C) |
| | | | Soiling of components | B | B | C | A | B | B |
| Low-temperature offset finish temperature | | | | 115 | 115 | 115 | 115 | 115 | 115 |

| | | | | Example 17 Toner 17 | Example 18 Toner 18 | Example 19 Toner 19 | Example 20 Toner 20 |
|---|---|---|---|---|---|---|---|
| Heat resistance | | | Storage stability (50° C./15 day) | A | A | A | B |
| | | | Long-term storage stability (45° C./95% 3 months) | C | A | A | C |
| Environmental stability | NN | Initial | Triboelectric charging amount (-μC/g) | 44.2 | 39.8 | 40.0 | 38.4 |
| | | | NN fogging | 0.9 (A) | 0.2 (A) | 0.2 (A) | 0.6 (A) |
| | | | Density | 1.40 (B) | 1.49 (A) | 1.48 (A) | 1.47 (A) |
| | | After 1,100-sheet endurance | NN fogging | 1.0 (B) | 0.3 (A) | 0.3 (A) | 0.9 (A) |
| | | | Density | 1.40 (B) | 1.49 (A) | 1.48 (A) | 1.46 (A) |
| | | | Soiling of components | A | A | A | A |
| | LL | Initial | Triboelectric charging amount (-μC/g) | 44.9 | 40.4 | 40.8 | 46.4 |
| | | | LL fogging | 1.0 (B) | 0.3 (A) | 0.3 (A) | 0.8 (A) |
| | | | Density | 1.39 (C) | 1.48 (A) | 1.47 (A) | 1.36 (C) |
| | | After 1,100-sheet endurance | LL fogging | 1.0 (B) | 0.3 (A) | 0.3 (A) | 0.9 (A) |
| | | | Density | 1.39 (C) | 1.48 (A) | 1.47 (A) | 1.37 (C) |
| | | | Soiling of components | A | A | A | A |
| | HH | Initial | Triboelectric charging amount (-μC/g) | 34.2 | 39.0 | 38.8 | 31.6 |
| | | | HH fogging | 1.6 (C) | 0.4 (A) | 0.4 (A) | 1.6 (C) |
| | | | Density | 1.39 (C) | 1.46 (A) | 1.45 (A) | 1.36 (C) |
| | | After 1,100-sheet endurance | HH fogging | 1.6 (C) | 0.4 (A) | 0.4 (A) | 1.7 (C) |
| | | | Density | 1.39 (C) | 1.46 (A) | 1.45 (A) | 1.36 (C) |
| | | | Soiling of components | B | A | A | B |
| | SHH after left to stand in severe environment for 168 hours | Initial | Triboelectric charging amount (-μC/g) | 32.4 | 37.4 | 37.2 | 30.6 |
| | | | SHH fogging | 1.6 (C) | 0.7 (A) | 0.8 (A) | 1.9 (C) |
| | | | Density | 1.37 (C) | 1.45 (A) | 1.44 (B) | 1.35 (C) |
| | | After 1,100-sheet endurance | SHH fogging | 1.6 (C) | 0.7 (A) | 0.8 (A) | 1.9 (C) |
| | | | Density | 1.37 (C) | 1.45 (A) | 1.44 (B) | 1.35 (C) |
| | | | Soiling of components | B | A | A | C |
| Low-temperature offset finish temperature | | | | 115 | 115 | 115 | 115 |

TABLE 15

| | | | | Example 21 Toner 21 | Example 22 Toner 22 | Example 23 Toner 23 | Example 24 Toner 24 | Example 25 Toner 25 | Example 26 Toner 26 |
|---|---|---|---|---|---|---|---|---|---|
| Heat resistance | | | Storage stability (50° C./15 day) | A | A | A | A | A | A |
| | | | Long-term storage stability (45° C./95% 3 months) | A | A | A | A | A | A |
| Environmental stability | NN | Initial | Triboelectric charging amount (-mC/kg) | 40.1 | 38.2 | 39.9 | 39.9 | 39.8 | 39.7 |
| | | | NN fogging | 0.2 (A) | 0.8 (A) | 0.3 (A) | 0.3 (A) | 0.3 (A) | 0.2 (A) |
| | | | Density | 1.50 (A) | 1.57 (A) | 1.52 (A) | 1.52 (A) | 1.50 (A) | 1.52 (A) |
| | | After 1,100-sheet endurance | NN fogging | 0.3 (A) | 0.9 (A) | 0.4 (A) | 0.3 (A) | 0.4 (A) | 0.3 (A) |
| | | | Density | 1.50 (A) | 1.56 (A) | 1.51 (A) | 1.51 (A) | 1.49 (A) | 1.51 (A) |
| | | | Soiling of components | A | A | A | A | A | A |
| | LL | Initial | Triboelectric charging amount (-mC/kg) | 43.1 | 40.2 | 42.1 | 42.4 | 41.2 | 41.0 |
| | | | LL fogging | 0.3 (A) | 0.7 (A) | 0.4 (A) | 0.4 (A) | 0.3 (A) | 0.2 (A) |
| | | | Density | 1.51 (A) | 1.53 (A) | 1.50 (A) | 1.50 (A) | 1.51 (A) | 1.51 (A) |
| | | After 1,100-sheet endurance | LL fogging | 0.3 (A) | 0.8 (A) | 0.4 (A) | 0.4 (A) | 0.5 (A) | 0.3 (A) |
| | | | Density | 1.51 (A) | 1.50 (A) | 1.50 (A) | 1.52 (A) | 1.50 (A) | 1.50 (A) |
| | | | Soiling of components | A | A | A | A | A | A |
| | HH | Initial | Triboelectric charging amount (-mC/kg) | 39.4 | 36.4 | 39.4 | 39.6 | 38.6 | 39.0 |
| | | | HH fogging | 0.4 (A) | 1.2 (B) | 0.5 (A) | 0.4 (A) | 0.5 (A) | 0.3 (A) |
| | | | Density | 1.51 (A) | 1.52 (A) | 1.50 (A) | 1.52 (A) | 1.48 (A) | 1.51 (A) |
| | | After 1,100-sheet endurance | HH fogging | 0.4 (A) | 1.4 (B) | 0.4 (A) | 0.5 (A) | 0.7 (A) | 0.4 (A) |
| | | | Density | 1.51 (A) | 1.50 (A) | 1.48 (A) | 1.52 (A) | 1.46 (A) | 1.50 (A) |
| | | | Soiling of components | A | A | A | A | A | A |
| | SHH after left to stand in severe environment for 168 hours | Initial | Triboelectric charging amount (-mC/kg) | 37.4 | 34.2 | 37.2 | 38.3 | 36.8 | 37.2 |
| | | | SHH fogging | 0.6 (A) | 1.4 (B) | 0.8 (A) | 0.6 (A) | 0.7 (A) | 0.5 (A) |
| | | | Density | 1.49 (A) | 1.50 (A) | 1.47 (A) | 1.48 (A) | 1.46 (A) | 1.48 (A) |
| | | After 1,100-sheet endurance | SHH fogging | 0.6 (A) | 1.6 (C) | 0.7 (A) | 0.7 (A) | 0.9 (A) | 0.7 (A) |
| | | | Density | 1.49 (A) | 1.48 (A) | 1.46 (A) | 1.47 (A) | 1.43 (B) | 1.47 (A) |
| | | | Soiling of components | A | A | A | A | A | A |
| Low-temperature offset finish temperature | | | | 105 | 115 | 115 | 125 | 110 | 110 |

| | | | | Example 27 Toner 27 | Example 28 Toner 28 | Example 29 Toner 29 | Example 30 Toner particles 1 |
|---|---|---|---|---|---|---|---|
| Heat resistance | | | Storage stability (50° C./15 day) | A | A | A | A |
| | | | Long-term storage stability (45° C./95% 3 months) | A | A | A | A |
| Environmental stability | NN | Initial | Triboelectric charging amount (-mC/kg) | 39.9 | 39.4 | 41.5 | 38.7 |
| | | | NN fogging | 0.3 (A) | 0.3 (A) | 0.2 (A) | 0.9 (A) |
| | | | Density | 1.48 (A) | 1.51 (A) | 1.53 (A) | 1.53 (A) |
| | | After 1,100-sheet endurance | NN fogging | 0.3 (A) | 0.3 (A) | 0.3 (A) | 1.0 (B) |
| | | | Density | 1.49 (A) | 1.50 (A) | 1.52 (A) | 1.52 (A) |
| | | | Soiling of components | A | A | A | A |
| | LL | Initial | Triboelectric charging amount (-mC/kg) | 43.0 | 41.1 | 43.1 | 37.6 |
| | | | LL fogging | 0.3 (A) | 0.3 (A) | 0.2 (A) | 0.7 (A) |
| | | | Density | 1.50 (A) | 1.51 (A) | 1.52 (A) | 1.51 (A) |
| | | After 1,100-sheet endurance | LL fogging | 0.3 (A) | 0.3 (A) | 0.3 (A) | 0.9 (A) |
| | | | Density | 1.50 (A) | 1.50 (A) | 1.51 (A) | 1.50 (A) |
| | | | Soiling of components | A | A | A | A |
| | HH | Initial | Triboelectric charging amount (-mC/kg) | 39.2 | 38.7 | 38.7 | 35.3 |
| | | | HH fogging | 0.4 (A) | 0.4 (A) | 0.3 (A) | 1.4 (B) |
| | | | Density | 1.50 (A) | 1.51 (A) | 1.52 (A) | 1.51 (A) |
| | | After 1,100-sheet endurance | HH fogging | 0.5 (A) | 0.5 (A) | 0.4 (A) | 1.6 (C) |
| | | | Density | 1.49 (A) | 1.49 (A) | 1.51 (A) | 1.48 (A) |
| | | | Soiling of components | A | A | A | A |
| | SHH after left to stand in severe environment for 168 hours | Initial | Triboelectric charging amount (-mC/kg) | 36.7 | 37.4 | 38.4 | 33.2 |
| | | | SHH fogging | 0.5 (A) | 0.6 (A) | 0.4 (A) | 1.5 (C) |
| | | | Density | 1.48 (A) | 1.49 (A) | 1.50 (A) | 1.48 (A) |
| | | After 1,100-sheet endurance | SHH fogging | 0.7 (A) | 0.6 (A) | 0.5 (A) | 1.8 (C) |
| | | | Density | 1.45 (A) | 1.48 (A) | 1.49 (A) | 1.46 (A) |
| | | | Soiling of components | A | A | A | A |
| Low-temperature offset finish temperature | | | | 95 | 115 | 115 | 110 |

TABLE 16

| | | | | Comparative Example 1 Comparative toner 1 | Comparative Example 2 Comparative toner 2 | Comparative Example 3 Comparative toner 3 | Comparative Example 4 Comparative toner 4 | Comparative Example 5 Comparative toner 5 | Comparative Example 6 Comparative toner 6 |
|---|---|---|---|---|---|---|---|---|---|
| Heat resistance | | | Storage stability (50° C./15 day) | C | C | D | C | C | B |
| | | | Long-term storage stability (45° C./95% 3 months) | E | E | E | D | D | D |
| Environmental stability | NN | Initial | Triboelectric charging amount (-μC/g) | 38.2 | 38.0 | 45.2 | 39.2 | 38.2 | 41.2 |
| | | | NN fogging | 0.7 (A) | 0.8 (A) | 1.2 (B) | 0.8 (A) | 1.2 (B) | 0.6 (A) |
| | | | Density | 1.42 (B) | 1.41 (B) | 1.38 (C) | 1.40 (B) | 1.38 (C) | 1.42 (B) |
| | | After 1,100-sheet endurance | NN fogging | 0.9 (A) | 1.2 (B) | 1.4 (B) | 1.2 (B) | 1.4 (B) | 1.2 (B) |
| | | | Density | 1.38 (C) | 1.37 (C) | 1.34 (C) | 1.37 (C) | 1.35 (C) | 1.39 (C) |
| | | | Soiling of components | A | A | A | A | A | A |
| | LL | Initial | Triboelectric charging amount (-μC/g) | 50.1 | 50.5 | 52.1 | 41.9 | 43.5 | 42.5 |
| | | | LL fogging | 1.1 (B) | 1.5 (C) | 1.6 (C) | 0.9 (A) | 1.6 (C) | 0.7 (A) |
| | | | Density | 1.40 (B) | 1.39 (C) | 1.38 (C) | 1.38 (C) | 1.34 (C) | 1.40 (B) |
| | | After 1,100-sheet endurance | LL fogging | 1.3 (B) | 1.7 (C) | 1.9 (C) | 1.1 (B) | 1.8 (C) | 0.8 (A) |
| | | | Density | 1.38 (C) | 1.37 (C) | 1.35 (C) | 1.36 (C) | 1.32 (C) | 1.39 (C) |
| | | | Soiling of components | B | B | B | B | B | B |
| | HH | Initial | Triboelectric charging amount (-μC/g) | 31.2 | 30.2 | 29.4 | 31.6 | 30.4 | 36.2 |
| | | | HH fogging | 1.4 (B) | 2.0 (D) | 2.1 (D) | 1.6 (C) | 1.8 (C) | 0.8 (A) |
| | | | Density | 1.34 (C) | 1.32 (C) | 1.29 (D) | 1.34 (0 | 1.32 (0 | 1.37 (0 |
| | | After 1,100-sheet endurance | HH fogging | 1.6 (C) | 2.2 (D) | 2.4 (D) | 1.8 (C) | 2.0 (D) | 0.9 (A) |
| | | | Density | 1.32 (C) | 1.30 (C) | 1.26 (D) | 1.32 (0 | 1.30 (0 | 1.36 (0 |
| | | | Soiling of components | B | C | B | B | B | B |
| | SHH after left to stand in severe environment for 168 hours | Initial | Triboelectric charging amount (-μC/g) | 19.4 | 18.4 | 18.4 | 18.2 | 17.1 | 19.2 |
| | | | SHH fogging | 2.4 (D) | 2.6 (E) | 2.8 (E) | 2.2 (D) | 2.4 (D) | 2.0 (D) |
| | | | Density | 1.29 (D) | 1.28 (D) | 1.28 (D) | 1.29 (D) | 1.24 (D) | 1.32 (0 |
| | | After 1,100-sheet endurance | SHH fogging | 2.6 (E) | 2.8 (E) | 3.1 (F) | 2.4 (D) | 2.6 (E) | 2.1 (D) |
| | | | Density | 1.27 (D) | 1.26 (D) | 1.25 (D) | 1.27 (D) | 1.22 (E) | 1.31 (0 |
| | | | Soiling of components | D | D | D | D | D | D |
| Low-temperature offset finish temperature | | | | 115 | 115 | 115 | 115 | 115 | 115 |

| | | | | Comparative Example 7 Comparative toner 7 | Comparative Example 8 Comparative toner 8 | Comparative Example 9 Comparative toner 9 | Comparative Example 10 Comparative toner 10 |
|---|---|---|---|---|---|---|---|
| Heat resistance | | | Storage stability (50° C./15 day) | C | C | F | B |
| | | | Long-term storage stability (45° C./95% 3 months) | E | C | F | E |
| Environmental stability | NN | Initial | Triboelectric charging amount (-μC/g) | 41.6 | 8.2 | 32.1 | 38.0 |
| | | | NN fogging | 1.5 (C) | 6.4 (F) | 4.3 (F) | 0.6 (A) |
| | | | Density | 1.41 (B) | 0.89 (F) | 0.67 (F) | 1.41 (B) |
| | | After 1,100-sheet endurance | NN fogging | 1.7 (C) | 6.38 (F) | 3.8 (F) | 1.2 (B) |
| | | | Density | 1.37 (C) | 0.87 (F) | 0.62 (F) | 1.37 (C) |
| | | | Soiling of components | A | C | F | A |
| | LL | Initial | Triboelectric charging amount (-μC/g) | 45.4 | 10.4 | 36.4 | 49.6 |
| | | | LL fogging | 1.7 (C) | 7.4 (F) | 6.5 (F) | 1.0 (B) |
| | | | Density | 1.42 (B) | 0.72 (F) | 0.54 (F) | 1.4 1 (B) |

TABLE 16-continued

| | | | | | | |
|---|---|---|---|---|---|---|
| | After 1,100-sheet endurance | LL fogging | 1.9 (C) | 7.4 (F) | 7.0 (F) | 1.2 (B) |
| | | Density | 1.40 (B) | 0.70 (F) | 0.49 (F) | 1.39 (C) |
| | | Soiling of components | B | C | F | B |
| HH | Initial | Triboelectric charging amount (-μC/g) | 31.4 | 6.1 | 26.4 | 30.6 |
| | | HH fogging | 2.1 (D) | 8.2 (F) | 8.6 (F) | 1.3 (B) |
| | | Density | 1.24 (E) | 0.66 (F) | 0.55 (F) | 1.32 (0 |
| | After 1,100-sheet endurance | HH fogging | 2.3 (D) | 8.2 (F) | 9.1 (F) | 1.5 (C) |
| | | Density | 1.22 (E) | 0.64 (F) | 0.5 (F) | 1.30 (0 |
| | | Soiling of components | C | C | F | B |
| SHH after left to stand in severe environment for 168 hours | Initial | Triboelectric charging amount (-μC/g) | 12.4 | 4.3 | 13.1 | 19.3 |
| | | SHH fogging | 2.6 (E) | 10.4 (F) | 11.2 (F) | 2.6 (E) |
| | | Density | 1.20 (F) | 0.53 (F) | 0.48 (F) | 1.29 (D) |
| | After 1,100-sheet endurance | SHH fogging | 2.8 (E) | 10.4 (F) | 12.5 (F) | 2.8 (E) |
| | | Density | 1.18 (F) | 0.51 (F) | 0.40 (F) | 1.27 (D) |
| | | Soiling of components | E | F | F | D |
| Low-temperature offset finish temperature | | | 115 | 115 | 115 | 115 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-131706 filed Jun. 26, 2014, which is hereby incorporated by reference herein in its entirety.

What is claimed is:

1. A toner, comprising toner particles, each of which has a surface layer containing an organosilicon polymer, wherein the organosilicon polymer has a partial structure represented by the following formula (T3), $$R—Si(O_{1/2})_3 \quad (T3)$$

wherein R denotes an alkyl group having 1 to 6 carbon atoms or a phenyl group, wherein the surface layer has an average thickness Dav. of 5.0 nm or more and 150.0 nm or less as measured by observing a cross section of each of the toner particles with a transmission electron microscope (TEM), and the toner has a ratio (ASi/AC) of 20.00 or more in mapping measurement by focused-ion-beam time-of-flight secondary ion mass spectrometry (FIB-TOF-SIMS), wherein ASi denotes ISi/I, AC denotes IC/I, ISi denotes an intensity of silicon ions, IC denotes an intensity of carbon ions, and I denotes the number of primary ions, the silicon ions and carbon ions being emitted from the toner particles in response to irradiation of the toner particles with the primary ions, and a concentration of silicon elements on a surface of the toner particles is 5.0 atomic percent or more as measured by electron spectroscopy for chemical analysis (ESCA).

2. The toner according to claim 1, wherein a percentage of line segments $Ar_n$ (n=1 to 32) having $FRA_n$ of 5.0 nm or less is 20.0% or less in observation of a cross section of each of the toner particles with a transmission electron microscope (TEM), wherein $Ar_n$ (n=1 to 32) denotes 32 line segments drawn from a midpoint of a long axis L to a surface of the toner particles at intervals of 11.25 degrees with respect to a line segment a, the long axis L is a longest chord in the cross section of each of the toner particles, the line segment a is one of line segments formed by dividing the long axis L at the midpoint thereof, and $FRA_n$ (n=1 to 32) denotes a length of the surface layer along the $Ar_n$ (n=1 to 32).

3. The toner according to claim 1, wherein the organosilicon polymer is produced by polymerization of an organosilicon compound having a structure represented by the following formula (1):

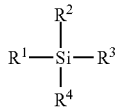

(1)

wherein $R^1$ denotes an alkyl group having 1 to 6 carbon atoms or a phenyl group, and $R^2$, $R^3$, and $R^4$ independently denote a halogen atom, a hydroxy group, an acetoxy group, or an alkoxy group.

4. The toner according to claim 3, wherein $R^1$ in the formula (1) denotes a methyl group, an ethyl group, a propyl group, or a phenyl group.

5. The toner according to claim 4, wherein $R^1$ in the formula (1) denotes a methyl group.

6. The toner according to claim 3, wherein $R^2$, $R^3$, and $R^4$ in the formula (1) independently denote an alkoxy group.

7. The toner according to claim 6, wherein $R^2$, $R^3$, and $R^4$ in the formula (1) independently denote a methoxy group or an ethoxy group.

8. The toner according to claim 1, wherein the toner particles are produced by forming particles of a polymerizable monomer composition in an aqueous medium, the polymerizable monomer composition containing a colorant and a polymerizable monomer, and polymerizing the polymerizable monomer.

9. The toner according to claim 8, wherein the polymerizable monomer composition contains a styrene monomer and an acrylic or methacrylic polymerizable monomer as polymerizable monomers.

10. The toner according to claim 1, wherein the concentration of silicon elements on the surface of the toner particles is 10.0 atomic percent or more.

11. The toner according to claim 1, wherein R in the formula (T3) denotes a methyl group.

* * * * *